US011375805B2

(12) United States Patent
Hurley

(10) Patent No.: US 11,375,805 B2
(45) Date of Patent: Jul. 5, 2022

(54) MULTI-PURPOSE PORTABLE PLATFORM STAGE

(71) Applicant: Peter Hurley, Cardiff, CA (US)

(72) Inventor: Peter Hurley, Cardiff, CA (US)

( * ) Notice: Subject to any disclaimer, the term of this patent is extended or adjusted under 35 U.S.C. 154(b) by 0 days.

(21) Appl. No.: 16/584,927

(22) Filed: Sep. 26, 2019

(65) Prior Publication Data

US 2020/0154877 A1 May 21, 2020

Related U.S. Application Data

(60) Provisional application No. 62/859,364, filed on Jun. 10, 2019, provisional application No. 62/738,186, filed on Sep. 28, 2018.

(51) Int. Cl.

| | |
|---|---|
| ***A47B 3/00*** | (2006.01) |
| ***A47B 3/083*** | (2006.01) |
| ***A63B 21/00*** | (2006.01) |
| *A47B 9/00* | (2006.01) |
| *A47B 87/00* | (2006.01) |
| *A47B 91/02* | (2006.01) |
| *A63J 1/00* | (2006.01) |

(52) U.S. Cl.

CPC ..... *A47B 3/083* (2013.01); *A63B 21/4037* (2015.10); *A47B 9/00* (2013.01); *A47B 87/002* (2013.01); *A47B 91/02* (2013.01); *A47B 2003/0835* (2013.01); *A63J 1/00* (2013.01)

(58) Field of Classification Search

CPC ..... A63J 1/00; A63J 3/00; E04H 3/24; E04H 3/28; A63B 21/4037; A47B 3/083; A47B 3/08; A47B 9/00; A47B 87/002; A47B 91/02; A47B 2003/0835; A47B 2003/0824; A47B 2003/0821; E04G 1/00; E04G 1/28

USPC ..... 108/166–175, 127, 115, 131, 129, 64; 52/7; 248/188, 163.1, 165, 166, 170, 248/171, 439

See application file for complete search history.

(56) References Cited

U.S. PATENT DOCUMENTS 2,342,591 A * 2/1944 McLean ..... A47B 3/083 108/168
2,529,940 A * 11/1950 Higley ..... A47B 3/0917 108/127

(Continued)

FOREIGN PATENT DOCUMENTS

DE 10149432 * 4/2003
DE 202015004007 * 8/2015

(Continued)

OTHER PUBLICATIONS

KR2016130644; abstract and figure; Han (Year: 2016).*

*Primary Examiner* — Janet M Wilkens
(74) *Attorney, Agent, or Firm* — Timothy J. Bortree

(57) ABSTRACT

Described herein is a multi-purpose portable platform stage for elevating a platform of the stage over a surface on which the stage is placed, that can be converted by a single person individually without assistance from an operational configuration in which one or more persons can stand, move and operate on the platform without the platform collapsing, and in which one or more objects can be placed and used on the platform, by or without such persons, without the platform collapsing, to a portable configuration in which the single person can carry the stage individually without assistance.

20 Claims, 43 Drawing Sheets

(56) References Cited

U.S. PATENT DOCUMENTS 2,699,977 A * 1/1955 Breslow ..... A47B 3/083 108/35
2,707,664 A * 5/1955 Marsilius ..... A47B 3/083 108/127
2,845,316 A * 7/1958 Bailey ..... A47B 3/08 108/127
2,851,311 A * 9/1958 Gibbs ..... E04G 1/28 182/222
2,991,139 A * 7/1961 Fihe ..... A47B 3/087 108/168
3,208,407 A * 9/1965 Maskew ..... A47C 17/80 108/170
4,041,880 A * 8/1977 Schankman ..... A47B 25/00 108/175
4,043,277 A * 8/1977 Wallace ..... A47B 3/083 108/35
4,494,465 A * 1/1985 Fick, Jr. ..... A47B 3/083 108/131
5,029,671 A * 7/1991 Larson ..... E04G 1/34 182/155
7,370,908 B2 * 5/2008 Crowell ..... A47C 4/02 108/118
9,848,695 B1 * 12/2017 Gauss ..... A47B 37/04
2008/0092786 A1 * 4/2008 Chen ..... A47B 3/08 108/131
2009/0139151 A1 * 6/2009 Quam ..... E04H 3/28 52/7
2019/0053885 A1 * 2/2019 Flynn ..... A47B 3/0818

FOREIGN PATENT DOCUMENTS

EP 372284 * 6/1990
FR 2227716 * 11/1974
WO 2019073255 * 4/2019

* cited by examiner

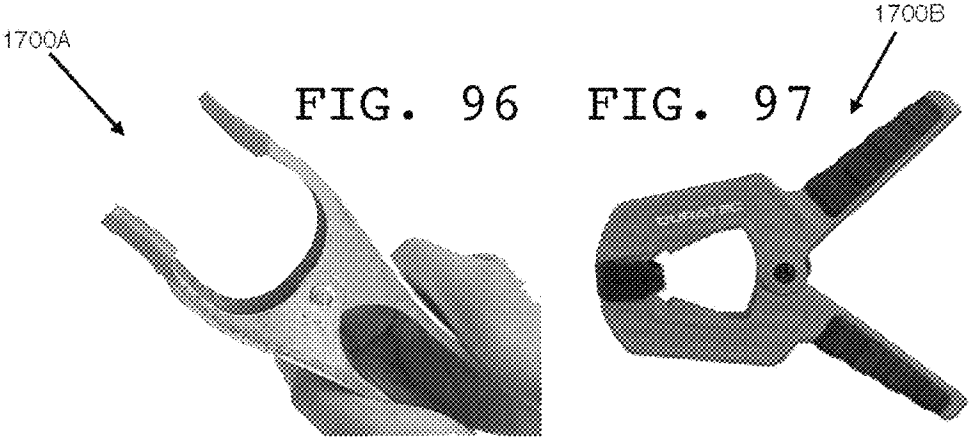
FIG. 96
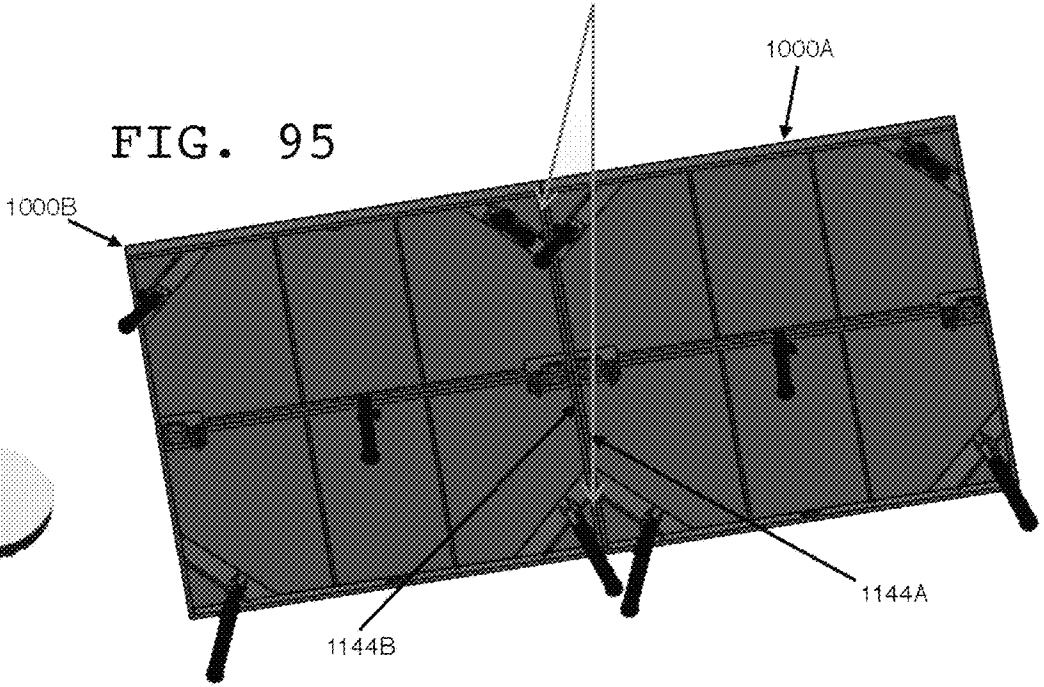
FIG. 95
FIG. 97
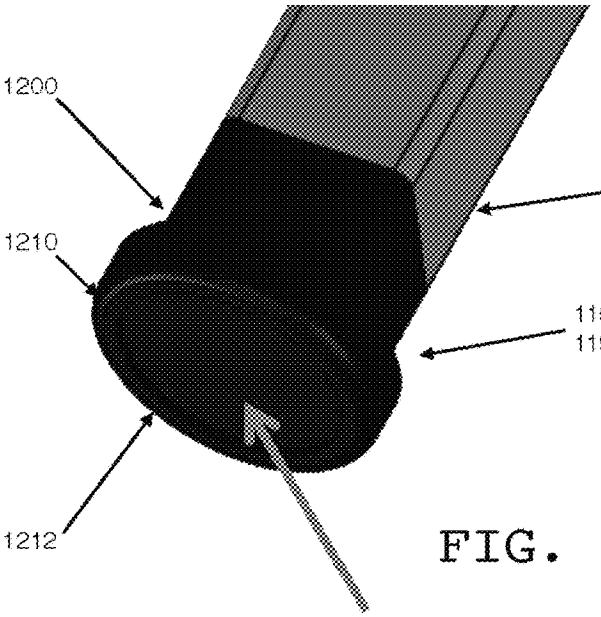
FIG. 93
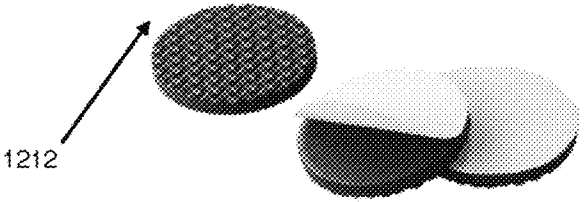
FIG. 94

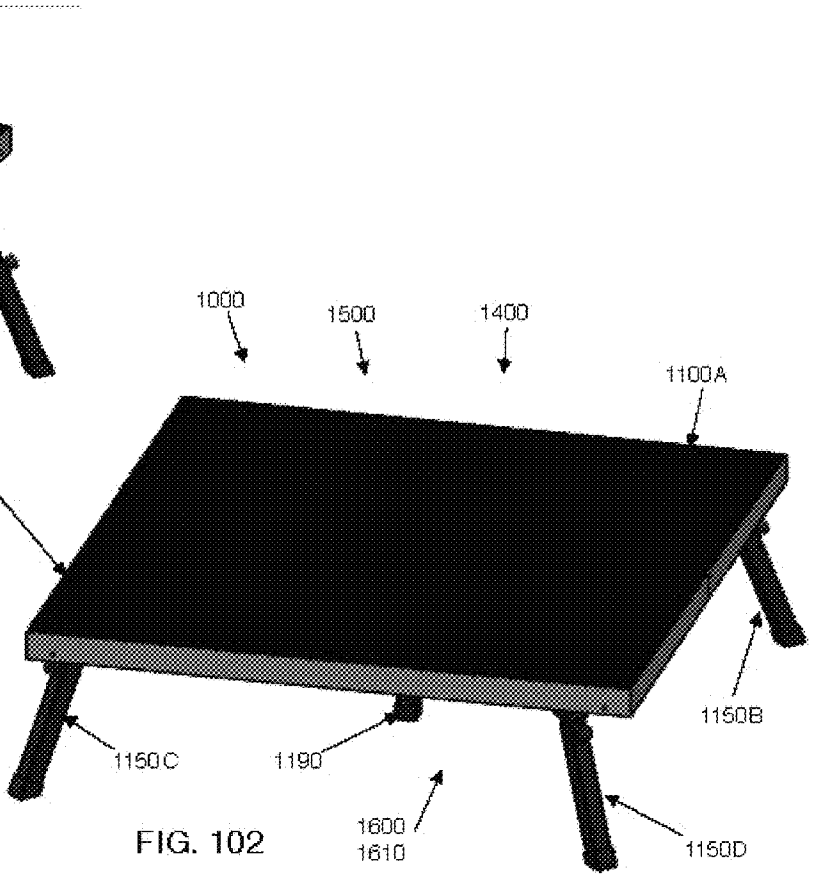
FIG. 101
FIG. 102
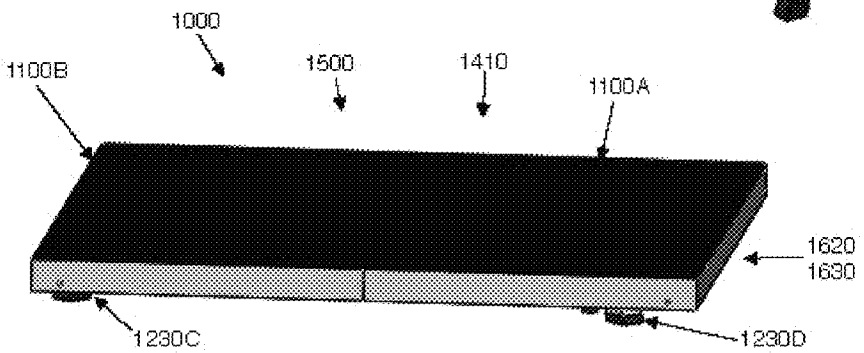
FIG. 103

MULTI-PURPOSE PORTABLE PLATFORM STAGE

CROSS REFERENCE TO RELATED APPLICATIONS

The present application claims priority from the following U.S. Provisional Applications, the entire disclosures of which, including but not limited to any and all cited references, are incorporated herein by reference: U.S. Provisional Application No. 62/738,186 (filed Sep. 28, 2018) and U.S. Provisional Application No. 62/859,364 (filed Jun. 10, 2019).

FIELD OF THE INVENTION

The invention relates generally to platform stages, and specifically to a multi-purpose portable platform stage.

BACKGROUND OF THE INVENTION

Currently there are a number of solutions for stages. At least one of these solutions attempts to build a stationary stage, but this solution fails to meet the needs of the market because the stage is not portable. At least one other solution attempts to provide a single height platform, but this solution is similarly unable to meet the needs of the market because, depending on the level of the ground surface, the platform may need to be raised to be visible to the audience. Still another solution seeks to provide a stage that requires assembly, but this solution also fails to meet market needs because the equipment to assemble the stage can be too heavy for one person to transport, and the time to assemble the stage can be undesirably excessive.

SUMMARY OF THE INVENTION

It would be advantageous to have a stage that is lightweight for portability, yet produced from sturdy material. Further, it would also be advantageous to have a stage that folds and locks for portability. Still further, it would be advantageous to have a stage that can be set up quickly and easily. Still further, it would be advantageous to have a stage that can adjust to different heights and different types of terrains (for example, even, uneven, solid, pliable, soft, shifting, etc.). Therefore, there currently exists a need in the market for an apparatus that is a multi-purpose portable platform stage.

The invention advantageously fills the aforementioned deficiencies by providing a multi-purpose portable platform stage, which provides an alternative to stationary stages.

In preferred embodiments, the stage is for elevating a platform of the stage over a surface on which the stage is placed.

Preferably, the stage is configurable into an operational configuration and a portable configuration.

Preferably, in the operational configuration, a platform of the stage can be occupied by one or more persons simultaneously, and one or more legs of the stage support the platform. For example, in the operational configuration, one or more persons can sit, stand, move and otherwise operate on the platform without the platform or other stage components collapsing or otherwise failing at their support functions, and one or more objects can be placed and used on the platform, by or without such persons, without the platform or other stage components collapsing or otherwise failing at their support functions. Preferably, the operational configuration provides a platform that is elevated off the surface on which the stage is placed. Preferably, the platform has a top surface, which is expected to be occupied by the one or more persons, that includes one or more comfort features (for example, the surface preferably is padded) and/or one or more safety features (for example, the surface preferably has non-slip features).

Preferably, in the portable configuration, the stage can be carried by a single person individually without assistance. As used herein, the concept of a person undertaking a task "individually without assistance" can mean to undertake the task without help from any other person and without any assisting devices. Accordingly, for example, in the portable configuration, a single person, such as, for example, one of the persons who had occupied or will occupy the platform, can carry the stage without help from another person and without any assisting devices.

Preferably, the stage includes at least one panel, and more preferably two panels, and at least one leg, and more preferably at least two legs, connected to the panel (or panels). Preferably, in the operational configuration, the panel is in a platform configuration (for example, an open configuration) in which the panel provides the platform, and the leg is in a support configuration in which the leg extends from the platform. Preferably, in the portable configuration, the panel is in a closed configuration in which the panel does not provide the platform, and the leg is in a stowed configuration in which the leg does not extend from the platform.

For example, in certain embodiments, the stage is comprised of two panels (each preferably having at least one dimension substantially similar to that of the other, and more preferably having substantially the same platform surface area, and length and wide dimensions, as that of the other) that can be folded toward one another (for example, preferably they can be folded toward one another until their bottom sides face one another) and releasably locked in such a folded configuration (for example, a closed configuration) (for example, for carrying by a single person individually without assistance), and unfolded away from one another (for example, preferably they can be unfolded away from one another until their top surfaces form a combined platform) and releasably locked in such an unfolded configuration (for example, an open configuration) (for example, for use to elevate persons and/or objects positioned on the platform, over a surface on which the stage is placed).

Further in this regard, for example, in certain embodiments of the stage with multiple panels, when the stage is in the portable configuration, preferably the panels are folded toward one another with their bottom sides substantially flush against one another in a closed configuration. For example, this aspect of the invention is made possible in certain embodiments preferably by one or more of the legs of the stage being fully stowable into (for example, folded against) the bottom side of one or more of the panels. Additionally or alternatively, for example, this aspect of the invention is made possible in certain embodiments preferably by one or more of the legs being positioned on the bottom sides of the panels so as to avoid one or more other legs when the legs are in a stowed configuration and the panels are in the closed configuration.

It should be understood that although the stage is illustrated and discussed herein in certain embodiments as having a square platform of certain length and width dimensions, the platform can have any desired shape, including shapes having no corners and shapes having one or more curved edges, and further, such shapes can be of any desired dimensions.

Preferably, the stage includes at least one leg, and preferably a plurality of legs, that extend downwardly from the platform when the stage is in an operational configuration, and preferably downwardly from a bottom side of the platform when the stage is in an operational configuration, so as to elevate the platform above a surface when the stage is placed on the surface.

Preferably, the legs are positioned to provide stability to the platform when the stage is in the operational configuration and one or more persons or objects are on the platform. Preferably, in embodiments in which the platform has a shape with at least one corner, at least one leg is positioned under the corner. Preferably, in embodiments in which the platform has a shape with a plurality of corners, at least one leg is positioned under each corner. Preferably, in embodiments in which the platform has a shape with four corners, the stage has at least four legs, and each one is positioned under a respective corner.

Preferably, the legs are directed to provide stability to the platform when the stage is in an operational configuration and one or more persons or objects are on the platform. Preferably in this regard, one or more of the legs are angled with respect to the platform, outwardly laterally away from the platform and outwardly laterally away from one another, so as to provide enhanced stability to the platform when the stage is in an operational configuration. For example, the angle of each leg is preferably between approximately 60 degrees and approximately 75 degrees from the bottom side of the panel to which it is attached, and more preferably approximately 68 degrees from the bottom side of the panel to which it is attached.

Preferably, the span of each panel of the platform is supported by the legs. Preferably in this regard, one or more legs are positioned under one or more panel spans. Preferably, in embodiments with two panels, at least one centrally located leg (for example, a middle leg) supports one or both panels at or near a rotational (for example, universal, folding, or hinged) connection between the panels, so as to provide structural support to the central area (for example, middle area) of the platform when the stage is in an operational configuration.

Preferably, the stage can be adjusted in elevation to a plurality of heights, and adjusted to accommodate even and uneven surfaces. Preferably in this regard, the stage can be adjusted in elevation to accommodate a plurality of different heights of an uneven surface on which it is placed. Preferably in this regard, one or more legs are independently and/or individually extendable and retractable in length within a desired length range, and can be locked at desired length increments, to accommodate different desired platform heights and the stable placement of the stage on uneven terrain (or other uneven surfaces, or spanning different types of surfaces). Preferably, a button (or other activation mechanism) on (or in association with) the leg, when pressed (or otherwise activated), unlocks the leg to enable length adjustment and when subsequently held in the pressed (or otherwise activated) position (or the position is otherwise maintained) enables the free movement of an extendable leg portion of the leg along its longitudinal axis to a desired length setting, and when subsequently released (or otherwise deactivated), locks the extendable leg portion of the leg at the desired length setting for the leg. Preferably, each outer leg (for example, corner leg) is adjustable in length by approximately 7 inches (180 mm), and each central leg (for example, middle leg) is adjustable in length by approximately 6.5 inches (166.5 mm).

Preferably, wobble and/or other instability aspects of the stage are limited, and preferably prevented, when the stage is locked in an operational configuration. Preferably in this regard, tolerances and/or clearances of moveable and/or adjustable components of the stage, including but not limited to the leg rotation lock, leg extension lock, and leg extension features, are minimized to limit, and preferably prevent, movement of such components relative to one another, to provide enhanced stability to the platform.

Preferably, each leg has a foot, and preferably the feet of the legs facilitate traction and/or stability on a variety of types of surfaces. Preferably, this facilitation is accomplished by the legs having removably attachable and/or interchangeable foot pads of various sizes, materials, and surface textures (for example, solid, pliable, soft, shifting, etc.). Preferably, the angle of the foot pad in relation to the longitudinal axis of the leg to which it is attached is flexible and/or otherwise can be adjusted, to enable the bottom of the foot pad to automatically align with (or otherwise align or be aligned with) the surface on which the foot pad is placed. Preferably in this regard, each foot pad is attached to the leg by a rotational connection (for example, a universal, flexible, or hinged connection) that enables the bottom of the foot pad to automatically align with (or otherwise align or be aligned with) a surface that is angled relative to the distal end of the leg. Preferably, the alignment of the foot pad in this regard can be locked (or is auto-locking), to provide enhanced stability. Preferably, one or more additional pads (for example, rigid or semi-rigid pads) of one or more of a variety of materials (for example, rubber, plastic, cloth, felt, etc.) can be added to and removed from the bottom of the foot pads to facilitate desired types of traction and/or surface engagement. Preferably, the legs of the stage can accommodate different types of surfaces at the same time (for example, one or more legs on one type of surface and one or more other legs on another type of surface).

Preferably, the stage can also be configured into a collapsed operational configuration. Preferably, in the collapsed operational configuration, the panel (or panels) is in the platform configuration (for example, the open configuration) and the leg (or legs) is in the stowed configuration. Preferably, the collapsed operational configuration provides a platform that is low to the surface on which the stage is placed. For example, in certain embodiments, in the collapsed operational configuration the panels of the stage are in the unfolded configuration (for example, the open configuration) but the legs are in the stowed configuration. Preferably, the stage includes one or more supports that facilitate the use of the stage in the collapsed operational configuration, as a low set platform. More particularly, the supports preferably extend downwardly from the bottom side of the platform past the bottom edge of the platform, so as to support the platform, when the panels are in the open configuration but the legs are in the stowed configuration, by providing clearance between the platform and the surface on which the stage is placed. Preferably, the dimensions of each support are such that the supports do not prevent the bottom sides of the panels that form the platform from folding flush against one another when the panels are folded into the closed configuration, and staying flush against one another when the panels are in the closed configuration. Preferably, the supports are located adjacent or near the bases of the legs of the stage.

Preferably, the stage is convertible from the operational configuration to the collapsed operational configuration to the portable configuration by a single person individually without assistance, and from the portable configuration to the collapsed operational configuration to the operational configuration by a single person individually without assistance. Further preferably, the stage is convertible to and from either and/or both of the operational configuration and the portable configuration by a single person individually without assistance. For example, a single person, such as, for example, one of the persons who had occupied or will occupy the platform, can convert the stage without help from another person and without any assisting devices.

Preferably, the stage can be locked in each of the configurations for use and unlocked from each of the configurations to facilitate conversion from one configuration to another. Preferably, processes of converting the stage between the operational configuration, the collapsed operational configuration, and the portable configuration, and therebetween and thereamong, have minimal steps, each of which preferably can be accomplished by a single person individually without assistance. Preferably, the ease of conversion is enabled by, for example, lightweight, quick-release, and/or one-handed operation locking, unlocking, and/or adjustment mechanisms or the like.

Preferably, these features of the invention, individually and/or collectively in various permutations, are made possible due to preferred physical characteristics of the stage and preferred design characteristics of the stage.

As to the ability of the stage to be carried by a single person individually without assistance and to support a plurality of persons occupying the platform simultaneously, the stage has preferred physical characteristics, such as, for example, preferred weight characteristics and preferred size characteristics. Preferably, the weight and size of each component of the stage are minimized to the extent possible while retaining sufficient functionality for the stage's intended uses. It should be understood that while the present disclosure primarily discusses a multi-purpose stage, other embodiments, such as stages that are designed for specific purposes, are contemplated by the invention, and in such embodiments, the stage need accommodate and support only the size and weight requirements needed for its specific purpose, and therefore the sizes and weights of the stage components can be set at the lowest possible specifications that still facilitate the use of the stage for such specific purpose.

As to preferred weight characteristics, preferably, the stage weighs no more than a weight that can be lifted with one arm by a person of average strength. More preferably, the stage weighs no more than a weight that can be lifted with one arm by a person of below average strength. Preferably, the stage weighs no more than a weight that can be supported by hanging from one shoulder by a person of average strength. More preferably, the stage weighs no more than a weight that can be supported by hanging from one shoulder by a person of below average strength. Preferably, the stage weighs no more than 40 pounds. More preferably, the stage weighs no more than 20 pounds.

Preferably, the preferred weights of the stage are made possible due to the use and configuration of preferred materials. Such materials can include, but are not limited to, lightweight metal, lightweight plastic, carbon fiber and composite materials. For example, the stage can be comprised of lightweight materials for each component. In this regard, in certain embodiments, the panels are preferably formed from aluminum, the legs are preferably formed from steel and/or plastic, and the top surface of the panels is preferably formed from rubber.

Further preferably, the size of each component and/or the amount of material used in each component is minimized to the extent possible to retain sufficient functionality while minimizing weight. For example, the panels can in some embodiments have a rib structure, lattice structure, or other structure that provides sufficient support while minimizing material. Further, for example, the panels of the stage can be structurally reinforced for stability by corner braces (and/or corner panels) utilizing minimal material, and one or more outer legs can be attached to the underside of the panels by attachment to the corner braces and/or corner panels to minimize the number of components of the stage and leverage the stability of the corner braces and/or corner panels.

As to additional preferred size characteristics, preferably, in the portable configuration, the stage can be comfortably carried at the side of a person of average height under the person's arm. For example, in the portable configuration, preferably the stage can be comfortably carried in the common manner of a shoulder bag. Preferably, the vertical dimension of the stage in such an orientation and placement is no greater than 3 feet. More preferably, the vertical dimension of the stage in such an orientation and placement is no greater than 2 feet.

Further as to the ability of the stage to be carried by a single person individually without assistance and also support a plurality of persons occupying the platform simultaneously, the stage has preferred design characteristics. Preferably in this regard, when the stage is in the operational configurations, the platform is of suitable surface area, and the supporting components are strong enough, to permit desired activities by one or more persons, with and without objects that may normally accompany or be used in such activities. Such activities can be, for example, practicing yoga, exercising, public speaking, magical or theatrical performances, and musical performances. For example, in order to sufficiently support a plurality of persons occupying the platform simultaneously, the platform has a surface area of at least 16 square feet. Further preferably, in the operational configuration, the stage supports a weight load on the platform of at least 500 pounds (and preferably more) and/or at least 31.25 pounds per square foot (and preferably more).

Preferably, in order to facilitate the ability of the stage to be carried as described herein, the platform can be folded or otherwise made compact. For example, in certain embodiments, the stage is comprised of one or more panels that form the platform, and preferably two panels that when fully opened (for example, placed in the open configuration) form the platform, and when fully closed against one another (for example, in the closed configuration) have a combined form that permits comfortable carrying by a single person. For example, when the stage is in the portable configuration, the stage preferably is approximately 2 feet (0.6 meters) wide, approximately 4 feet (1.2 meters) long, and approximately 4.72 inches (0.12 meters) deep (or thick).

Preferably in this regard, the panel (or panels) that provides the platform includes first and second sections (preferably, two halves, or, first and second panels) that are foldably connected (for example, by one or more rotational connections or hinges) to one another at a central area (preferably a midline) of the sections such that they are foldable toward one another and unfoldable away from one another. Preferably, in the platform configuration (for example, the open configuration), the sections are fully unfolded, and in the closed configuration the sections are fully folded. Preferably, when the stage is in the operational configuration, the leg (or legs) supports the platform. Preferably, the stage includes includes five legs, and when the stage is in the operational configuration, one of the legs (for example, a central leg or middle leg) supports a central area (for example, a middle area) of the platform and each of the remaining legs supports a respective corner area (for example, an edge area) of the platform.

Preferably, in order to further facilitate the ability of the stage to be carried as described herein, the leg (or legs) can be stowed (or otherwise stored against or with other components of the stage). More particularly, when the stage is in the portable configuration, the leg (or legs) preferably are fully enclosed by the sections (for example, the panels).

Further preferably, in order to facilitate the platform dimensions and portable configuration dimensions described herein, the platform is rectangular. More preferably in this regard, the platform is square.

For example, the platform preferably is comprised of two sections that each provide half of the platform. Each section is preferably a panel that is approximately 2 feet (0.6 meters) wide and approximately 4 feet (1.2 meters) long, such that when the panels are in an unfolded or open configuration, they form a platform that is approximately 4 feet (1.2 meters) wide and approximately 4 feet (1.2 meters) long, and such that when they are in a folded or closed configuration, they form a box that has a vertical dimension of approximately 2 feet (0.6 meters), a horizontal dimension of approximately 4 feet (1.2 meters), and a width that is double the thickness of each section.

Preferably, in order to further facilitate the ability of the stage to be carried as described herein, the stage preferably includes a carrying feature such as, for example, a handle or strap, and when the stage is in the portable configuration, the stage can be carried by a single person individually without assistance by use of the carrying feature.

For example, in certain embodiments, the stage, in its portable configuration, is preferably dimensioned and featured (for example, with a handle or graspable area or feature) so that it can be carried by a person holding a top part (preferably, a top edge) of the folded (or compacted) stage using the person's hand (preferably, the stage is configured with a handle or other graspable area or feature to facilitate holding), with the person's arm extended down by the person's side and the stage hanging from the person's hand and substantially parallel to the person's side. This is preferably accomplished by the panels of the stage being approximately 2 feet (0.6 meters) (preferably 3 feet (0.91 meters) or less) in the dimension extending down by the person's side when held in such a position. Such preferred dimension results, for embodiments having a square platform, in a platform of approximately 4 feet (1.2 meters) wide and approximately 4 feet (1.2 meters) long when the stage is in its unfolded configuration (for example, its operational configuration).

Additionally or alternatively, for example, in certain embodiments, the stage, in its portable configuration, is dimensioned and/or outfitted so that it can be carried by a person using the person's shoulder as the primary point of support. For example, this can be achieved by the stage having a carrying strap (or other flexible or semi-flexible feature) and by a person having the carrying strap across the person's shoulder and allowing the stage to hang substantially parallel to the person's side. More preferably in this regard, the panel (or panels) that provides the platform has first and second sides, and the carrying strap is a shoulder strap that extends from the first side to the second side, such that a single person can carry the stage with the shoulder strap over the person's shoulder and the stage hanging from the strap by the person's side under the person's arm. This is preferably accomplished by the panels of the stage being approximately 2 feet (0.6 meters) (preferably 3 feet (0.91 meters) or less) in the dimension extending down by the person's side when held in such a carried position. Such preferred dimensions result, for a stage having a square platform, in a platform approximately 4 feet (1.2 meters) wide and approximately 4 feet (1.2 meters) long when the stage is in the operational configuration.

With regard to the configurations of the stage, certain embodiments of the stage preferably include first and second panels that are movable relative to one another into an open configuration and a closed configuration. For example, the panels are preferably unfoldable away from one another into the open configuration and foldable toward one another into the closed configuration.

Preferably, one or more unfolding locks are operable to lock the panels to one another in the open configuration. Examples of suitable unfolding locks include but are not limited to locks with a component on the bottom side of one panel and a component on the bottom side of the other panel, that cooperate or otherwise engage one another to lock the panels to one another in the open configuration. In some embodiments, the unfolding lock is a sliding lock bar that slides from the bottom side of one panel to straddle the midline between the panels to block the panels from closing toward one another. In other embodiments, the unfolding lock is a slider lock at or near the rotational connection (for example, hinge) between the panels that uses a bar to span the midline between the panels to block the panels from closing toward one another. Other examples of suitable unfolding locks include but are not limited to locks with a component that moves within the frames of the panels. In some embodiments, the unfolding lock is a locking slide beam that moves, within the frames of the panels at the sides of the panels, from being fully within one frame (for example, in the unlocked position) to being partially within one frame and partially within the other frame and straddling the midline between the sides of the panels (for example, in the locked position), to block the panels from closing toward one another.

Preferably, one or more folding locks are operable to lock the panels to one another in the closed configuration. Examples of suitable folding locks include but are not limited to locks with a component on the bottom side of one panel and a component on the bottom side of the other panel, that cooperate or otherwise engage one another to lock the panels to one another in the closed configuration. Preferably, the folding lock uses a magnetic force for such cooperation or engagement.

Further, the stage preferably includes first and second legs that are movable relative to the panels into a support configuration and a stowed configuration. Further preferably, each of the panels has a recess. Further preferably, each of the panels has a stowing location for the leg or legs. More preferably, each recess is such a stowing location.

Further preferably, in the open configuration, the panels define the platform and in the closed configuration the recesses define an enclosure. Further preferably, in the support configuration, when the stage is on a surface, the legs extend from the recesses to the surface.

For example, one or more legs can be folded (or otherwise positioned) substantially against the bottom side of the panels, and locked in such a stowed configuration. Preferably, when the panels are in the closed configuration, the legs stowed against one panel do not interfere with the legs stowed against the other panel, so that when the panels are in the closed configuration, the stowed legs do not prevent the panels from being folded flush against one another. Such non-interference can be effected, for example, by each leg size (for example, thickness) being thinner than the depth of the panel against which it is folded, by the legs being positioned on the panels to avoid one another when the legs are in the stowed configuration and the panels are in the closed configuration, and/or by some other sizing, positioning, or physical avoidance solution.

In this regard, in certain preferred embodiments, in the stowed configuration, the legs fit fully within the recesses on the bottom sides of the panels. This, for example, enables non-interference of the stowed legs with one another when the panels are in the closed configuration. In other preferred embodiments, in the stowed configuration, the legs fit within the recesses on the bottom sides of the panels except for minority portions of each leg that remain outside the recesses. Preferably, in such embodiments, when the panels are in the closed configuration and the legs are in the stowed configuration, the legs fit fully within the enclosure but neither leg fits fully within either recess. This, for example, in combination with an asymmetrical positioning of the legs as described herein, enables the use of larger (for example, thicker) legs without interference of the legs with one another when the panels are in the closed configuration.

Accordingly, preferably, the operational configuration of the stage discussed herein is established in these and other embodiments by the placement of the panels in the open configuration and the legs in the support configuration, and the portable configuration of the stage discussed herein is established in these and other embodiments by the placement of the panels in the closed configuration and the legs in the stowed configuration.

As to the collapsed operational configuration of the stage discussed herein, preferably, the collapsed operational configuration is established in these and other embodiments by the placement of the panels in the open configuration and the legs in the stowed configuration.

More particularly, preferably, each leg minority portion (for example, that remains outside the recesses when the legs are in the stowed configuration) includes at least a portion of a support, and accordingly, when the panels are in the open configuration and the legs are in the stowed configuration, the supports elevate the platform over the surface when the stage is on the surface.

Further preferably in this regard, each leg includes a proximal end and a base thereat having a point of rotation of the leg, the first leg support is attached to the first leg base, and the second leg support is attached to the second leg base. This, for example, enables the platform to be supported (and elevated) by the supports at the leg bases when the panels are in the open configuration and the legs are in the stowed configuration.

Further preferably in this regard, each leg includes a distal end and a foot thereat, the first leg support is spaced from the first leg foot, the second leg support is spaced from the second leg foot, and when the legs are in the stowed configuration, the first leg foot fits fully within the first panel recess and the second leg foot fits fully within the second panel recess. In such embodiments, for example, the platform can be supported (and elevated) by the supports, which may be at locations on the legs other than at the leg bases, when the panels are in the open configuration and the legs are in the stowed configuration.

Further in this regard, for example, it should be understood that in embodiments in which the supports do not fit fully within the recesses when the legs are in the stowed configuration, the supports are preferably the minority portions of the legs that remain outside the recesses but still fit within the enclosure formed when the panels are in the closed configuration. Accordingly, this, for example, in combination with an asymmetrical positioning of the legs as described herein, enables the inclusion of the supports without interference of the legs with one another when the panels are in the closed configuration.

With regard to the asymmetrical positioning discussed herein, in preferred embodiments, each panel defines a respective half of the platform when the panels are in the open configuration, and each recess defines a respective half of the enclosure when the panels are in the closed configuration.

Further preferably in this regard, the first leg supports an area of the first panel platform half, the second leg supports an area of the second panel platform half, and the areas are substantially similar in size. Further preferably, when the panels are in the open configuration, with respect to a middle of the platform, the areas are symmetrically (for example, not offset with respect to one another) opposite one another on the panels but the legs are positioned asymmetrically (for example, offset with respect to one another) opposite one another in the recesses, and when the panels are in the closed configuration, with respect to a middle of the enclosure, the areas are symmetrically (for example, not offset with respect to one another) opposite one another on the panels but the legs are positioned asymmetrically (for example, offset with respect to one another) opposite one another in the recesses. In such embodiments, for example, there is non-interference of the legs with one another when the legs are in the stowed configuration and the panels are in the closed configuration, even through the legs exceed the size of the recesses, such as, for example, when the legs include the supports.

Preferably, at least one central leg (for example, middle leg) supports one or both panels on or near the rotatable connection between the panels, so as to provide structural support to the platform when the stage is in the operational configuration. Preferably, the central leg in its unfolded configuration (for example, support configuration) spans the seam (for example, midline) between the panels to support a force against the top surface of the panels (for example, caused by gravity when a person or object is on the platform) bearing down at the seam (for example, midline) between the adjacent panels. Preferably, the central leg can be secured in its unfolded configuration (for example, support configuration). More preferably, a quick release clamp releasably secures the central leg in its unfolded configuration (for example, support configuration).

In this regard, in preferred embodiments, the stage includes a third leg (for example, central or middle leg) that is movable relative to the panels into a third leg (for example, central or middle leg) support configuration and a third leg (for example, central or middle leg) stowed configuration. Further preferably, when the panels are in the open configuration and the third leg (for example, central or middle leg) is in the third leg (for example, central or middle leg) support configuration, the third leg (for example, central or middle leg) supports both panels, and in the third leg (for example, central or middle leg) stowed configuration, the third leg (for example, central or middle leg) fits fully within one of the recesses. In certain embodiments, in the third leg (for example, central or middle leg) stowed configuration, the third leg (for example, central or middle leg) exceeds the size of the recess but fits within the enclosure formed when the panels are in the closed configuration. The third leg (for example, central or middle leg) enables additional central support (e.g., middle support) of the platform in embodiments where such support is desired.

Preferably, each panel includes an edge, and the panels are rotationally connected to one another at the edges such that the panels can be unfolded away from one another into the open configuration and folded toward one another into the closed configuration. Rotational connections contemplated can be or include, but are not limited to, folding, hinged, bendable, flexible, angled and/or universal joint connections.

Further preferably, each panel includes a top surface and a bottom side, each top surface provides a respective portion of the platform when the panels are in the open configuration, and each bottom side has a respective one of the edges, at which the panels are connected to one another, and a respective one of the recesses. The location of the rotational connection being at the edges of the bottom sides of the panels, for example, provides support for the platform at the midline (of the platform) defined by the adjacent edges of the panels, because as weight presses down at the midline, the rotational connection, due to its location at the adjacent bottom edges of the panels, is urged to unfold the panels, and this urging causes the panels to press against one another at their adjacent top edges. Given the strength of the opposing forces at the top edges and the strength of the rotational connection, the integrity of the platform at the midline is enhanced.

In this regard, in preferred embodiments, one or more hinges (or other similarly functional connections) connect the two panels that form the platform, to facilitate the folding and unfolding, and preferably are positioned to have a center of rotation at or adjacent the bottom sides of the panels at their point of mutual engagement in the unfolded configuration (for example, the open configuration), such that when the panels are unfolded and a force against the top surface of the panels (for example, caused by gravity when a person or object is on the platform) bears down at the seam (for example, midline) between the adjacent panels, the adjacent sides of the panels press against one another at the top edges of the seam (for example, midline) and the hinges at the bottom edges of the seam (for example, midline) bear the corresponding separating force created thereby at the bottom edges of the panels at their meeting point.

Further with regard to the integrity of the connection between the panels, preferably, the seam (for example, midline) at which the panels of the stage meet when in the unfolded configuration (for example, the open configuration) is reinforced against downward forces, such that vertical translation of the opposing sides of the panels at the seam (for example, midline), relative to one another, is prevented. Preferably, this is enabled by at least one channel formed on one of the sides and at least one protrusion formed on the other side, that fits into at least one of the channels, such that the protrusion crosses over the seam (for example, midline) at which the panels of the stage meet when in the unfolded configuration (for example, the open configuration).

In this regard, in preferred embodiments, the seam (for example, midline) at which the panels of the stage meet when in the unfolded configuration (for example, the open configuration) is reinforced by, as to the sides of the panels that meet one another at the seam (for example, midline), one side having a horizontal channel and the opposing side having a horizontal protrusion that fits into the channel when the sides meet and thereby crosses over the seam (for example, midline), such that a vertical translation of one side in relation to the other is prevented.

Preferably, the stage has a modular design, such that a plurality of the stages can be positioned adjacent one another and preferably locked to one another (for example, by removably attachable clamps, or clamp and pin features, slot and tab features, and/or other corresponding connection features at the meeting sides of the platforms) to form a platform larger than the platform provided by only one of the stages. Preferably, stages of different platform dimensions can be positioned adjacent one another. Preferably, when multiple stages are positioned adjacent one another, any angled legs of any of the plurality of stages do not interfere with any angled legs of any other of the plurality of stages. Preferably, in this regard, the angles of angled legs of the stages, and the positioning of the bases of the legs on the bottom side of the panels of the stages, are configured to effect such non-interference.

In this regard, in preferred embodiments, to provide for larger platform sizes, multiple stages of the invention can be grouped together to form a combined larger platform.

Preferably, to form a combined platform larger than a single stage's platform, multiple stages can be positioned adjacent one another, in operational configurations (or collapsed operational configurations), substantially side to side. In preferred embodiments, in the operational configuration, the legs avoid interference with nearby legs from other stages. This is preferably accomplished by one or more legs being positioned, at their points of connection to the bottom side of the panels (for example, at their bases), in an asymmetrical (for example, staggered or offset) configuration relative to one another, such that when the stage is in an operational configuration, and multiple stages are positioned adjacent one another substantially side to side, legs from one stage do not interfere with nearby legs from another stage, regardless of the length to which the legs are extended beyond the platform side boundaries of the one stage and underneath the platform of the adjacent other stage. This is further preferably accomplished by one or more legs being angled such that when the stage is in an operational configuration, and multiple stages are positioned adjacent one another substantially side to side, legs from one stage do not interfere with adjacent legs from another stage, regardless of the length to which the legs are extended beyond the platform side boundaries of the one stage and underneath the platform of the adjacent other stage. Further preferably, when multiple stages are positioned adjacent to one another to form a combined platform larger than a single stage's platform, connection features on one side corresponding to connection features on an adjacent side can be secured to one another to cause the sides to remain flush against one another during use of the stages. Additionally or alternatively, one or more removably attachable clamps can be used to hold the edges against one another during use of the stages.

While any combination of any number of stages is contemplated by the invention, an example of a group of two stages will be described below and an example of a group of four stages will be described below.

Further with regard to a group of at least two stages, a preferred embodiment includes a first stage having a platform defining a plane, the first stage platform having an edge defining an intersection of the first stage plane and a boundary perpendicular to the first stage plane, the first stage having a leg extending from the first stage platform such that a distal portion of the first stage leg crosses the first stage boundary. For example, the boundary being described is the planar area perpendicular to the plane of the platform and to the edge of the platform. Stated alternatively, the boundary being described is an imaginary vertical plane at the edge of the first stage platform, that extends above and below the first stage plane.

This example preferred embodiment further includes a second stage having a platform defining a plane, the second stage platform having an edge defining an intersection of the second stage plane and a boundary perpendicular to the second stage plane, the second stage having a leg extending from the second stage platform such that a distal portion of the second stage leg crosses the second stage boundary. For example, the boundary being described is the planar area perpendicular to the plane of the platform and to the edge of the platform. Stated alternatively, the second stage boundary being described is an imaginary vertical plane at the edge of the second stage platform, that extends both above and below the second stage plane.

In this example preferred embodiment, when the edges are aligned, the first stage leg crosses the second stage boundary without interfering with the second stage leg, the second stage leg crosses the first stage boundary without interfering with the first stage leg, and the two platforms define the combined platform, or performance area. Stated alternatively, for example, when the edges of the stages are adjacent one another and the legs of the stages are extended, the first stage legs extend from the bottom sides of the first stage platform past the first stage boundary and cross over the second stage boundary and underneath the second stage platform, and the second stage legs extend from the bottom sides of the second stage platform past the second stage boundary and cross over the first stage boundary and underneath the first stage platform, but the first stage legs do not interfere with the second stage legs, and the second stage legs do not interfere with the first stage legs.

Preferably, this is enabled by an asymmetrical positioning of the legs relative to one another with reference to the platform areas they support. Preferably in this regard, the first stage leg supports an area of the first stage platform, the second stage leg supports an area of the second stage platform, and the areas are substantially similar in size. Further preferably, the alignment of the edges defines a line between the platforms, and with respect to the line, the areas are symmetrically opposite one another on the platforms and the legs are positioned asymmetrically opposite one another under the platforms, and the asymmetrical positioning of the legs causes the non-interference of the legs.

Stated alternatively, although each leg of the first stage on one side of the line between the platforms supports a certain area of the first stage platform, and each leg of the second stage on the other side of the line between the platforms supports a certain similarly sized area on the second stage platform that is symmetrically opposite the first stage platform area, the first stage leg location under the first stage platform is asymmetrical with respect to the second stage leg location under the second stage platform. This, for example, enables the non-interference of the legs when the stages are in their operational configurations and adjacent one another.

Further with regard to a group of at least four stages, a preferred embodiment includes the stages of the two stage group, but also includes a third stage having a platform defining a plane, the third stage platform having a first edge defining an intersection of the third stage plane and a first boundary perpendicular to the third stage plane, the third stage platform having a second edge defining an intersection of the third stage plane and a second boundary perpendicular to the third stage plane and to the first third stage boundary, the third stage having a leg extending from the third stage platform such that a distal portion of the third stage leg crosses the first third stage boundary. For example, the boundaries being described are the planar areas perpendicular to the plane of the platform and to the edges of the platform. Stated alternatively, the boundaries being described are imaginary vertical planes at adjacent edges of the third stage platform, that extend above and below the third stage plane.

This example preferred embodiment further includes a fourth stage having a platform defining a plane, the fourth stage platform having a first edge defining an intersection of the fourth stage plane and a first boundary perpendicular to the fourth stage plane, the fourth stage platform having a second edge defining an intersection of the fourth of the fourth stage plane and a second boundary perpendicular to the fourth stage plane and to the first fourth stage boundary, the fourth stage having a leg extending from the fourth stage platform such that a distal portion of the fourth stage leg crosses the first fourth stage boundary. For example, the boundaries being described are the planar areas perpendicular to the plane of the platform and to the edges of the platform. Stated alternatively, the boundaries being described are imaginary vertical planes at adjacent edges of the fourth stage platform, that extend above and below the fourth stage plane.

Further in this example preferred embodiment, the first stage platform edge is a first edge of the first stage platform, and the first stage boundary is a first boundary perpendicular to the first stage plane, and the first stage platform further has a second edge defining an intersection of the first stage plane and a second boundary perpendicular to the first stage plane and to the first first stage boundary. For example, the boundaries being described are the planar areas perpendicular to the plane of the platform and to the edges of the platform. Stated alternatively, the boundaries being described are imaginary vertical planes at adjacent edges of the first stage platform, that extend above and below the first stage plane.

Further in this example preferred embodiment, the second stage platform edge is a first edge of the second stage platform, and the second stage boundary is a first boundary perpendicular to the second stage plane, and the second stage platform further has a second edge defining an intersection of the second stage plane and a second boundary perpendicular to the second stage plane and to the first second stage boundary. For example, the boundaries being described are the planar areas perpendicular to the plane of the platform and to the edges of the platform. Stated alternatively, the boundaries being described are imaginary vertical planes at adjacent edges of the second stage platform, that extend above and below the second stage plane.

In this example preferred embodiment, when the first stage platform first edge is aligned with the second stage platform first edge, and the second stage platform second edge is aligned with the third stage platform second edge, and the third stage platform first edge is aligned with the fourth stage platform first edge, and the fourth stage platform second edge is aligned with the first stage platform second edge, none of the legs interfere with any of the other legs.

Stated alternatively, for example, when the edges of the stages are adjacent one another and the legs of the stages are extended, the legs extending from the bottom side of a platform of a stage extend past that stage's platform side boundary and cross over an adjacent stage's platform side boundary and underneath that adjacent stage's platform, but do not interfere with the legs of the adjacent stage.

Preferably, this is enabled by an asymmetrical positioning of the legs relative to one another with reference to the platform areas they support. Preferably in this regard, the first stage leg supports an area of the first stage platform, the second stage leg supports an area of the second stage platform, the third stage leg supports an area of the third stage platform, the fourth stage leg supports an area of the fourth stage platform, and the areas are substantially similar in size. Further preferably, the alignment of the edges defines a line between the first and second platforms, a line between the second and third platforms, a line between the third and fourth platforms, and a line between the fourth and first platforms. Further preferably, with respect to each line, the areas of the platforms on either side of the respective line are symmetrically opposite one another on the platforms on either side of the respective line and the legs of the stages on either side of the respective line are positioned asymmetrically opposite one another under the platforms on either side of the respective line, and the asymmetrical positioning of the legs causes the non-interference of the legs.

Stated alternatively, although each leg of a stage on one side of a line between adjacent platforms supports a certain area of the stage's platform, and each leg of the opposite stage (on the other side of the line) supports a certain similarly sized area on that opposite stage's platform that is symmetrically opposite the original stage's platform area, the original stage's leg location under the original stage's platform is asymmetrical with respect to the opposing stage's leg location under the opposing stage's platform. This, for example, enables the non-interference of the legs when the four stages are in their operational configurations and adjacent one another.

The invention includes, in addition to the apparatuses described and illustrated herein, the processes of converting a stage of the invention from an operational configuration to a portable configuration, and vice versa, and any and all subprocesses undertaken in such processes.

For example, a preferred process of converting the stage from an operational configuration to a portable configuration, in at least one embodiment, includes one or more of the following: (1) unlocking extended legs for retraction, (2) fully retracting extended legs, (3) unlocking legs for folding, (4) folding legs against the panels, (5) locking legs in folded positions, (6) unlocking panels for folding, (7) folding panels against one another, and (8) locking panels in a folded position.

For example, a preferred process of converting the stage from a portable configuration to an operational configuration, in at least one embodiment, includes one or more of the following: (1) unlocking panels for unfolding, (2) folding panels away from one another until the platform surface is formed, (3) locking panels in an unfolded position, (4) unlocking legs for unfolding, (5) unfolding legs away from the panels, (6) locking legs in unfolded positions, (7) unlocking legs for extension (if desired), (8) extending legs to desired lengths, and (9) locking legs at desired lengths.

The invention further includes, in addition to the apparatuses described and illustrated herein, the processes of converting a stage between and among an operational configuration, a collapsed operational configuration, and a portable configuration, and vice versa, and any and all subprocesses undertaken in such processes.

For example, a preferred process of converting the stage from an operational configuration to a collapsed operational configuration, in at least one embodiment, includes one or more of the following: (1) unlocking extended legs for retraction, (2) fully retracting extended legs, (3) unlocking legs for folding, (4) folding legs against the panels, and (5) locking legs in folded positions.

For example, a preferred process of converting the stage from a collapsed operational configuration to a portable configuration, in at least one embodiment, includes one or more of the following: (1) unlocking panels for folding, (2) folding panels against one another, and (3) locking panels in a folded position.

For example, a preferred process of converting the stage from a portable configuration to a collapsed operational configuration, in at least one embodiment, includes one or more of the following: (1) unlocking panels for unfolding, (2) folding panels away from one another until the platform surface is formed, and (3) locking panels in an unfolded position.

For example, a preferred process of converting the stage from a collapsed operational configuration to an operational configuration, in at least one embodiment, includes one or more of the following: (1) unlocking legs for unfolding, (2) unfolding legs away from the panels, (3) locking legs in unfolded positions, (4) unlocking legs for extension (if desired), (5) extending legs to desired lengths, and (6) locking legs at desired lengths.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

FIGS. 1-25 illustrate preferred features of a first preferred embodiment of a portable stage of the present invention.

FIGS. 74-97 illustrate preferred features of a third preferred embodiment of a portable stage of the present invention.

FIGS. 98-122 illustrate preferred features of a fourth preferred embodiment of a portable stage of the present invention.

FIG. 1 shows the first preferred embodiment, in a back view, in a portable configuration.

FIG. 2 shows the first preferred embodiment, in a front view, in a portable configuration.

FIG. 3 shows the first preferred embodiment, in a side view, in a portable configuration.

FIG. 4 shows the first preferred embodiment, in a top view, in a portable configuration.

FIG. 5 shows the first preferred embodiment, in a bottom view, in a configuration in which the panels of the platform are in an open configuration and the legs are in a stowed configuration.

FIG. 6 shows the first preferred embodiment, in a side view, in a configuration in which the panels of the platform are in an open configuration and the legs are in a stowed configuration.

FIG. 7 shows the first preferred embodiment, in a bottom view, in a configuration in which the panels of the platform are in an open configuration and the legs are in a support configuration and extended.

FIG. 8 shows the first preferred embodiment, in a side view perpendicular to the midline of the panels of the platform, in a configuration in which the panels of the platform are in an open configuration and the legs are in a support configuration and extended.

FIG. 9 shows the first preferred embodiment, in a top perspective view, in a configuration in which the panels of the platform are in an open configuration and the legs are in a support configuration and extended.

FIG. 10 shows the first preferred embodiment, in a side view along the midline of the panels of the platform, in a configuration in which the panels of the platform are in an open configuration and the legs are in a support configuration and extended.

FIG. 11 shows the first preferred embodiment, in a top view, in a configuration in which the panels of the platform are in an open configuration and the legs are in a support configuration and extended.

FIG. 12 shows the first preferred embodiment, in a top perspective view, in a configuration in which the panels of the platform are in an open configuration and the legs are in a support configuration and extended.

FIGS. 13-16 show first preferred embodiment, in a side view illustrating a foldable and extendable leg design (FIG. 13), an inset view illustrating a folded leg (FIG. 14), a large foot pad detail perspective view illustrating a large foot pad option (FIG. 15), and a small foot pad detail perspective view illustrating a small foot pad option (FIG. 16).

FIG. 17 shows the first preferred embodiment, in a side view illustrating angled legs that are individually adjustable in length.

FIGS. 18-20 show the first preferred embodiment, in a bottom perspective view illustrating a sliding lock bar design (FIG. 18), a side view, in a portable configuration, illustrating a carrying strap and handle (FIG. 19), and an inset detail view illustrating a folding lock design (FIG. 20).

FIGS. 21-23 show the first preferred embodiment, in a top perspective view illustrating multiple stages of the present invention, each in an operational configuration, adjacent one another to form a larger stage (FIG. 21), an inset view illustrating slots of a slot and tab connection design (FIG. 22), and a bottom view illustrating an asymmetrical positioning of the legs (FIG. 23).

FIG. 24 shows the first preferred embodiment, in a side perspective view illustrating padded top surfaces of the platforms.

FIG. 25 shows the first preferred embodiment in a portable configuration and being carried.

FIGS. 26-28 show the second preferred embodiment, in a top perspective view in an operational configuration (FIG. 26), in a top perspective view in a portable configuration (FIG. 27), and a top perspective view in a configuration in which multiple stages of the present invention are connected to one another to form a larger stage (FIG. 28).

FIG. 29 shows the second preferred embodiment, in a top perspective view in an operational configuration in which the panels of the platform are in an open configuration and the legs are in a support configuration and extended, including a central leg.

FIG. 30 shows the second preferred embodiment, in a top perspective view in partial cutaway, in a configuration in which the panels of the platform are in an open configuration and the legs are in a support configuration, illustrating certain internal and external features of the platform.

FIGS. 31-36 show the second preferred embodiment, in a bottom perspective view, in an operational configuration (FIG. 31), illustrating a central leg hinge (FIG. 32), a slider lock (FIG. 33), a folding lock (FIG. 34), a central leg lock (FIG. 35) and a folding hinge (FIG. 36).

FIGS. 37-43 show the second preferred embodiment, in deconstructed views illustrating a frame design (FIGS. 37-40), a frame and hinge design (FIG. 41), a base of a leg attached to a corner brace (FIG. 42), and a frame extrusion cross-section (FIG. 43).

FIGS. 44-48 show the second preferred embodiment, in component views illustrating a leg rotary lock design (FIG. 44), a two pin lock design (FIG. 45), a spring design (FIG. 46), and a leg in a folded configuration (for example, a stowed configuration) at its base (FIG. 47) and an unfolded configuration (for example, a support configuration) at its base (FIG. 48).

FIGS. 49-50 show the second preferred embodiment, in component views illustrating a central leg support design (FIG. 49) and a central leg rotary lock design (FIG. 50).

FIGS. 51-53 show the second preferred embodiment, in a side view illustrating an extended leg lock design (FIG. 51), and its internal mechanism (FIGS. 52-53).

FIGS. 54-57 show the second preferred embodiment, in bottom perspective views illustrating hinges (FIG. 54) and hinge slider locks (FIGS. 55-57).

FIGS. 58-61 show the second preferred embodiment, in perspective (FIG. 58), section (FIG. 59), cutaway (FIG. 60), and component (FIG. 61) views illustrating folding features, including the legs in a stowed leg configuration and a folding lock.

FIGS. 62-65 show in perspective views a process of converting the second preferred embodiment, from an operational configuration with legs extended (FIG. 62), to an operational configuration with legs retracted (FIG. 63), to a configuration in which the panels are in an open configuration and the legs are in a stowed configuration (FIG. 64), to a portable configuration (FIG. 65).

FIGS. 66-73 show a plurality of stages of the present invention, each being of the second preferred embodiment, in top perspective (FIGS. 66 and 70), bottom perspective (FIGS. 67 and 71), bottom (FIGS. 68 and 72), and component (FIGS. 69 and 73) views, illustrating the stages in a configuration in which they are connected to one another at certain sides to form a larger stage, including illustrating adjacent legs in asymmetrical positions to avoid one another in such a configuration, including when the legs are extended.

FIGS. 74-76 show the third preferred embodiment, in top perspective (FIG. 74), side (FIG. 75) and bottom perspective (FIG. 76) views, in a collapsed operational configuration, illustrating supports that elevate the platform of the stage when the legs are in a stowed configuration.

FIGS. 77-79 show the third preferred embodiment, in a close-up cutaway view of a central support (FIG. 77), a close-up perspective cutaway view of a support (FIG. 78), and a close-up side cutaway view of a support (FIG. 79), illustrating the supports' non-interference with the conversion of the stage into a portable configuration.

FIGS. 80-84 show the third preferred embodiment, in a component view of a leg (FIG. 80), a close-up perspective view of a support (FIG. 81), and a close-up perspective view of central supports (FIG. 82), illustrating the supports' positions adjacent certain legs of the stage, and in close-up perspective (FIG. 83) and close-up side (FIG. 84) views of a corner brace of the stage, illustrating features of the frame that accommodate the supports.

FIGS. 85-92 show the third preferred embodiment, in a component top perspective view of frames of the stage (FIG. 85), cross-section views of cooperating first and second frame components (FIGS. 86-87), a perspective cutaway view of a connection of the frames (FIG. 88), and side cutaway views illustrating a connection sequence for connecting the frames (FIGS. 89-92).

FIGS. 93-94 show the third preferred embodiment, in a component close-up perspective view of a foot of a leg of the stage (FIG. 93) and a component view of pads suitable for attachment to a foot pad of the foot (FIG. 94).

FIGS. 95-97 show a plurality of stages of the present invention, each being of the third preferred embodiment, in a bottom perspective view illustrating the stages in a configuration in which they are connected to one another at certain sides to form a larger stage (FIG. 95), and component views of connection devices for connecting the stages (FIGS. 96-97).

FIGS. 98-100 show a fourth preferred embodiment, in perspective views, in an operational configuration (FIG. 98), a portable configuration (FIG. 99), and a multiple stage configuration (FIG. 100).

FIGS. 101-103 show the fourth preferred embodiment, in perspective views, in an operational configuration with extended legs (FIG. 101), an operational configuration with retracted legs (FIG. 102), and a collapsed operational configuration (FIG. 103).

FIGS. 104-107 show the fourth preferred embodiment, in bottom perspective (FIG. 104) and partial bottom perspective (FIG. 105) views in a collapsed operational configuration, a bottom perspective view with panels partially closed (for example, folded) and legs in a stowed configuration (FIG. 106), and a partial perspective view in an operational configuration illustrating a locking slide beam (FIG. 107).

FIGS. 108-109 show the fourth preferred embodiment, in partial side (FIG. 108) and side cutaway (FIG. 109) views illustrating a central leg design.

FIGS. 110-112 show the fourth preferred embodiment, in a side view, in an operational configuration, illustrating an extendable leg design (FIG. 110) and cutaway component views of leg extension lock (FIGS. 111-112).

FIGS. 113-115 show the fourth preferred embodiment, in a side view showing a rotatable leg design (FIG. 113) and detail views of a leg rotation lock with the leg in a support configuration (FIG. 114) and a stowed configuration (FIG. 115).

FIGS. 116-119 show the fourth preferred embodiment, in perspective views, in a process of conversion from an operational configuration with extended legs (FIG. 116), to an operational configuration with retracted legs (FIG. 117), to a collapsed operation configuration (FIG. 118), to a portable configuration (FIG. 119).

FIGS. 120-122 show a plurality of stages of the present invention, each being of the fourth preferred embodiment, in bottom perspective (FIG. 120), adjacent leg detail (FIG. 121) and stage connector detail (FIG. 122) views, illustrating the stages in a configuration in which they are connected to one another at certain sides to form a larger stage, including illustrating adjacent legs in asymmetrical positions so as to avoid one another in such a configuration, and a connector used to secure the stages together at the sides.

FIGS. 123-125 show the fifth preferred embodiment, in a top perspective view in an operational configuration (FIG. 123) and bottom perspective views in an operational configuration (FIG. 124) and a collapsed operational configuration (FIG. 125), illustrating an angled central leg.

FIGS. 126-128 illustrate in perspective views a leg rotation lock of certain preferred embodiments of the present invention.

FIGS. 129-132 illustrate in perspective views a clamp and pin feature of certain preferred embodiments of the present invention.

DETAILED DESCRIPTION OF PREFERRED EMBODIMENTS

Following are detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

It should be understood that the same element numbers on the figures identify the same or similar elements (or additional or alternate versions of such elements) that are so numbered on other figures, regardless of whether the numbered elements in a given figure are specifically referred to in the description accompanying that figure.

It should further be understood that the elements described in the detailed description below have, additionally and/or alternatively to the features described in the detailed description below, the features discussed in the summary above with respect to the similarly identified and discussed elements in the summary.

It should further be understood that the preferred embodiments described herein can have, additionally or alternatively, the same or similar elements as the other preferred embodiments described herein, even elements or features of the other preferred embodiments that are not specifically discussed with respect to a given preferred embodiment. The invention contemplates that any one or more of the elements and features described herein can be included in any embodiment, in any number and in any permutations of combinations thereof, without departing from the scope of the invention.

FIGS. 1-25 show a first preferred embodiment of a stage 1000 of the present invention Elements of the first preferred embodiment of the stage 1000 corresponding to elements of the other preferred embodiments of the stage 1000 discussed herein have the same or similar features, unless otherwise discussed, and nevertheless, constitute additional and/or alternative features of such corresponding elements as to the other preferred embodiments of the stage 1000 discussed herein. Accordingly, such corresponding elements use the same or similarly indicative element numbers.

Referring now to FIGS. 1-4, these figures show the stage 1000 in a portable configuration 1420, showing panels 1100A,B in a closed configuration 1510.

Figure 1:
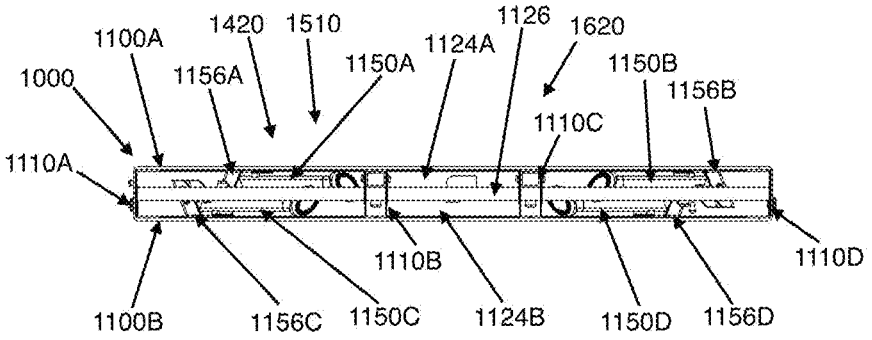

FIG. 1 shows the stage 1000 in a back view, looking into the rotatable connection (for example, folding connection) (see hinges 1110A-D) between the panels 1100A,B, with legs 1150A-D being viewable in a stowed configuration 1620 in the recesses 1124A,B of the panels 1100A,B with the cradles (or bases 1156A-D) of the legs 1150A-D extending into and contained within the enclosure 1126 formed by the recesses 1124A,B. The panels 1100A,B are folded flush against one another in the closed configuration 1510.

Figure 2:
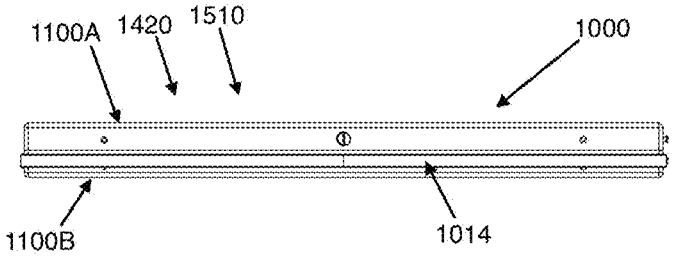

FIG. 2 shows the stage 1000 in a front view, looking opposite the rotatable connection (for example, folding connection) (see hinges 1110A-D in FIG. 1) between the panels 1100A,B, showing the loop of a strap 1014 for carrying the stage 1000. The strap 1014 is connected to the sides of panel 1100B (as shown also in FIGS. 3 and 4).

Figure 3:
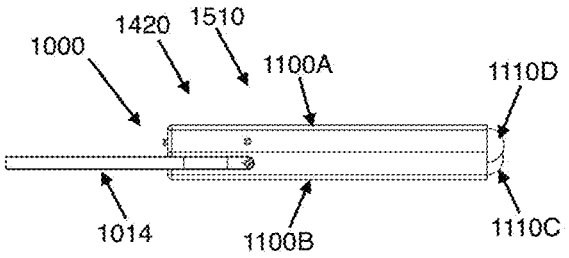

FIG. 3 shows the stage 1000 in a side view, looking from the right side of FIG. 2. The loop of strap 1014 is spaced from the panels to allow the stage 1000 to be carried by the strap 1014 over a person's shoulder. Hinges 1110C and 1110D are visible in side view.

Figure 4:
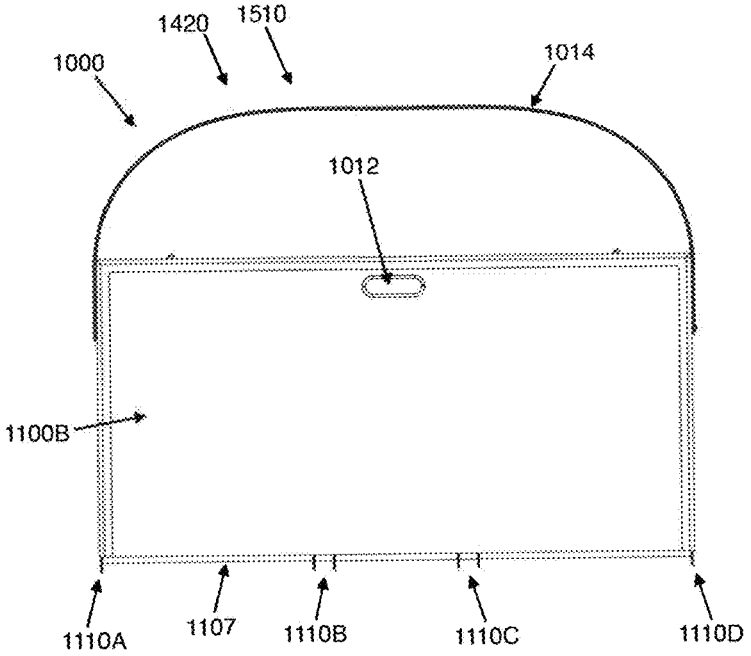

FIG. 4 shows the stage 1000 in a top view, looking from the top side of FIG. 1 and the bottom side of FIG. 2. This view shows a handle 1012 for carrying the stage 1000. Preferably, the handle 1012 includes a hole in each panel 1100A,B, and a person can grip the handle 1012 all the way through from one panel 1100A,B to the other. Rod 1107 of the hinges 1110A-D is visible in this view.

Figure 5:
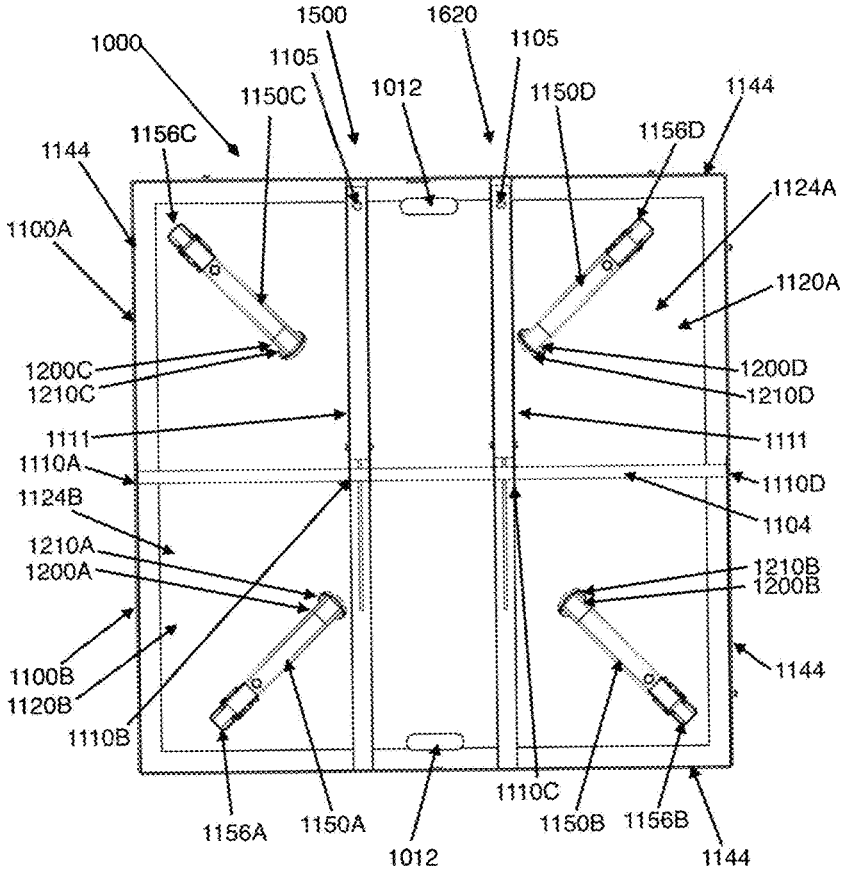
Figure 6:
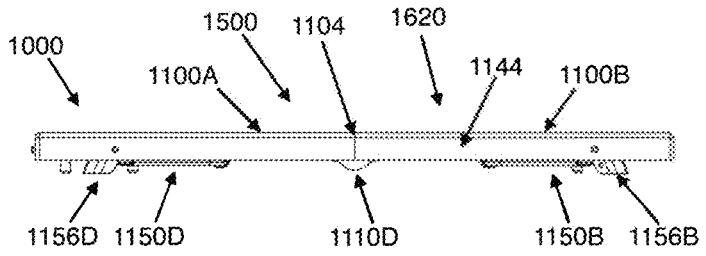

Referring now to FIGS. 5-6, these figures show the stage 1000 in a configuration in which the panels 1100A,B are in an open configuration 1500 and the legs 1150A-D are in a stowed configuration 1620.

FIG. 5 shows the stage 1000 in a bottom view. The legs 1150A-D are shown with their bases 1156A-D attached in asymmetrical positions relative to one another on the panels 1100A,B. The legs 1150A-D are stowed against the panels 1100A,B, into the recesses 1124A,B of the panels 1100A,B formed on the bottom sides 1120A,B of the panels 1100A,B. The feet 1200A-D of the legs 1150A-D are shown, with foot pads 1210A-B. Sliding lock bars 1111 are also shown, in an unlocked position. In the unlocked position, the sliding lock bars 1111 allow the panels 1100A,B to be folded (for example, closed) together as shown in FIGS. 1-4. In the locked position (shown in FIG. 7) the sliding lock bars 1111 are slid across the midline 1104 of the panels 1100A,B and accordingly, among other things, provide support to the central area of the platform and prevent the panels 1100A,B from being folded (for example, closed) toward one another. Preferably, pins or set screws 1105 on the sliding lock bars 1111 further secure the sliding lock bars 1111 in the locked and unlocked positions. This view shows both holes of the handle 1012 that is also shown in FIG. 4. Hinges 1110A-D are visible. This view also illustrates the sides 1144 of the stage 1000, which are referenced in discussions herein of multiple stage configurations.

FIG. 6 shows stage 1000 in a side view, looking from the right side of FIG. 5. The bases 1156B,D of legs 1150B,D are visible.

Referring now to FIGS. 7-11, these figures show the stage 1000 in an operational configuration 1400 in which the panels 1100A,B are in an open configuration 1500 and the legs are in a support configuration 1600 and extended. As can be seen in FIGS. 7-11, in the support configuration, the legs 1150A-D each extend past the boundary defined by the plane including the edge of the platform 1040 formed by the panels 1100A,B and perpendicular to the plane defined by the platform 1040. The asymmetrical positioning of the legs 1150A-D enables the non-interference of the legs 1150A-D with the legs of any adjacent stages ("adjacent" meaning, for example, with platforms placed flush against one another at their sides), in that although the legs 1150A-D extend past the boundary (and therefore underneath the platforms of adjacent stages), the legs 1150A-D of the adjacent stages do not interfere with one another.

Figure 7:
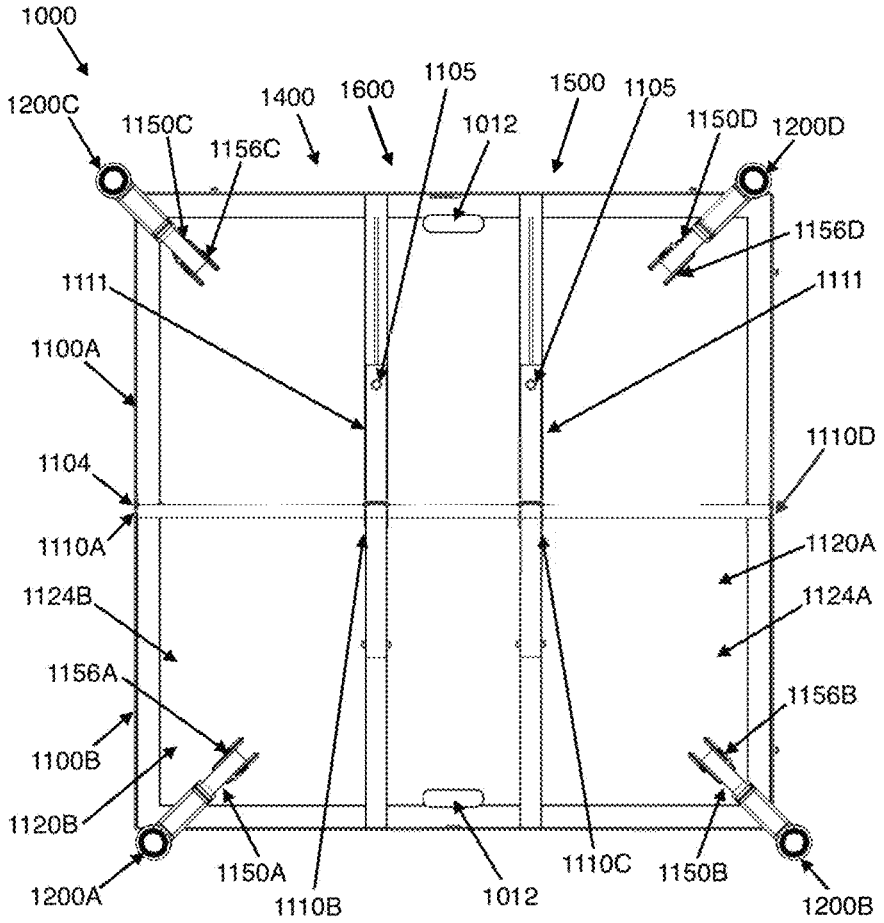

FIG. 7 shows the stage 1000 in a bottom view. Sliding lock bars 1111 are shown in a locked position. In the locked position, the sliding lock bars 1111 are slid across the midline 1104 of the panels 1100A,B and accordingly provide to the central area of the platform and prevent the panels 1100A,B from being folded (for example, closed) toward one another. In the unlocked position (shown in FIG. 5), the sliding lock bars 1111 allow the panels 1100A,B to be (for example, closed) together as shown in FIGS. 1-4. Preferably, pins or set screws 1105 on the sliding lock bars 1111 further secure the sliding lock bars 1111 in the locked and unlocked positions. The legs 1150A-D are shown with their bases 1156A-D attached in asymmetrical positions relative to one another on the recesses 1124A,B of the panels 1100A,B formed on the bottom sides 1120A,B of the panels 1100A,B. The legs 1150A-D are unfolded away from the recesses 1124A,B and are angled outwardly to, among other things, provide enhanced stability. The feet 1200A-D of the legs 1150A-D are shown. This view shows both holes of handle 1012. Hinges 1110A-D are visible.

Figure 8:
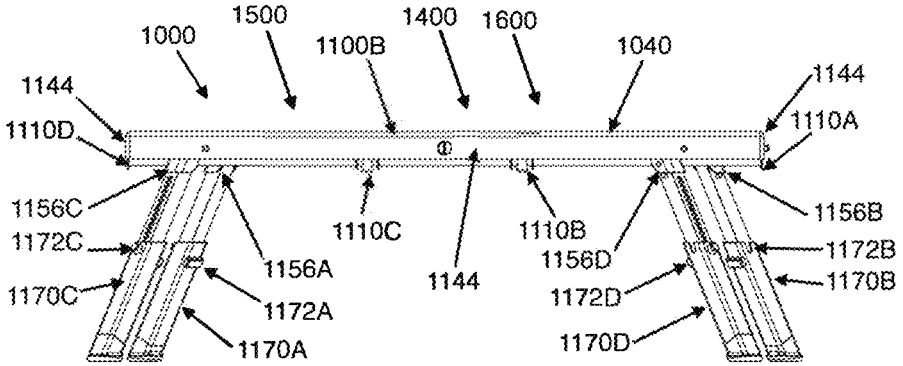
Figure 9:
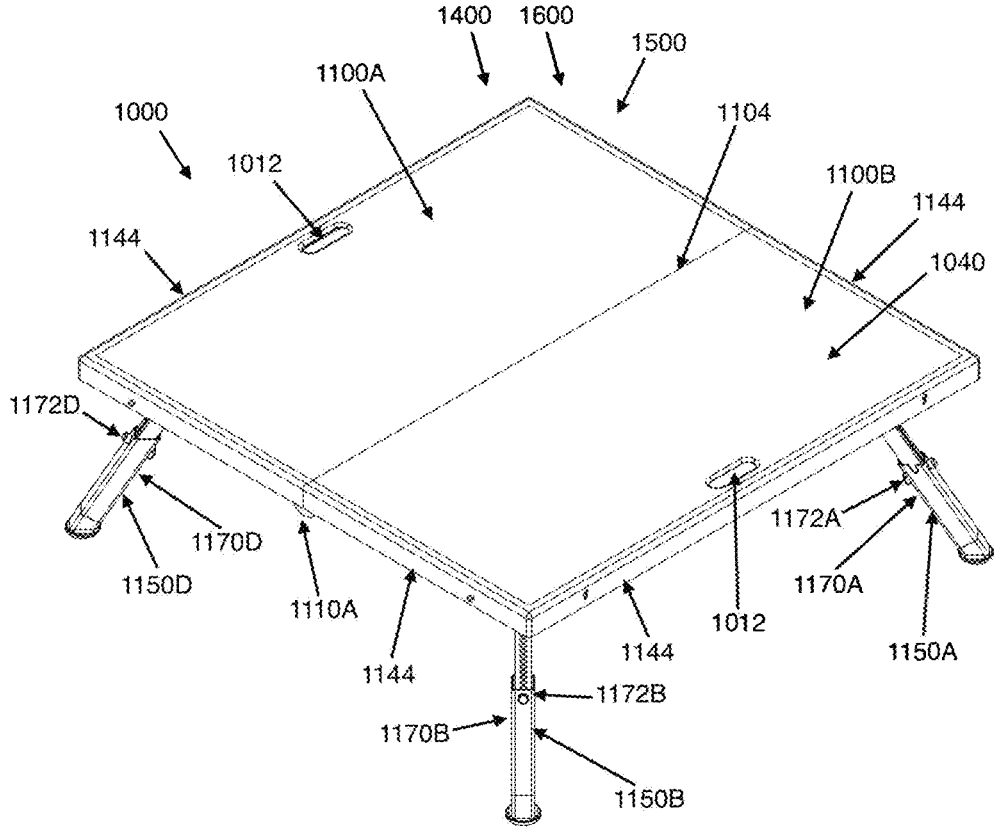
Figure 10:
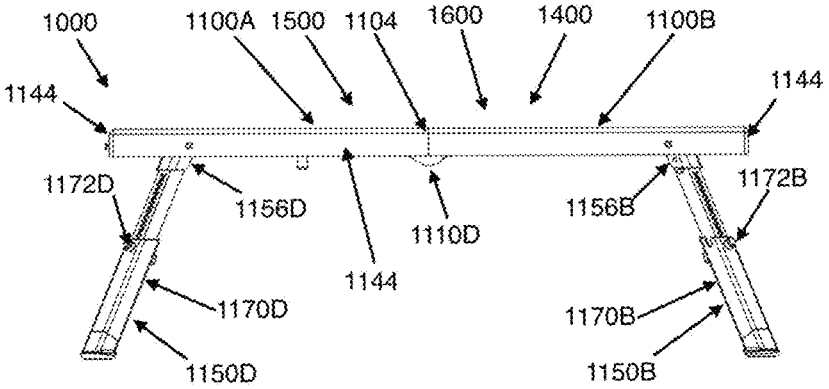
Figure 11:
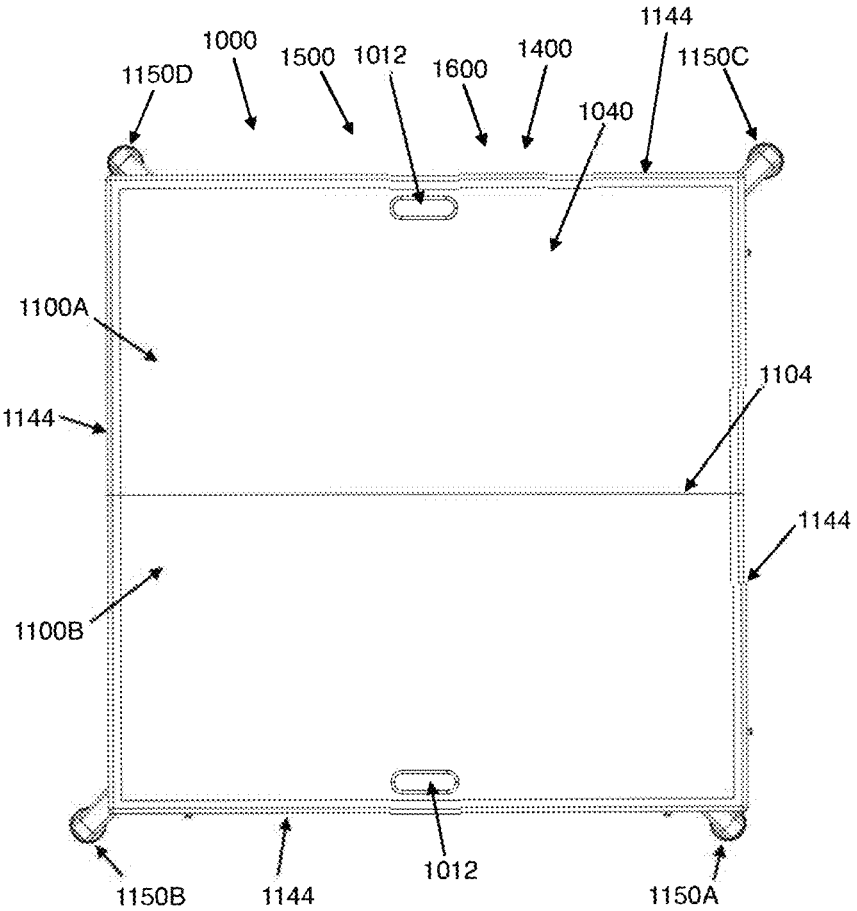

FIG. 8 shows the stage in a side view perpendicular to the midline 1104 of the panels 1100A,B, that is, looking from the top side of FIG. 7. FIG. 9 shows the stage 1000 in a top perspective view. FIG. 10 shows the stage 1000 in a side view along the midline 1104 of the panels 1100A,B, that is, looking from the right side of FIG. 7. FIG. 11 shows the stage 1000 in a top view, looking from the top side of FIG. 8, illustrating the sides 1144 of the stage 1000. Some of these views show some or all (as indicated) of the extendable leg portions 1170A-D and leg extension locks 1172A-D, which are used to adjust the length of the legs 1150A-D and lock the legs 1150A-D at the adjusted height positions. To extend the legs 1150A-D, the leg extension locks 1172A-D can be unlocked to allow movement of the extendable leg portions 1170A-D along the longitudinal axis of the leg 1170A-D, and then locked once the extendable leg portions 1170A-D are located at the desired height locations. The lengths of the legs 1150A-D are preferably individually adjustable in this regard.

Figure 12:
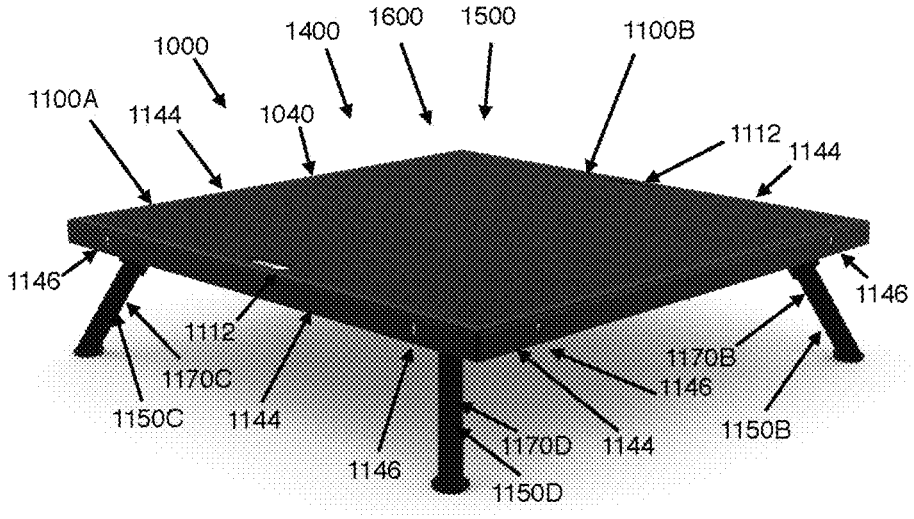

FIG. 12 shows the stage 1000 in a top perspective view, in an operational configuration 1400 in which the panels 1100A,B are in an open configuration 1500 and the legs are in a support configuration 1600 and retracted. That is, the extendable leg portions 1170A,D are shown, but are not extended as they are in FIGS. 7-11. Also shown are slots 1146 for accepting tabs 1147 (see FIGS. 22-23) to secure stages together at their sides 1144 in multiple stage configurations, as discussed with references to FIGS. 21-24.

Figure 13:
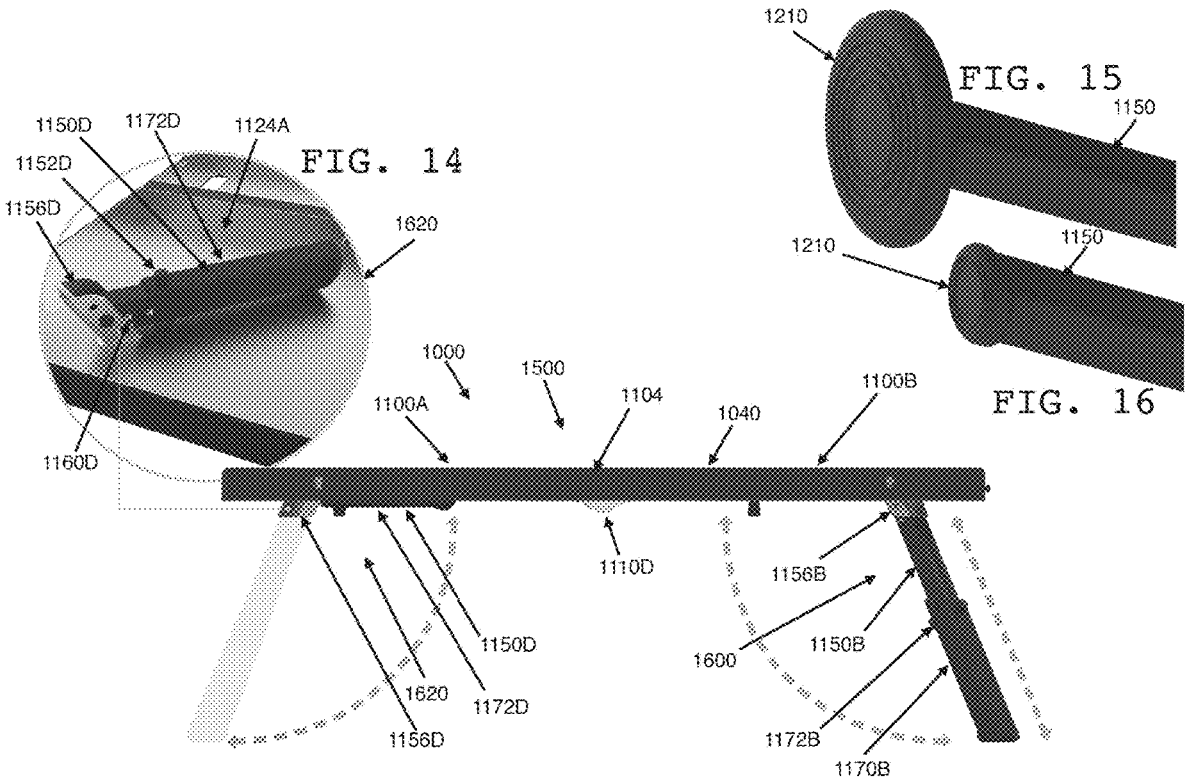

FIG. 13 shows the stage 1000 in a side view along the midline 1104 of the panels 1100A,B, showing leg 1150B in a support configuration 1600 and with the extendable leg portion 1170B extended (and showing base 1172B, extendable leg portion 1172D retracted, and leg extension lock 1172B), and leg 1150D in a stowed configuration 1620 against recess 1124A (having been rotated at the base 1156D). FIG. 13 illustrates the conversion between these configurations. FIG. 14 shows an inset view of leg 1150D in the stowed configuration 1620 against recess 1124A, showing base 1156D, leg rotation lock 1160D, extendable leg portion 1172D retracted, and leg extension lock 1152D. The legs 1150A-D can be moved from the support configuration 1600 to the stowed configuration 1620 by unlocking the leg rotation lock 1160A-D, rotating (or folding) the legs 1150A-D toward and against the recesses 1124A,B, and then locking the leg rotation lock 1160A-D. The legs 1150A-D can be moved from the stowed configuration 1620 to the support configuration 1600 by unlocking the leg rotation lock 1160A-D, rotating (or folding) the legs 1150A-D away from the recesses 1124A,B until the angled position is reached, and then locking the leg rotation lock 1160A-D. FIG. 15 shows a large foot pad 1210 on a foot 1200 of a leg 1150 of the stage 1000. FIG. 16 shows a small foot pad 1210 on a foot 1200 of a leg 1150 of the stage 1000.

Figure 17:
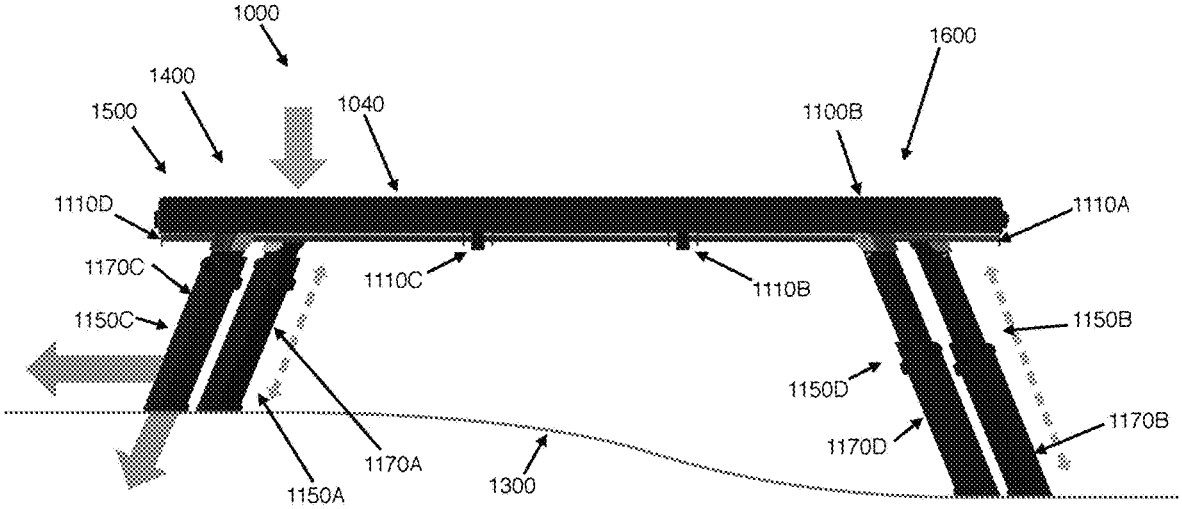

FIG. 17 shows the stage 1000 in an operational configuration 1400, in a side view perpendicular to the midline 1104 of the panels 1100A,B, showing the panels 1100A,B in an open configuration 1500, legs 1150B,D in a support configuration 1600 and extended (that is, extendable leg portions 1170B,D are extended), and legs 1150A,C in a support configuration 1600 and retracted (that is, extendable leg portions 1170A,C are not extended), illustrating the ability of the stage 1000 to be conformed (or conform) to a surface 1300 of varying heights by adjusting the length of each leg 1150A-D independently to the individual lengths needed. Hinges 1110A-D are visible. The legs 1150A-D are angled outward for stability.

Figure 19:
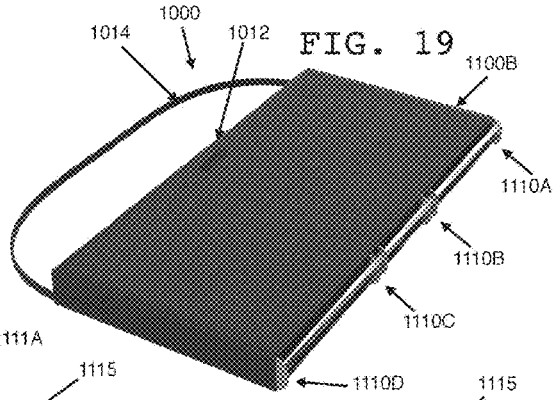
Figure 18:
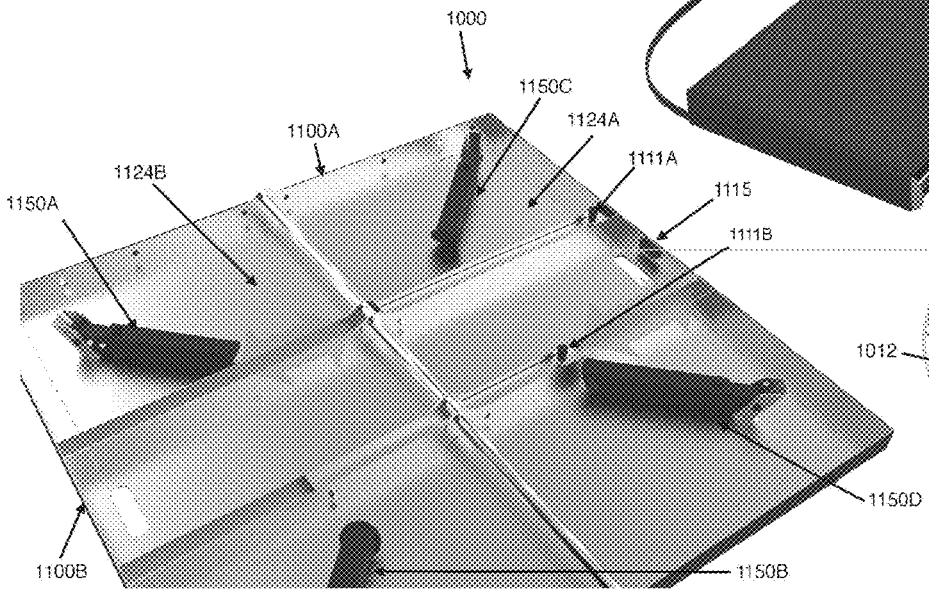
Figure 20:
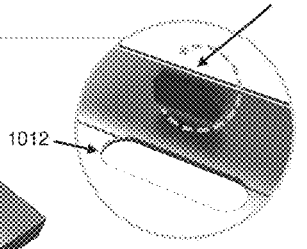

FIG. 18 shows the stage 1000 in a bottom perspective view, in the configuration of FIG. 4, except that one sliding lock bar 1111A is locked and the other sliding lock bar 1111B is unlocked. A magnetic folding lock 1115 is also shown. FIG. 19 shows the stage 1000 in a perspective view, in the configuration of FIG. 4. FIG. 20 shows an inset view of the magnetic folding lock 1115. The magnetic folding lock 1115 has a component on each panel 1100A,B, and the components are attracted to and held against one another by a magnetic force when the panels 1100A,B are in a closed configuration 1510.

Figure 22:
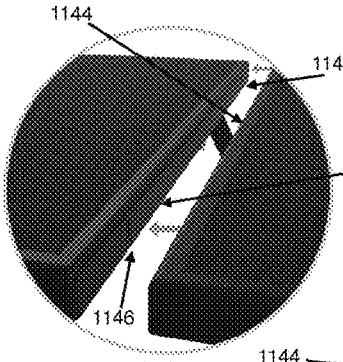
Figure 23:
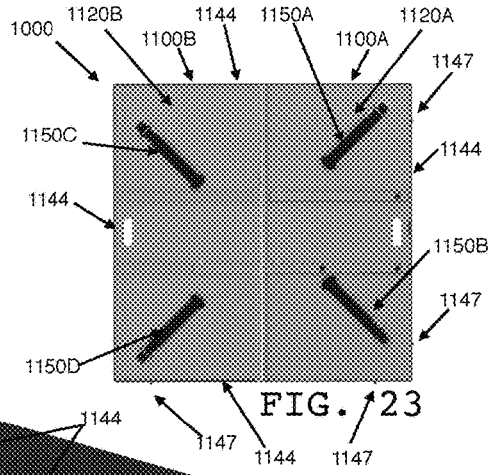
Figure 21:
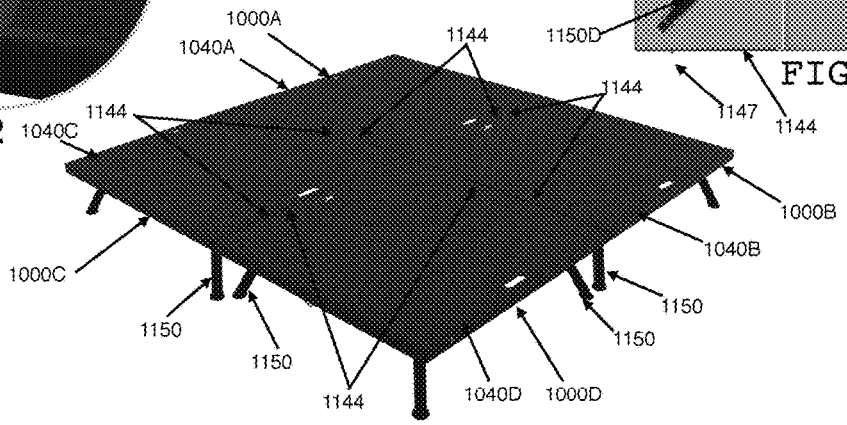
Figure 24:
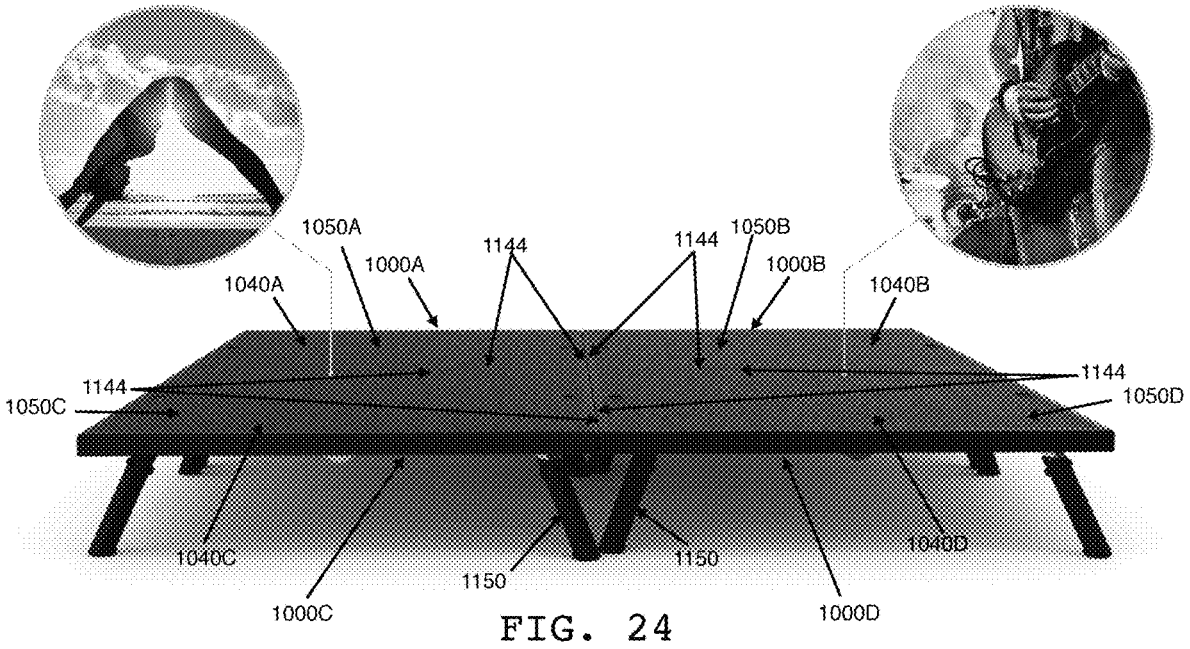

FIG. 21 shows a top perspective view of four stages 1000A-D, each being of the first preferred embodiment of the stage 1000, adjacent one another to form a combined larger platform from the platforms 1040A-D, each of the stages 1000A-D being in an operational configuration 1400 in which the panels 1100A,B (see FIGS. 1-11) of each are in an open configuration 1500 and the legs 1150A-D (see FIGS. 1-11) of each are in a support configuration 1600. Certain sides 1144 of the stages 1000A-D are positioned flush against one another. Legs 1150 of adjacent stages extend underneath the platforms of the adjacent stages but do not interfere with the legs 1150 of the adjacent stages due to being asymmetrically positioned on the bottom sides 1120A,B (see FIG. 23 and also FIGS. 1-11) of the panels 1100A,B (see FIG. 23 and also FIGS. 1-11). FIG. 22 shows an inset view of a connection between the sides 1144 of the stages of FIG. 21, showing slots 1146 for accepting tabs 1147 (see FIG. 23) for holding the sides 1144 together. FIG. 23 shows the stage 1000 in a bottom view, in the configuration of FIG. 5, showing the asymmetrical positioning of the legs 1150A-D (see also FIGS. 1-11) of the stage 1000 and the tabs 1147 for being accepted into slots 1146 (see FIG. 22) for holding the sides 1144 together. FIG. 24 shows the four stage configuration of FIG. 21, in a side view illustrating padded top surfaces 1050A-D.

Figure 25:
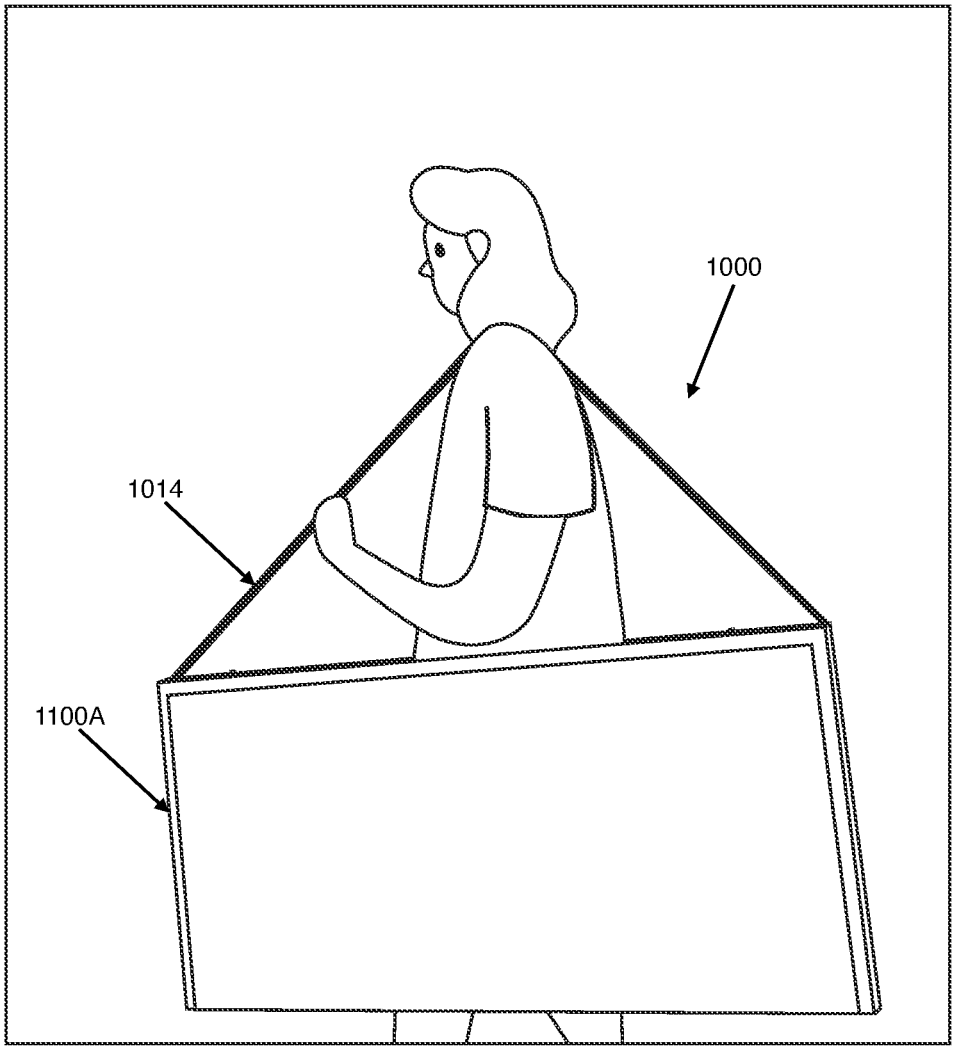

FIG. 25 shows the stage 1000 in a portable configuration 1420, being carried over the shoulder of a person using the shoulder strap 1014.

FIGS. 26-73 show a second preferred embodiment of a stage 1000 of the present invention. Elements of the second preferred embodiment of the stage 1000 corresponding to elements of the other preferred embodiments of the stage 1000 discussed herein have the same or similar features, unless otherwise discussed, and nevertheless, constitute additional and/or alternative features of such corresponding elements as to the other preferred embodiments of the stage 1000 discussed herein. Accordingly, such corresponding elements use the same or similarly indicative element numbers.

Figure 27:
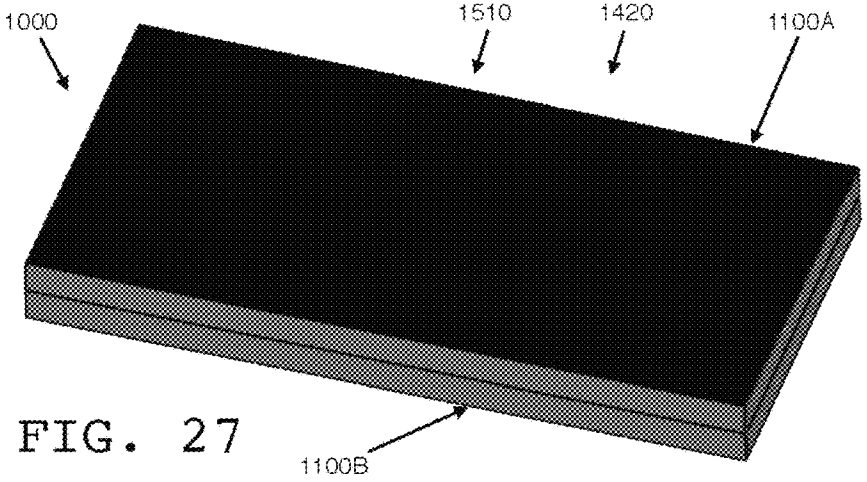
FIGS. 26-73 illustrate preferred features of a second preferred embodiment of a portable stage of the present invention.
Figure 26:
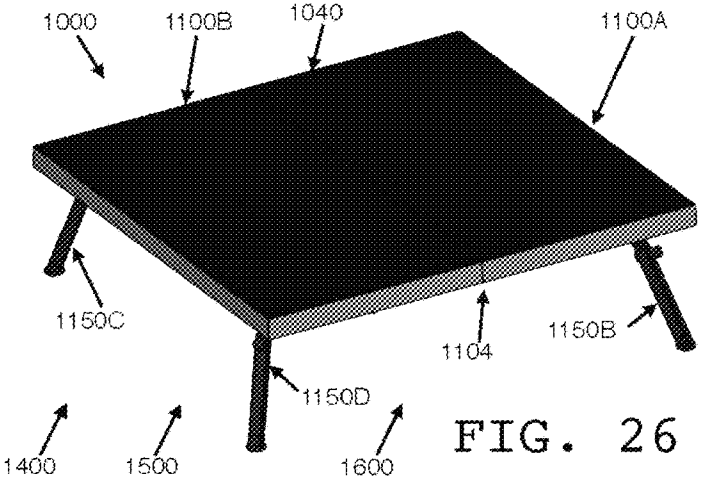
Figure 28:
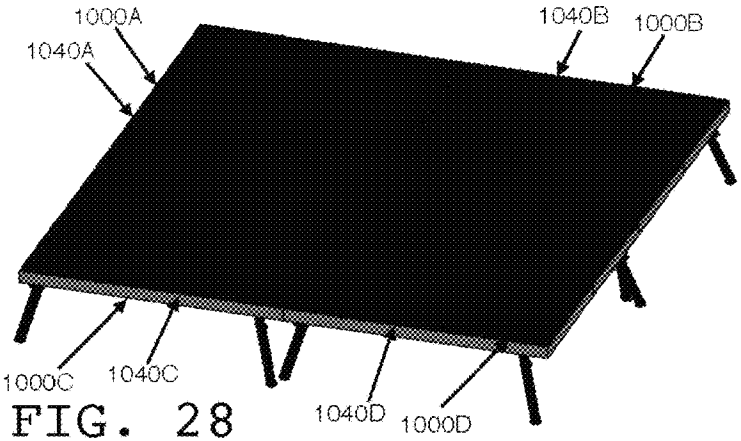

FIGS. 26-27 show the stage 1000 in a top perspective view in an operational configuration 1400 (FIG. 26) in which the panels 1100A,B are in an open configuration 1500 and the legs 1150A-D are in a support configuration 1600 and a top perspective view in a portable configuration 1420 (FIG. 27) in which the panels 1150A-B are in a closed configuration 1510 and the legs (not shown) are in a stowed configuration 1620. FIG. 28 shows a top perspective view of four stages 1000A-D, each being of the second preferred embodiment of the stage 1000, adjacent one another to form a combined larger platform from the platforms 1040A-D, each of the stages 1000A-D being in an operational configuration 1400 in which the panels 1100A,B of each are in an open configuration 1500 and the legs 1150A-D of each are in a support configuration 1600. Certain sides 1144 (see FIGS. 21-24) of the stages 1000A-D are positioned flush against one another. Legs 1150 of adjacent stages extend underneath the platforms of the adjacent stages but do not interfere with the legs 1150 of the adjacent stages due to being asymmetrically positioned on the bottom sides 1120A,B of the panels 1100A,B). Preferably, the area of the platform 1040 of each stage 1000 is approximately 4 feet (1.2 meters) wide by approximately 4 feet (1.2 meters) long. Preferably, the panels 1150A,B of each stage 1000 are each approximately 2.36 inches (0.06 meters) thick. Accordingly, each stage 1000, when in its portable configuration, preferably is approximately 4.72 inches (0.12 meters) thick, and approximately 2 feet (0.6 meters) wide by approximately 4 feet (1.2 meters) long.

Figure 29:
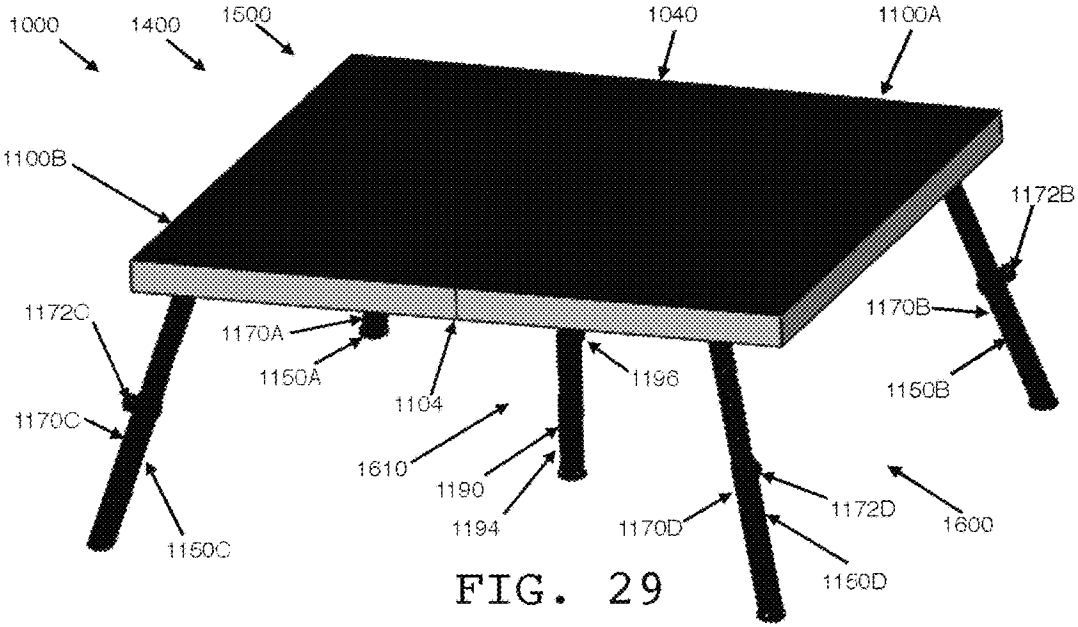

FIG. 29 shows the stage 1000 in a top perspective view in an operational configuration 1400 in which the panels 1150A,B of the platform 1040 are in an open configuration 1500 and the legs 1150A-D are in a support configuration 1600 and extended, including a central leg 1190 in a support configuration 1610 and extended. That is, for the legs 1150A-D,1190 that are extended, the extendable leg portions 1170A-D,1194 thereof are extended and locked in the extended positions by the leg extension locks 1172A-D,1196 (leg extension lock 1172A is not visible here) to increase and/or otherwise establish the desired height of the platform 1040 of the stage 1000. The central leg 1190 provides support to a central area of the platform 1040 (for example, at the center of the midline 1104 of the panels 1100A,B). In certain embodiments, it may be advantageous to lower the central leg 1190 to a height slightly less than the height of the corner legs 1150 so as to prevent an upward bowing of the platform 1040 when the platform 1040 is bearing weight.

Figure 30:
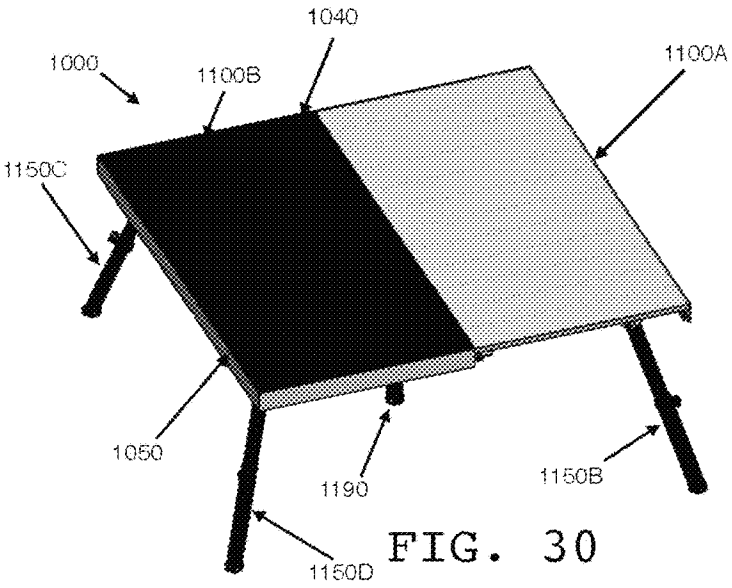

FIG. 30 shows the stage 1000 in a top perspective view in partial cutaway, in a configuration in which the panels 1100A,B of the platform 1040 are in an open configuration 1500 and the legs 1150A-D,1190 are in a support configuration 1600,1620. Further, FIG. 30 shows the platform 1040 having a top surface 1050 with non-slip features for, among other things, providing traction and safety, and having a rib structure for, among other things, providing support and stability.

Figure 31:
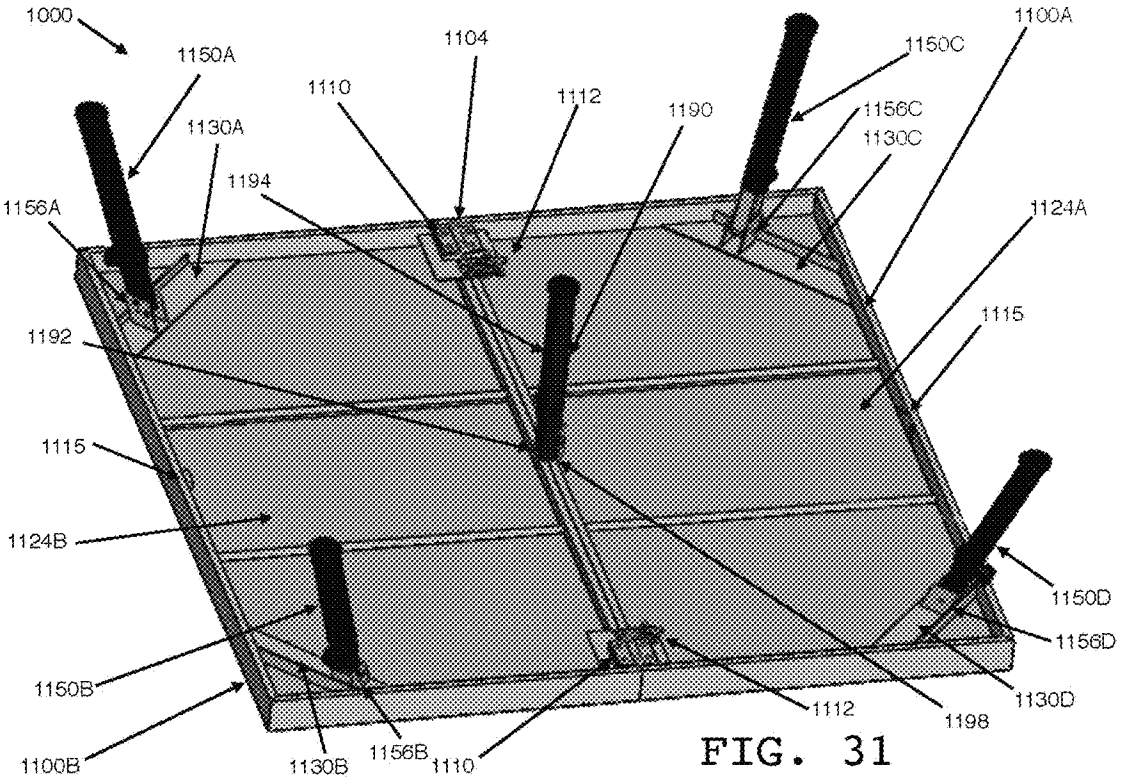

FIGS. 31-36 show the stage 1000 from a bottom perspective view in an operational configuration 1400 in which the panels 1100A,B of the stage 1000 are in an open configuration 1500 and the legs 1150A-D,1190 are in a support configuration 1600,1620 and extended (FIG. 31).

FIG. 31 illustrates corner braces 1130A-D to which the bases 1156A-D of the corner legs 1150A-D are attached for, among other things, enhancing structure and stability.

Figure 32:
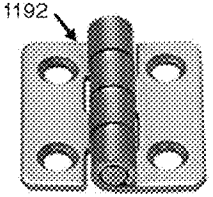

FIGS. 31 and 32 further illustrate a central leg hinge 1192 for, among other things, rotating the central leg 1190 into and out of the support configuration 1610.

Figure 33:
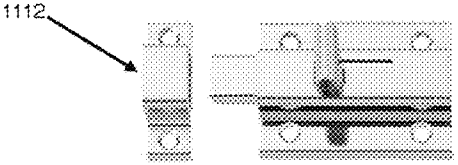
Figure 56:
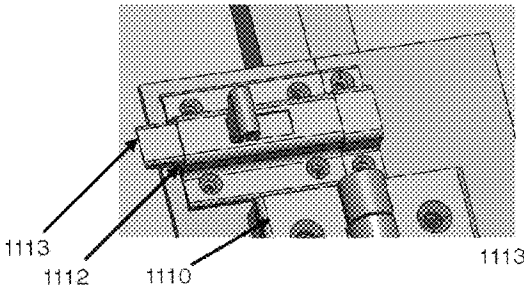
Figure 57:
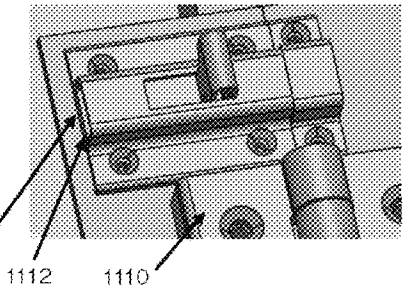

FIGS. 31 and 33 further illustrate slider locks 1112 for, among other things, locking the folding hinges 1110 (or otherwise preventing movement of the folding hinges 1110) to maintain the panels 1100A,B in an open configuration 1500, and unlocking the folding hinges 1110 to allow the panels 1100A,B to be placed in a closed configuration 1510, both as further illustrated by FIGS. 56-57.

Figure 34:
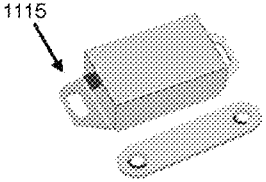

FIGS. 31 and 34 further illustrate a magnetic folding lock 1115 for, among other things, maintaining the panels 1100A,B in a closed configuration 1510.

Figure 35:
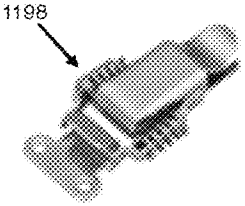
Figure 50:
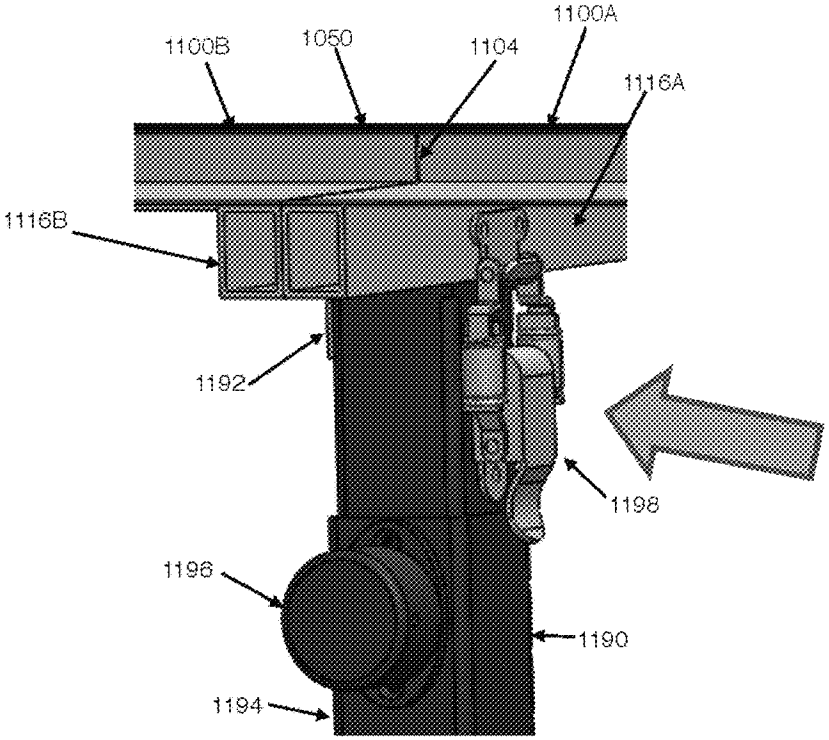
Figure 49:
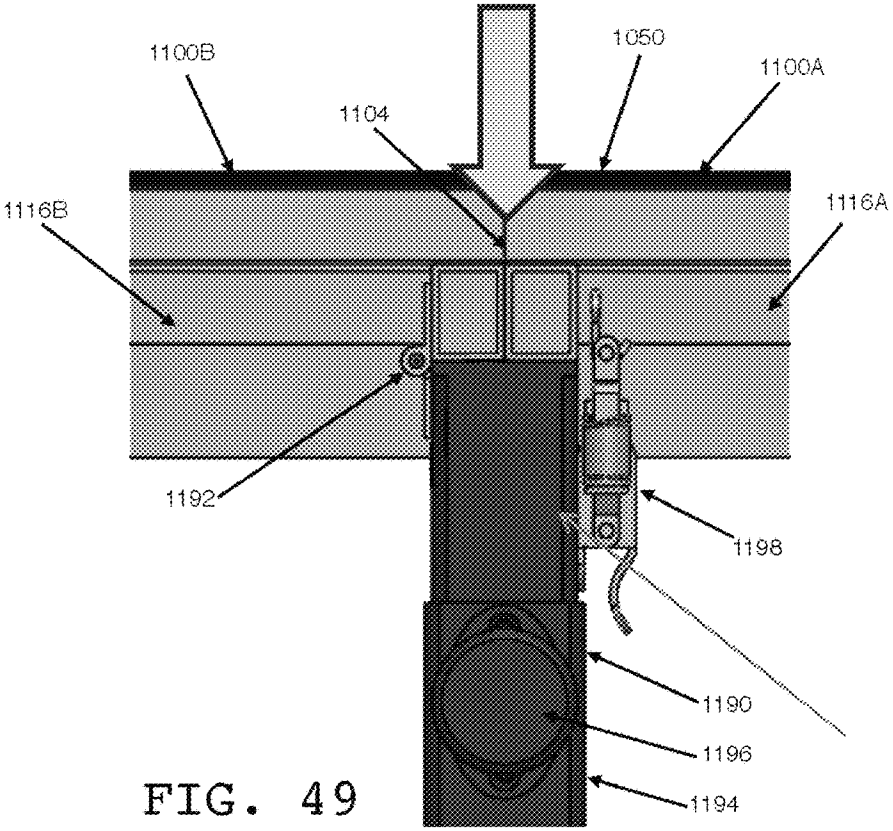

FIGS. 31 and 35 further illustrate a central leg lock 1198 for, among other things, locking the central leg 1190 in the support configuration 1610, and unlocking the central leg 1190 to allow it to be rotated back to a stowed configuration 1630, both as further illustrated by FIGS. 49-50.

Figure 36:
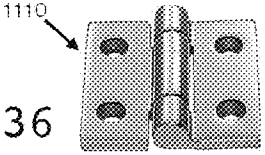
Figure 39:
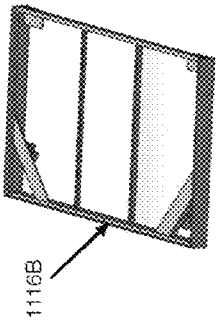
Figure 40:
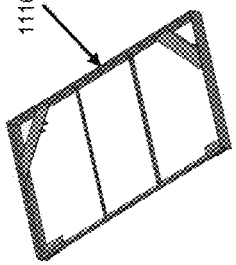

FIGS. 31 and 36 further illustrate a folding hinge 1110 for, among other things, allowing the panels 1100A,B to be folded towards one another about the midline 1104 of the panels 1100A,B to be placed into the closed configuration 1510, and to be unfolded away from one another about the midline 1104 of the panels 1100A,B to be placed in the open configuration 1500.

Figure 43:
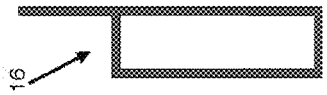
Figure 42:
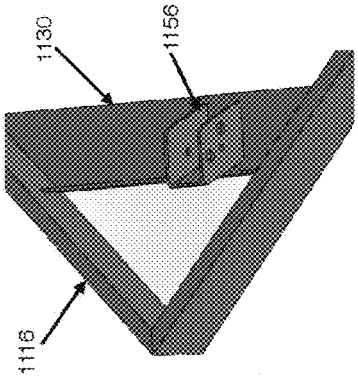
Figure 38:
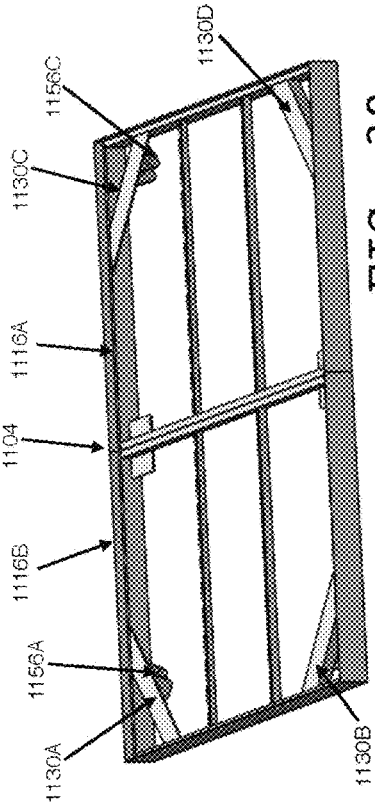

FIGS. 37-43 show the stage 1000 in deconstructed views, illustrating a frame design. FIGS. 37-43 illustrate the structure of the frames 1116A,B of each panel 1100A,B, including the corner braces 1130A-D and the hinges 1110 at the midline 1104 of the panels 1100A,B. As also shown in FIG. 42 in detail, the bases 1156A-D of the legs 1150A-D are attached to the corner braces 1130A-D for, among other things, enhancing structure and stability. The extrusion cross-section of the frame is illustrated in FIG. 43.

Figure 41:
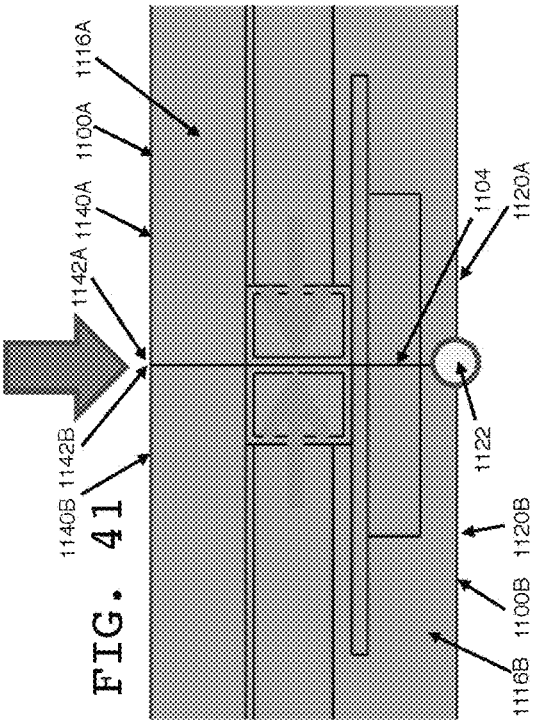
Figure 37:
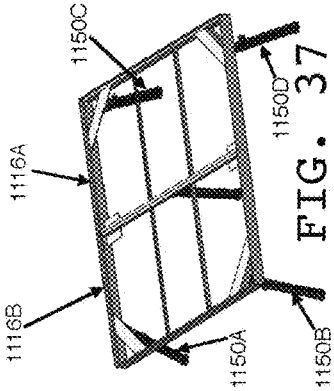

FIG. 41 illustrates a frame and hinge design that, among other things, enhances the structural support provided at the midline 1104 of the panels 1100A,B. Further in this regard, FIG. 41 illustrates that a center of rotation 1122 of the hinges 1110 is located at the bottom sides 1120A,B of the panels 1100A,B, so that, among other things, when a weight presses down on the top surfaces 1140A,B of the panels 1100A,B, the top edges 1142A,B of the panels A,B are pressed together, and the strength of the structure of the panels 1100A,B and the strength of the hinges 1100 prevent separation of the hinges 1100 from their internal parts and/or from the frame 1116A,B and accordingly prevent the stage from collapsing under the weight.

Figure 44:
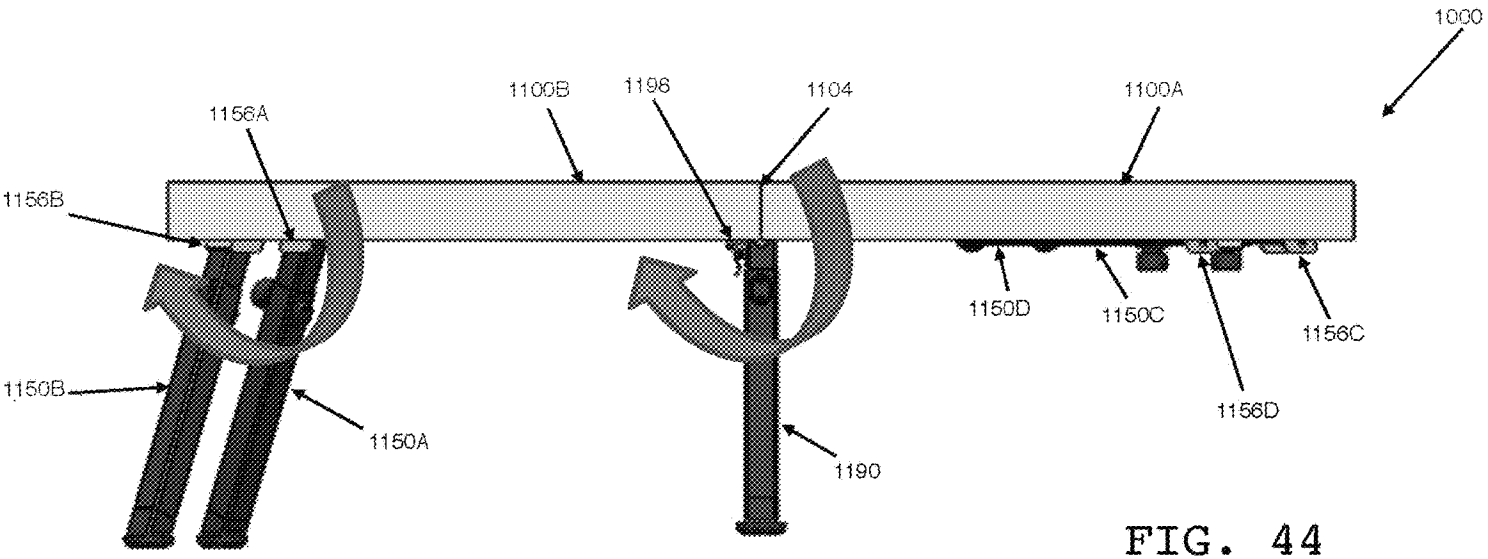
Figure 47:
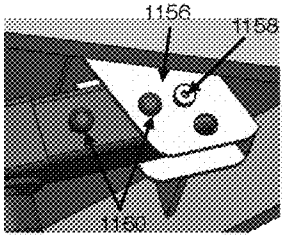
Figure 48:
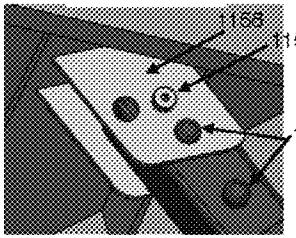
Figure 46:
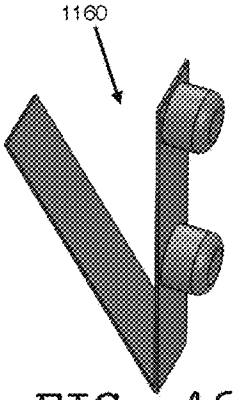
Figure 45:
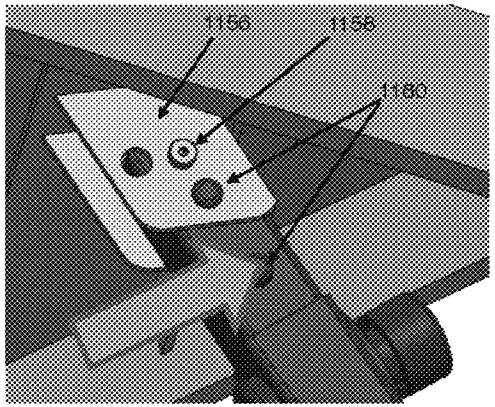

FIGS. 44-48 show the stage 1000, illustrating a leg rotation lock design. FIG. 44 shows a side view of the stage 1000, with the panels 1100A,B in an open configuration 1500, legs 1150A,B,1190 in a support configuration 1600, 1610, and legs 1150C,D in a stowed configuration 1620. FIGS. 44-48 illustrates that the corner legs 1150A-D are rotatable about a center of rotation 1158A-D at the base 1156A-D of the leg 1150A-D, and can be locked in the stowed configuration 1620 and in the support configuration 1600 by a leg rotation lock 1160A-D. (FIGS. 49-50 illustrate the center leg 1190 rotation and locking features.) In the illustrated mechanism, the leg rotation lock 1160 includes two pins that are spring-loaded (see FIG. 46), one being a control pin and the other being a fitting pin that fits into both of two holes in the base 1156 of the leg 1150 (see FIG. 45), such that if the control pin is pressed and held, the fitting pin is free to be moved from one hole to another, and when the control pin is released, the fitting pin is pushed into the hole with which it is aligned. Accordingly, the leg 1150 can be locked in either the support (for example, unfolded) configuration (FIG. 48) engaged by one of the holes, or the stowed (for example, folded) configuration (FIG. 47) engaged by the other of the holes, and unlocked to be rotated, about the center of rotation 1158, between the configurations.

FIGS. 49-50 show the stage 1000 in component views, illustrating a central leg support design and central leg rotation lock design. FIG. 49 illustrates that the central leg 1190 has a rotational connection or hinge 1192 at the frame 1116B of one of the panels 1100B such that when the central leg 1190 is rotated into a stowed configuration 1630, the central leg 1190 fits in to the recess 1124B of the panel 1100B, and when the central leg 1190 is rotated into a support configuration 1610, the central leg 1190 supports both panels 1100A,B at the midline 1104 of the panels 1100A,B. This provides, with regard to a weight pressing down on the top surface 1050 of the platform 1040 at the midline 1104 of the panels 1100A,B, enhanced support for the central area of the platform 1040. Further, in order to, among other things, maintain the central leg 1190 in the support configuration 1610, a central leg rotation lock 1198, shown in FIGS. 49 and 50 as a quick release clamp, can be locked to secure the central leg 1190 to the frame 1116A of the other panel 1100A.

Figure 51:
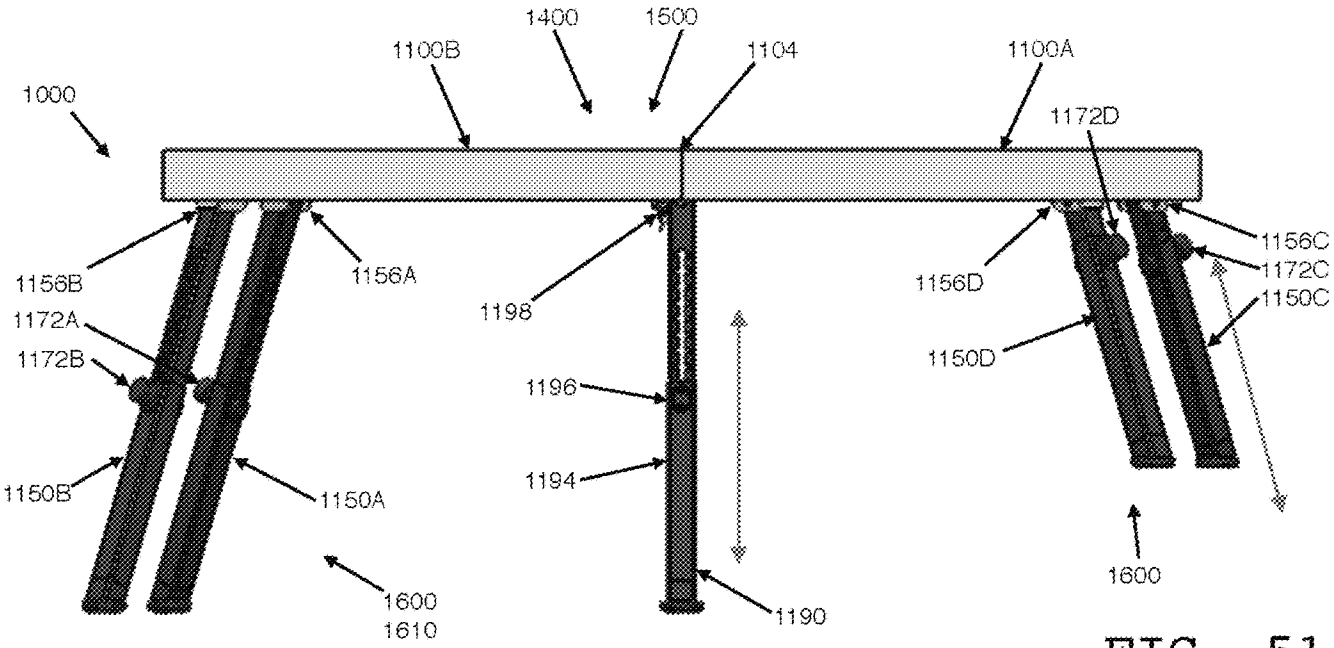
Figure 53:
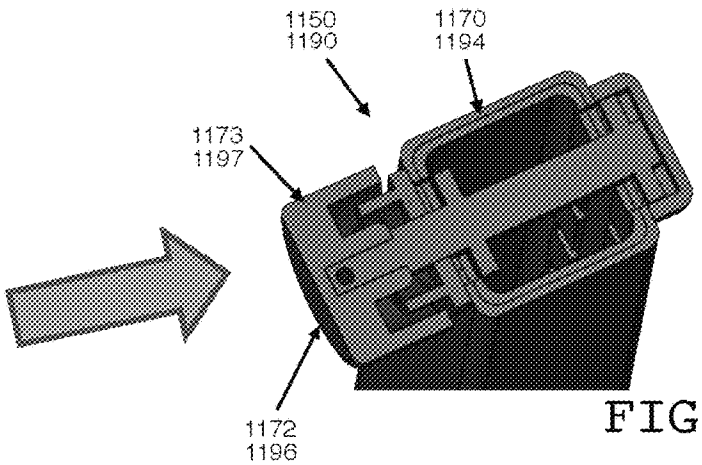
Figure 52:
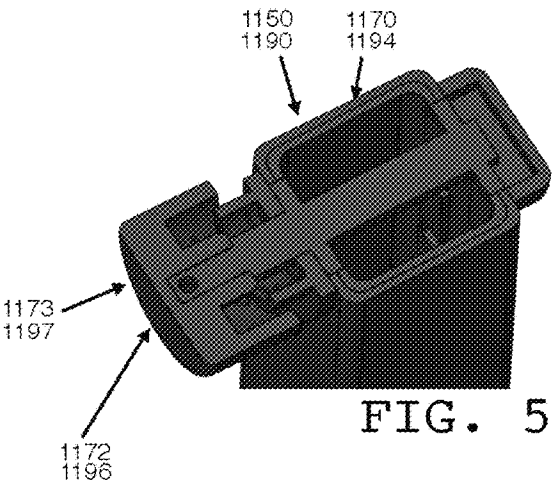

FIGS. 51-53 illustrate a leg extension lock design. FIG. 51 shows a side view of the stage 1000 in an operational configuration 1400, with the panels 1150A,B in an open configuration 1500, legs 1150A,B,1190 in a support configuration 1600,1610 and extended, and legs 1150C,D in a support configuration 1600 and retracted. The legs 1150A, B,1190 are adjustable by unlocking the leg extension lock 1172A-D,1196 and moving the extendable leg portion 1170A-D,1194 along the length of the leg 1150A-D,1190 until a desired length is reached, and then locking the leg extension lock 1172A-D,1196. Preferably, the corner legs 1150A-D are adjustable in length by approximately 7 inches (180 mm), and central leg 1190 is adjustable in length by approximately 6.5 inches (166.5 mm). FIGS. 52 and 53 are cutaway component views of the leg extension lock 1172, 1196, in a locked configuration (FIG. 52) and an unlocked configuration (FIG. 53). The leg extension lock 1172,1196 is biased in the locked configuration, and can be placed in the unlocked configuration by pressing on a button 1173,1197 of the leg extension lock 1172,1196, which pushes the blocking components of the leg extension lock 1172,1196 away from the non-moving part of the leg 1150,1190 to allow the extendable leg portion 1170,1194 to move along the length of the non-moving part of the leg 1150,1190. Once the extendable leg portion 1170,1194 is at the desired location, the button 1173,1197 can be released to release the blocking components of the leg extension lock 1172,1196 to move back to their blocking configuration.

Figure 54:
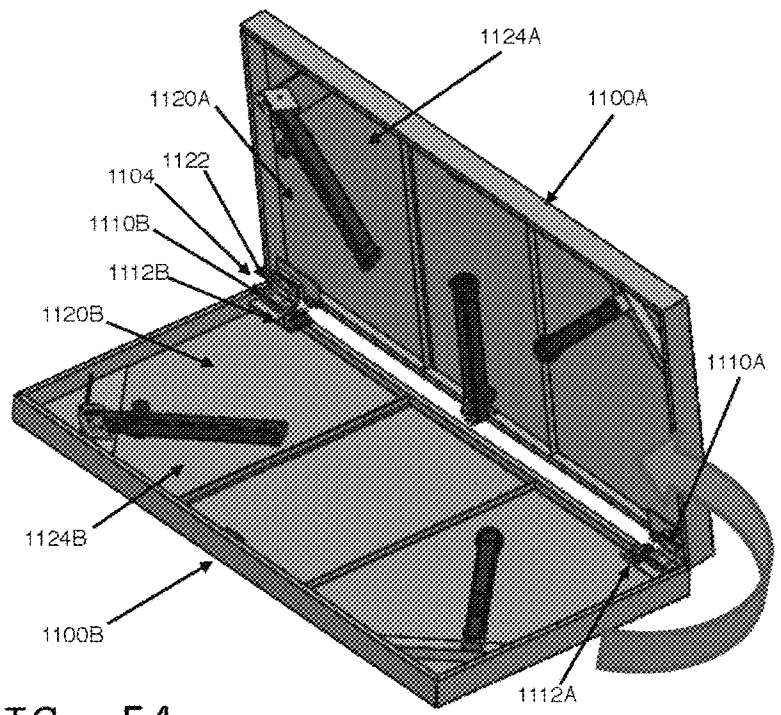

FIGS. 54-57 illustrate a slider lock design. FIG. 54 shows the stage 1000 in a bottom perspective view showing the stage 1000 partially open (that is, with the panels 1100A,B in between an open configuration 1500 and a closed configuration 1510), showing the rotation of the panels 1150A,B about a center of rotation 1122 at the bottom sides 1120A,B of the panels 1100A,B along the midline 1104 of the panels 1100A,B, the rotation being enabled by hinges 1110A,B along the midline 1104. Slider locks 1112A,B are positioned adjacent the hinges 1110A,B and in FIG. 54 are in an unlocked configuration, which, among other things, allows the panels 1100A,B to be rotated from one configuration to another.

Figure 55:
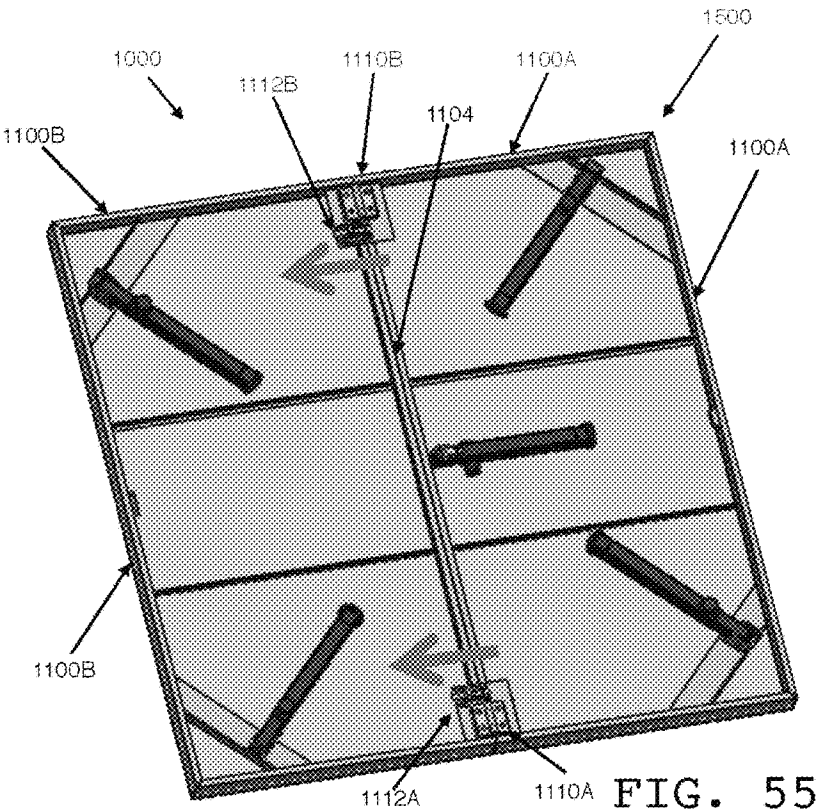

FIG. 55 show the stage 1000 in a bottom perspective view showing the stage 1000 with the panels 1100A,B in an open configuration 1500. Slider locks 1112A,B are positioned adjacent the hinges 1110A,B and in FIG. 55 are in a locked configuration, which, among other things, prevents the panels 1100A,B from being rotated and provides support for the midline 1104 of the panels 1150A,B. As illustrated in FIGS. 56 and 57, the slider locks 1112A,B can be moved between the unlocked configuration (FIG. 56) and the locked configuration (FIG. 57) by moving a slider lock bar 1113 between an unblocking position (FIG. 56) and a blocking position (FIG. 57).

Figure 58:
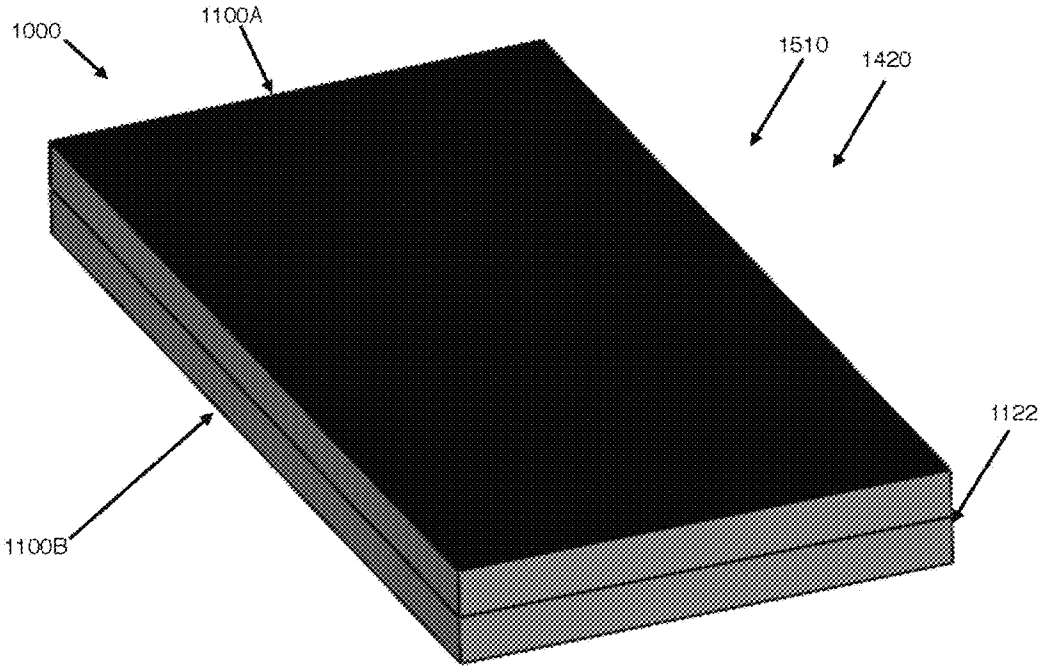

FIGS. 58-61 illustrate folding features. FIG. 58 shows the stage 1000 in a perspective view in a portable configuration 1420, in which the panels 1100A,B are in a closed configuration 1510 and the legs 1150A-D,1190 are in a stowed configuration 1620,1630. The panels 1100A,B can be closed toward one another by rotating them about the center of rotation 1122 of the hinges 1110 (see FIGS. 59 and 60) between the panels 1100A,B.

Figure 59:
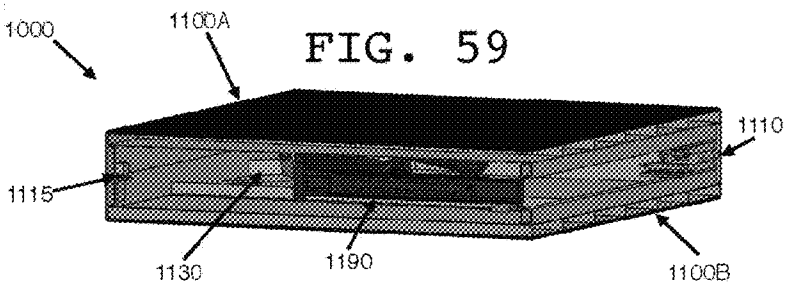

FIG. 59 shows the stage 1000 in a perspective section view in the portable configuration 1420, showing the panels 1100A,B closed about a hinge 1110 between the panels 1100A,B, and showing a corner brace 1130, a central leg 1190 and a folding lock 1115. The folding lock 1115 has two components, one on each panel 1100A,B, that are held together by a magnetic force when the components are brought near one another. Accordingly, when the panels 1100A,B are folded closed and the components are therefore brought together, the components are held together and therefore the panels 1150A,B are held together unless and until they are opened with a force that overcomes the magnetic force of the folding lock 1115.

Figure 60:
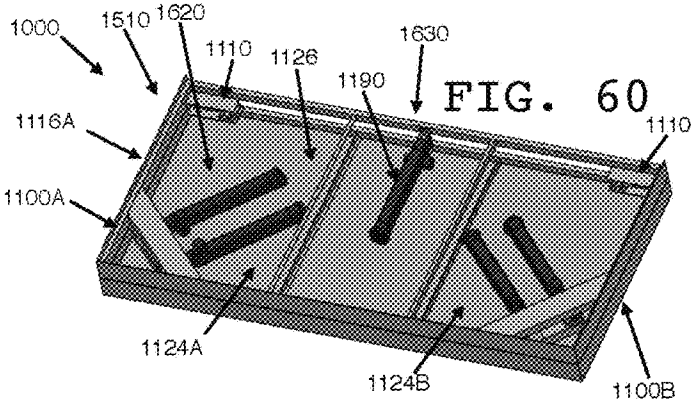
Figure 61:
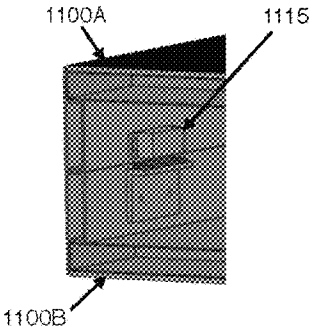

FIG. 60 shows the stage 1000 in a perspective section view in the portable configuration 1420, showing the panels 1100A,B in a closed configuration 1510, but with the enclosure 1126 formed by the recesses 1124A,B visible. Hinges 1110 are shown, along with legs 1150A-D,1190 in a stowed configuration 1620,1630 in which the legs 1150A-D,1190 are folded into the recesses 1124A,B and fit within the enclosure 1126.

Figure 63:
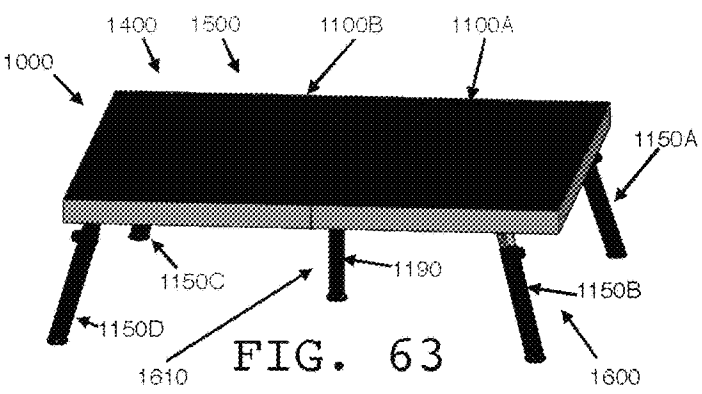
Figure 64:
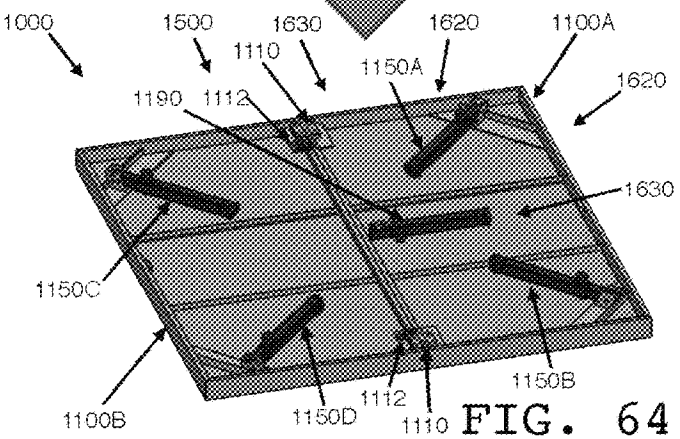
Figure 62:
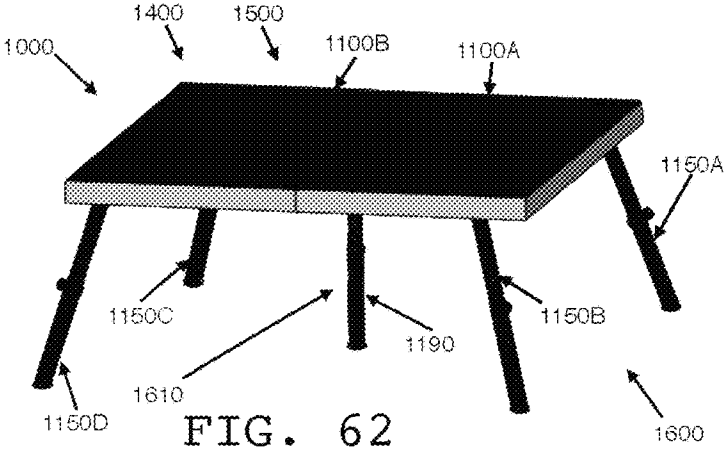
Figure 65:
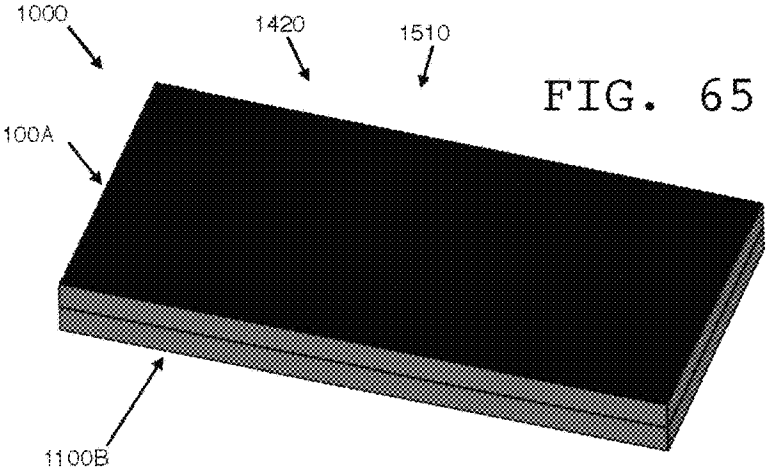

FIGS. 62-65 illustrate a process of converting the stage 1000 from an operational configuration 1400 (FIG. 62) to a portable configuration 1420 (FIG. 65). FIG. 62 shows the stage 1000 in an operational configuration 1400 with the panels 1100A,B in an open configuration 1500 and the legs 1150A-D,1190 in a support configuration 1600,1610 and extended.

FIG. 63 shows the stage 1000 in an operational configuration 1400 with the panels 1100A,B in an open configuration 1500 and the legs 1150A-D,1190 in a support configuration 1600,1610 and retracted. As discussed above, the legs 1150A-D,1190 can be retracted by unlocking the leg extension locks 1172A-D,1196 (see FIGS. 51-53) of the legs 1150A-D,1190, moving the extendable leg portions 1170A-D,1194 (see FIGS. 51-53) along the length of the leg 1150A-D,1190 to the fully retracted position, and again locking the leg extension locks 1172A-D,1196.

FIG. 64 shows the stage 1000 with the panels 1100A,B in an open configuration 1500 and the legs 1150A-D,1190 in a stowed configuration 1620,1630. As discussed above, the legs 1150A-D,1190 can be placed in the stowed configuration 1620,1630 by unlocking the leg rotation locks 1160A-D (and the central leg lock 1196) (see FIGS. 44-50) at the bases 1156A-D (see FIGS. 44-50) of the legs 1150A-D,1190, rotating the legs 1150A-D,1190 into the recesses 1124A,B (see FIG. 31) and again locking the leg rotation locks 1160A-D (see FIGS. 44-50).

FIG. 65 shows the stage 1000 in a portable configuration 1420 with the panels 1100A,B in a closed configuration 1510. As discussed above, the panels 1100A,B can be placed in a closed configuration 1510 by first unlocking the slider locks 1112 (see FIGS. 54-57 and 64) at the hinges 1110 (see FIGS. 54-57 and 64) that rotationally connect the panels 1100A,B, then rotating the panels 1100A,B until they are closed together (see FIGS. 58-61).

It should be understood that with respect to any and all of the processes described herein for converting the stage 1000 from one configuration to another, the processes shown and described for converting from one configuration to another can be followed in reverse to convert the stage back to the original configuration.

Figure 66:
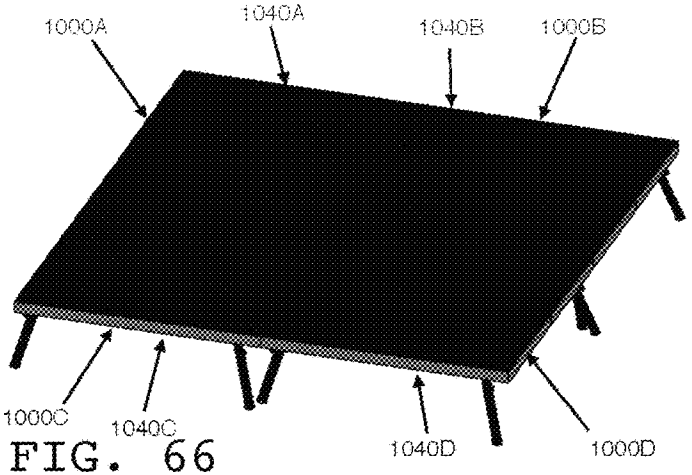
Figure 67:
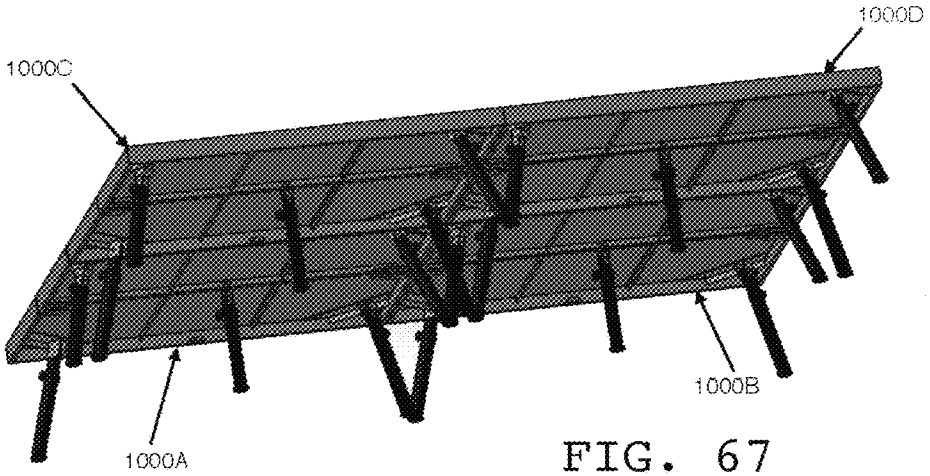
Figure 68:
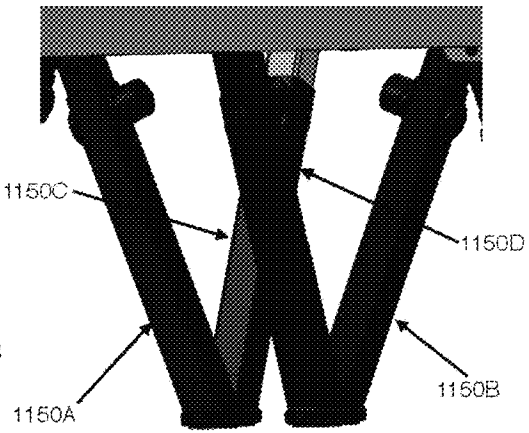
Figure 69:
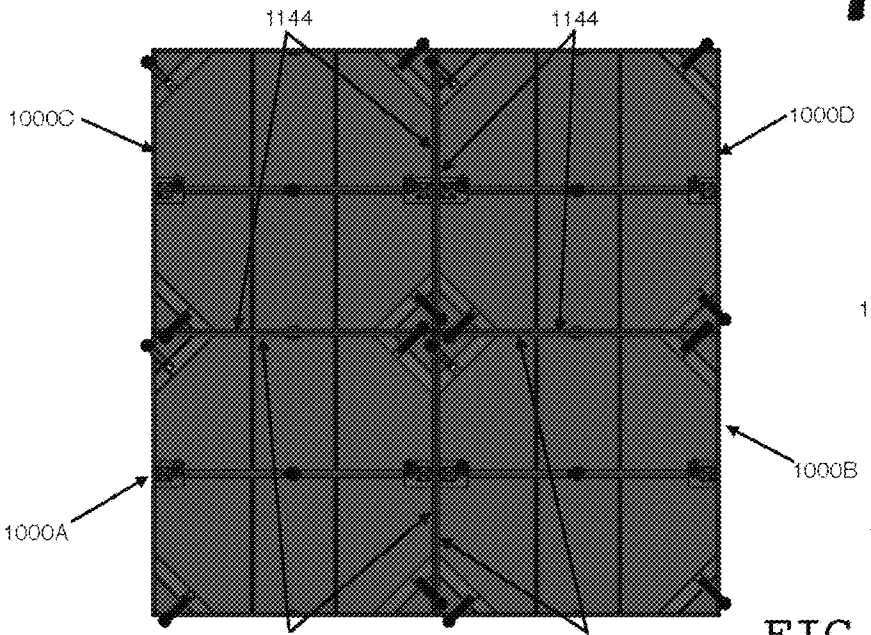
Figure 70:
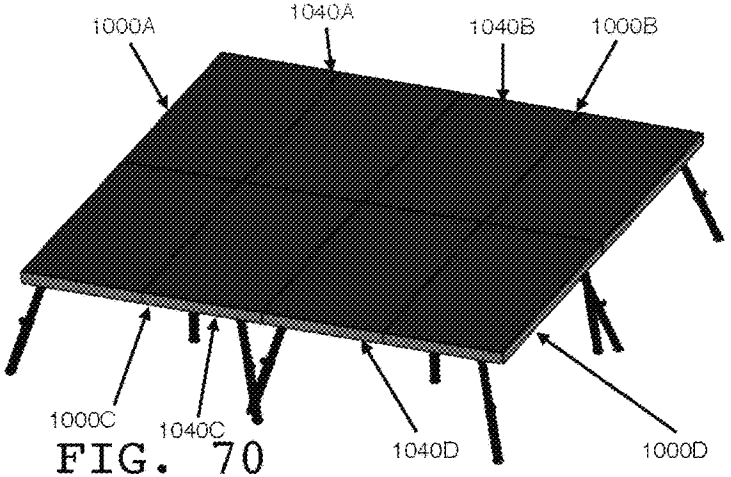
Figure 71:
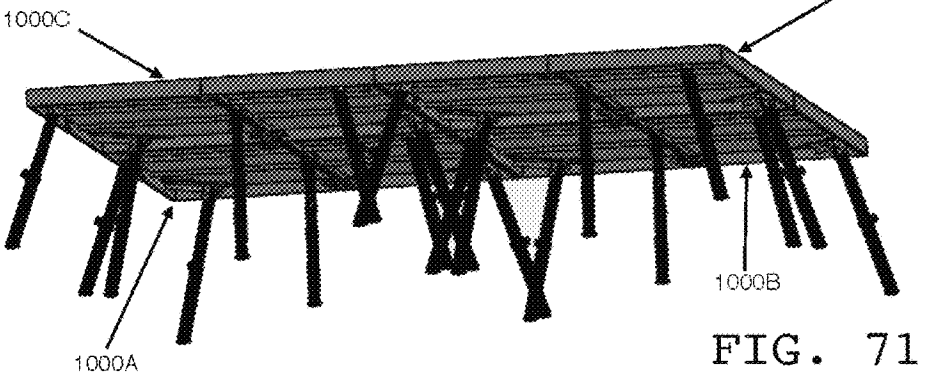
Figure 72:
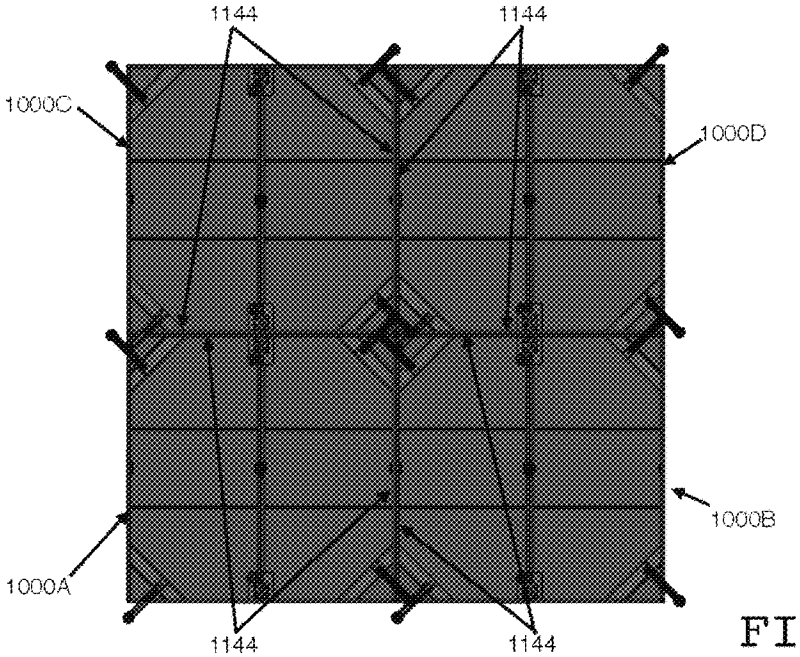
Figure 73:
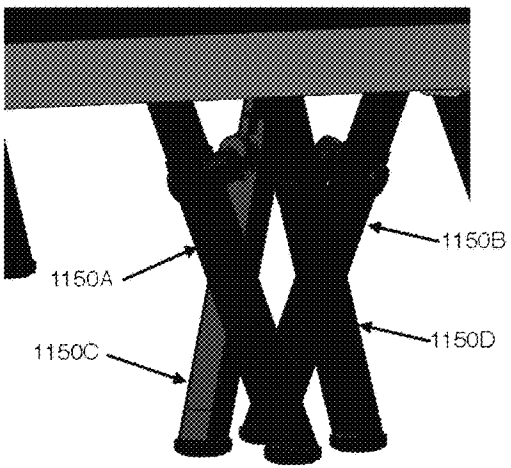

FIGS. 66-73 show four stages 1000A-D, each being of the second preferred embodiment of the stage 1000, adjacent one another to form a combined larger platform from the platforms 1040A-D, each of the stages 1000A-D being in an operational configuration 1400 (see FIGS. 26-31) in which the panels 1100A,B (see FIGS. 26-31) of each are in an open configuration 1500 (see FIGS. 26-31) and the legs 1150A-D,1190 (see FIGS. 26-31) of each are in a support configuration 1600,1610 (see FIGS. 26-31). In FIGS. 66-69 the legs 1150A-D,1190 are retracted. In FIGS. 70-73 the legs 1150A-D,1190 are extended. Certain sides 1144 of the stages 1000A-D are positioned flush against one another. Legs 1150 of adjacent stages extend underneath the platforms of the adjacent stages but do not interfere with the legs 1150 of the adjacent stages due to being asymmetrically positioned on the bottom sides 1120A,B (see FIGS. 26-31) of the panels 1100A,B (see FIGS. 26-31). FIG. 69 illustrates a close-up view of the configuration of the legs 1150A-D (one from each stage) at the center of the group of stages shown in FIGS. 66-68, showing the non-interference of the legs 1150A-D (one from each stage). FIG. 73 illustrates a close-up view of the configuration of the legs 1150A-D (one from each stage) at the center of the group of stages shown in FIGS. 70-72, showing the non-interference of the legs 1150A-D (one from each stage).

FIGS. 74-97 show a third preferred embodiment of a stage 1000 of the present invention. Elements of the third preferred embodiment of the stage 1000 corresponding to elements of the other preferred embodiments of the stage 1000 discussed herein have the same or similar features, unless otherwise discussed, and nevertheless, constitute additional and/or alternative features of such corresponding elements as to the other preferred embodiments of the stage 1000 discussed herein. Accordingly, such corresponding elements use the same or similarly indicative element numbers.

Figure 76:
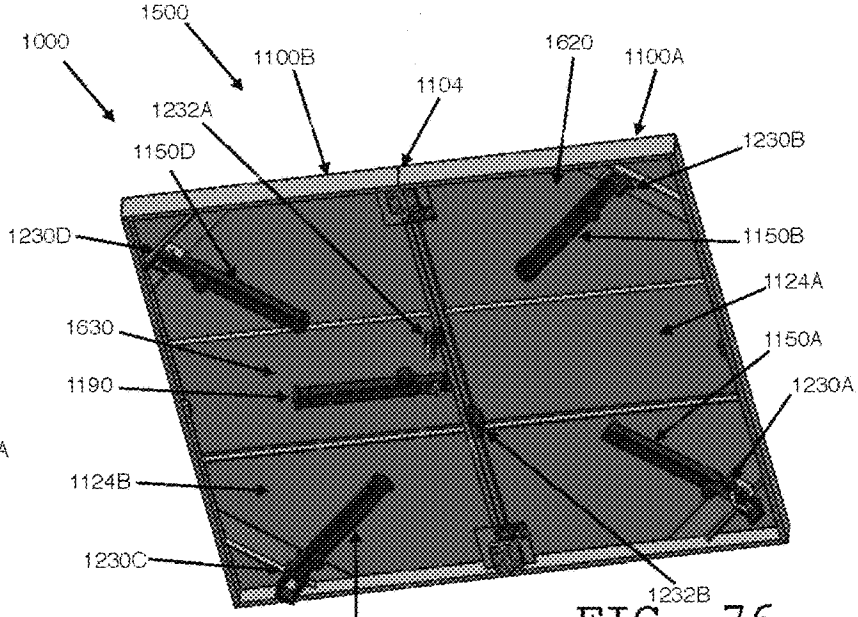
Figure 74:
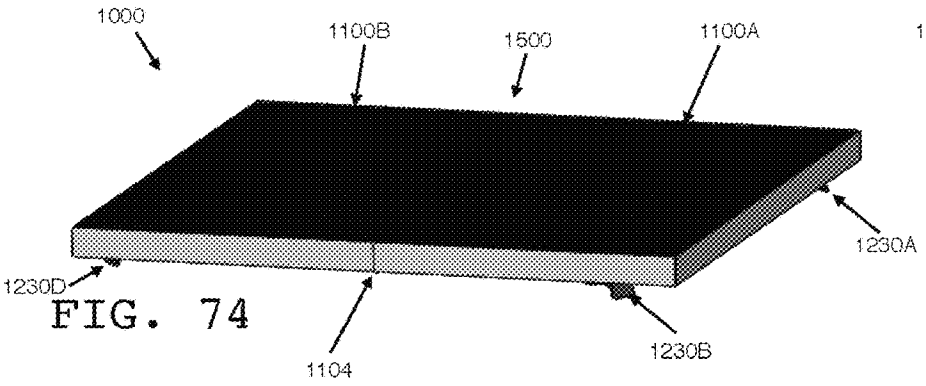
Figure 75:
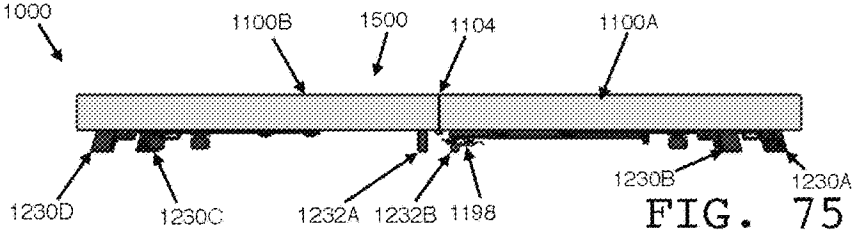

FIGS. 74-76 show the stage 1000 in top perspective (FIG. 74), side (FIG. 75) and bottom perspective (FIG. 76) views, illustrating supports 1230A-D and central supports 1232A,B that enable the stage 1000 to be used (for example, to elevate the platform 1040 above a surface 1300 upon which the stage 1000 is placed) when the legs 1150A-D,1190 are folded in the stowed configuration 1620,1630.

FIGS. 74-76 show the stage 1000 in a collapsed operational configuration 1410 in which the panels 1100A,B are in an open configuration 1400 and the legs are in a stowed configuration 1620,1630. In this collapsed operational configuration 1410, the stage 1000 can be used but is low to the surface on which it is placed, in that it is supported by and elevated above the surface by the supports 1230A-D, 1232A,B when the legs 1150A-D,1190 are in the stowed configuration 1620,1630. The supports 1230A-D are part of or attached to the bases 1156A-D of the legs 1150A-D, and extend outside the recesses 1124A,B of the panels 1100A,B. The central supports 1232A,B are part of or attached to the frames 116A,B near the midline 1104 between the panels 1100A,B and also extend outside the recesses 1124A,B of the panels 1100A,B. However, as described below, the supports 1230A-D,1232A,B are sized to fit within the enclosure 1126 formed by the recesses 1124A,B when the panels 1100A,B are in a closed configuration 1510 (see FIGS. 77-79).

Figure 78:
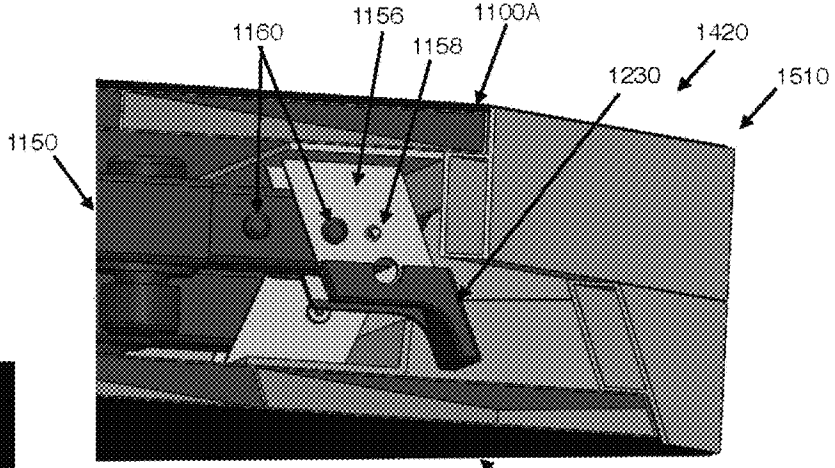
Figure 79:
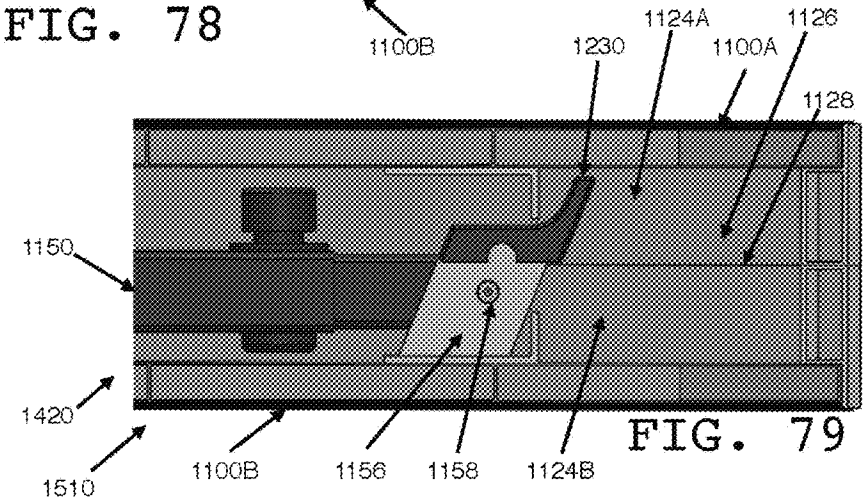
Figure 77:
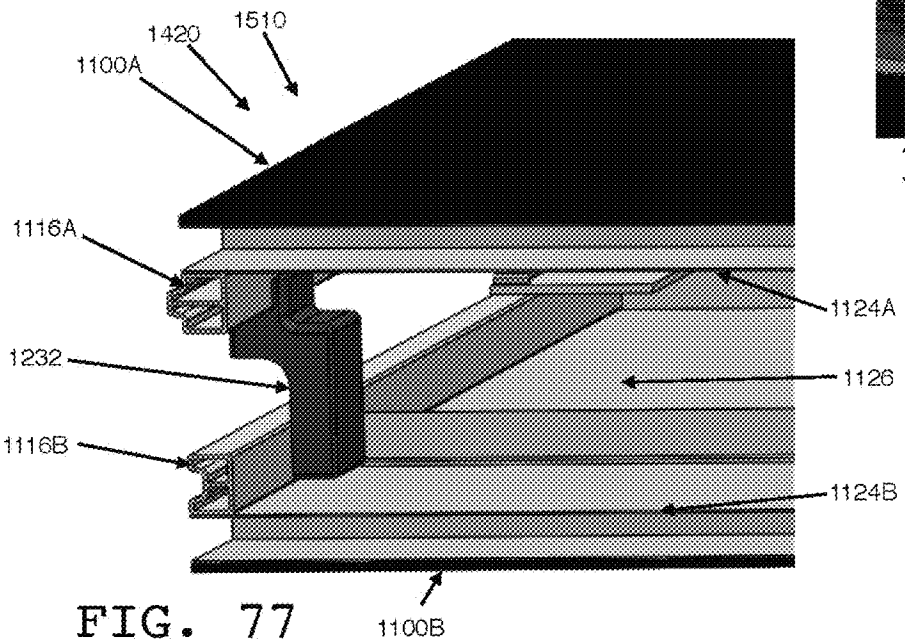
Figure 82:
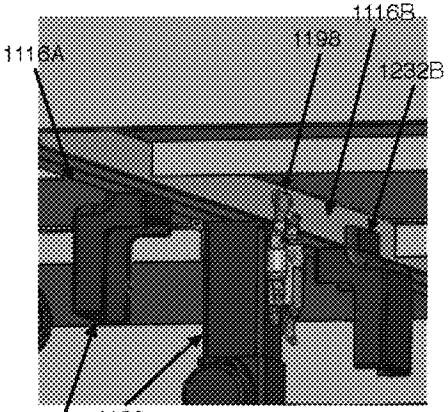
Figure 81:
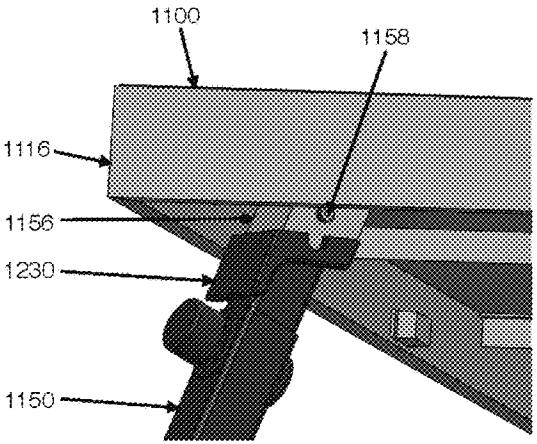

FIGS. 77-79 show the stage 1000 in a close-up cutaway view of a central support 1232 (FIG. 77), a close-up perspective cutaway view of a support 1230 (FIG. 78), and a close-up side cutaway view of a support 1230 (FIG. 79), illustrating the supports' 1230A-D,1232A,B non-interference with the conversion of the stage 1000 into a portable configuration 1420 in which the panels 1100A,B are in a closed configuration 1510. As shown in FIGS. 77-79, each central support 1232 is attached to a frame (in FIG. 77, frame 1116A), and each support 1230 is part of or attached to a base 1156 of a leg 1150. All of the supports 1230,1232 are larger in height than the recess 1124A of the panel 1100A, but not larger in height than the enclosure 1126 formed by the recesses 1124A,B when the panels 1100A,B are in a closed configuration 1510.

Figure 84:
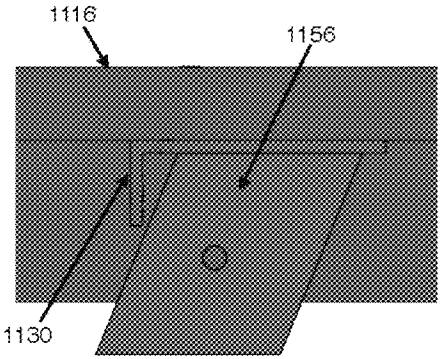
Figure 83:
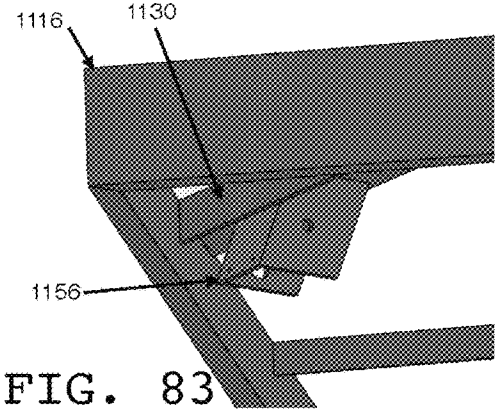
Figure 80:
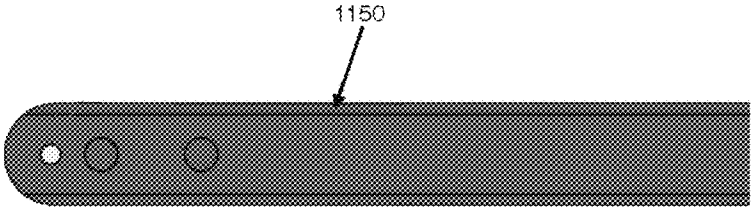

FIGS. 80-84 show the stage 1000 in a component view of a leg 1150 (FIG. 80), a close-up perspective view of a support 1230 as part of or attached to a base 1156, of a leg 1150, that is attached to a frame 1116 of a panel 1100 (FIG. 81), and a close-up perspective view of central supports 1232A,B attached to frames 1116A,B of the stage 1000 near a central leg 1190 (FIG. 82), illustrating the positions of the supports 1230,1232. FIGS. 83 and 84 show close-up perspective (FIG. 83) and close-up side (FIG. 84) views of a corner brace 1130 of a frame 1116 of the stage 1000, illustrating features of the frame 1116 that accommodate the corner brace 1130 and the base 1156 of the leg 1150.

Figure 85:
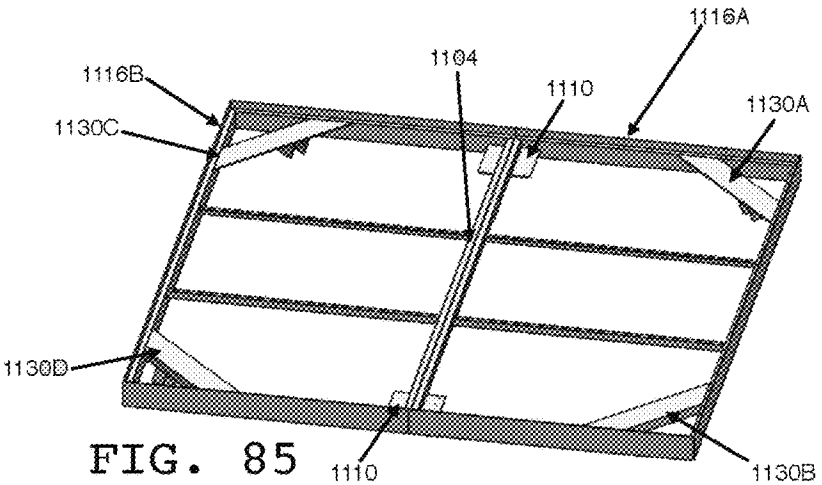
Figure 88:
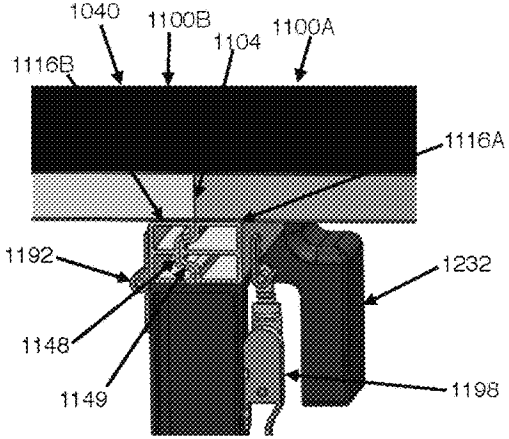
Figures 86, 87:
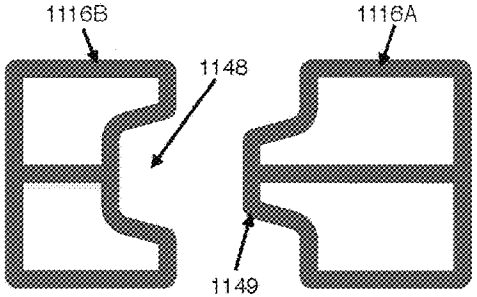
Figures 89, 90:
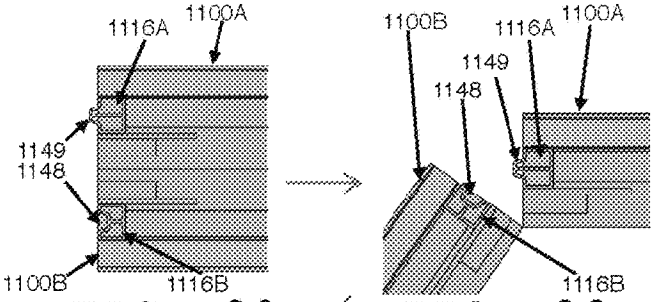
Figures 91, 92:
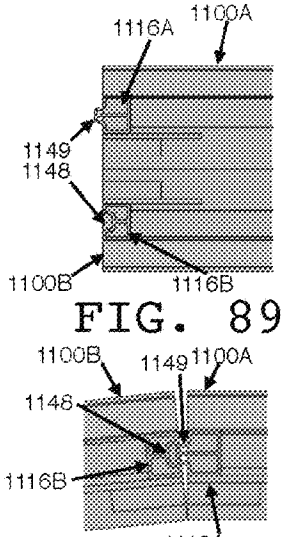

FIG. 85 shows the stage 1000 in a component top perspective view of frames 1116A,B of the stage 1000 (FIG. 85) in which the corner braces 1130A-D are visible along with the hinges 1110 along the midline 1104 where the frames 1116A,B fold. FIGS. 86 and 87 show cross-section views of frame 1116B (FIG. 86) and frame 1116A (FIG. 87), illustrating a channel 1148 on frame 1116B and a cooperating protrusion 1149 on frame 1116A. As illustrated in FIG. 88, when the panels 1100A,B are in an open configuration 1510 such that the frames 1116A,B are joined at the midline 1104, the protrusion 1149 fits within the channel 1148 and accordingly, the fit of the channel 1148 and protrusion 1149 enhance the support and stability of the platform 1040 at the midline 1104 when a weight is placed on the platform 1040. FIGS. 89-92 illustrate the joining of the channel 1148 and protrusion 1149 as the panels 1100A,B are brought together when the panels 1100A,B are rotated at the hinges 1110 (not shown) to be moved from the closed configuration 1510 (FIG. 89) to a partially open configuration (FIG. 90), to an almost open configuration (FIG. 91) to the open configuration 1500 (FIG. 92).

FIG. 93 shows a component close-up perspective view of a foot 1200 of a leg 1150,1190 of the stage 1000, illustrating a foot pad 1210 on the foot 1200 and a pad 1212 on the foot pad 1210. The foot pads 1210 can be made of different materials and be interchangeable to, for example, accordingly accommodate different traction requirements for different surfaces. FIG. 94 shows a component view of pads 1212 suitable for attachment to a foot pad 1210 of the foot 1200.

FIG. 95 shows a bottom perspective view of two stages 1000A,B, each being of the third preferred embodiment of the stage 1000, adjacent one another to form a combined larger platform from the platforms 1040A,B, each of the stages 1000A,B being in an operational configuration 1400 in which the panels 1100A,B of each are in an open configuration 1500 and the legs 1150A-D,1190 of each are in a support configuration 1600. Certain sides 1144 of the stages 1000A,B are positioned flush against one another. Legs 1150 of adjacent stages extend underneath the platforms of the adjacent stages but do not interfere with the legs 1150 of the adjacent stages due to being asymmetrically positioned on the bottom sides 1120A,B of the panels 1100A,B. FIGS. 96-97 show component views of connection devices such as clamps 1700A,B for holding the stages 1000A,B together at desired points of connection (FIGS. 96-97).

FIGS. 98-122 show a fourth preferred embodiment of a stage 1000 of the present invention. Elements of the fourth preferred embodiment of the stage 1000 corresponding to elements of the other preferred embodiments of the stage 1000 discussed herein have the same or similar features, unless otherwise discussed, and nevertheless, constitute additional and/or alternative features of such corresponding elements as to the other preferred embodiments of the stage 1000 discussed herein. Accordingly, such corresponding elements use the same or similarly indicative element numbers.

Figure 99:
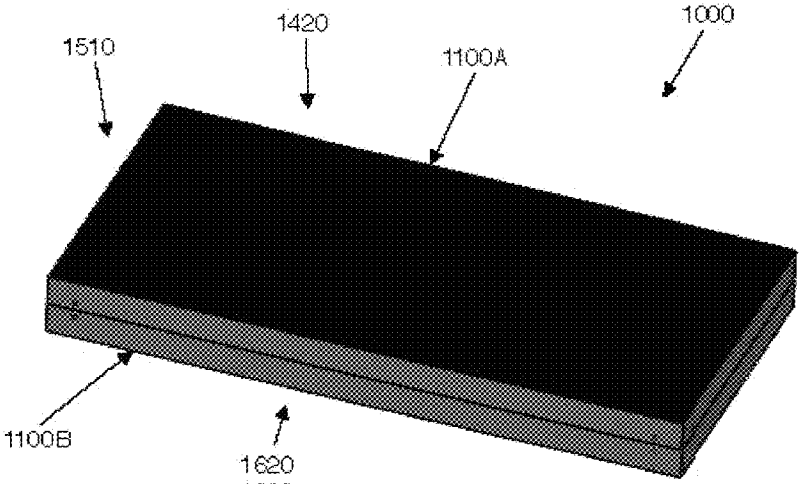
Figure 98:
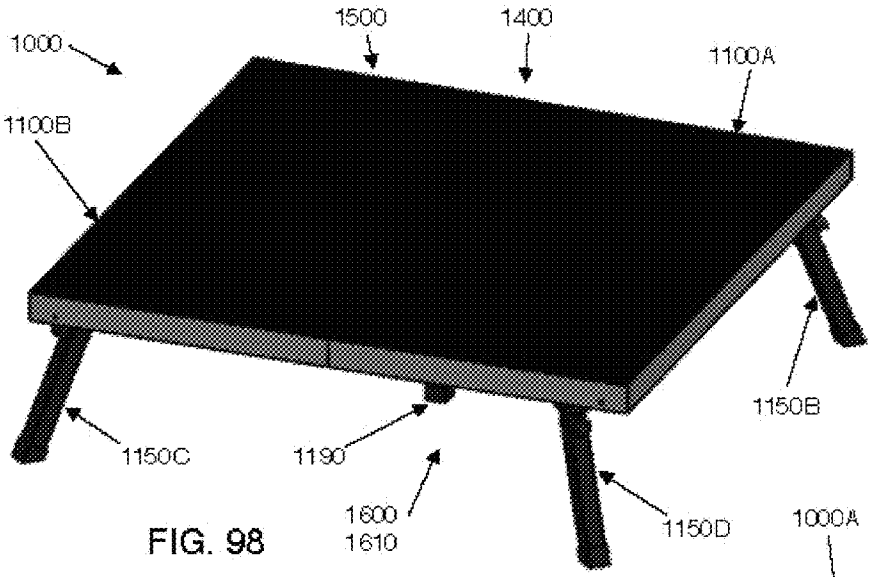
Figure 100:
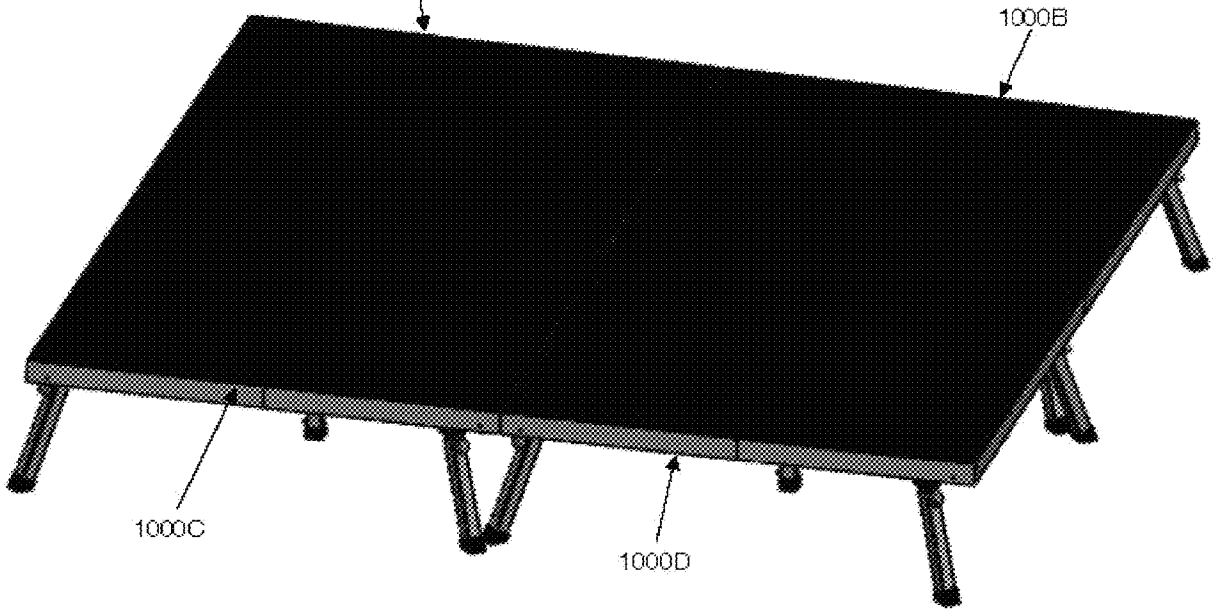

FIG. 98 shows the stage 1000 in a perspective view in an operational configuration 1400 in which the panels 1100A,B are in an open configuration 1500 and the legs 1150A-D, 1190 are in a support configuration 1600,1610 and retracted. FIG. 99 shows the stage 1000 in a perspective view in a portable configuration 1420 in which the panels 1100A,B are in a closed configuration 1510 and the legs 1150A-D, 1190 are in a stowed configuration 1620,1630. FIG. 100 shows a top perspective view of four stages 1000A-D, each being of the fourth preferred embodiment of the stage 1000, adjacent one another to form a combined larger platform from the platforms 1040A-D, each of the stages 1000A-D being in an operational configuration 1400 in which the panels 1100A,B of each are in an open configuration 1500 and the legs 1150A-D,1190 of each are in a support configuration 1600. Certain sides 1144 of the stages 1000A-D are positioned flush against one another. Legs 1150 of adjacent stages extend underneath the platforms of the adjacent stages but do not interfere with the legs 1150 of the adjacent stages due to being asymmetrically positioned on the bottom sides 1120A,B of the panels 1100A,B.

FIG. 101 shows the stage 1000 in a perspective view in an operational configuration 1400 in which the panels 1100A,B are in an open configuration 1500 and the legs 1150A-D, 1190 are in a support configuration 1600,1610 and extended. FIG. 102 shows the stage 1000 in a perspective view in an operational configuration 1400 in which the panels 1100A,B are in an open configuration 1500 and the legs 1150A-D, 1190 are in a support configuration 1600,1610 and retracted. FIG. 103 shows the stage 1000 in a perspective view in a collapsed operational configuration 1410 in which the panels 1100A,B are in an open configuration 1500 and the legs 1150A-D,1190 are in a stowed configuration 1620,1630. The supports 1230A-D (supports 1230A-B are not visible here) are shorter than the supports 1230A-D of the third preferred embodiment of the stage 1000.

Figure 105:
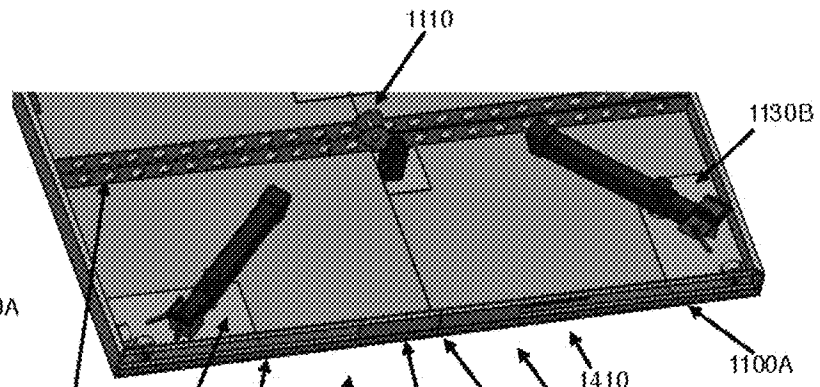
Figure 107:
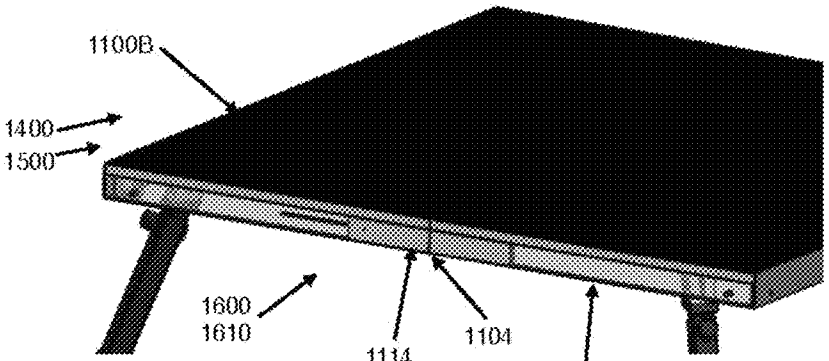
Figure 104:
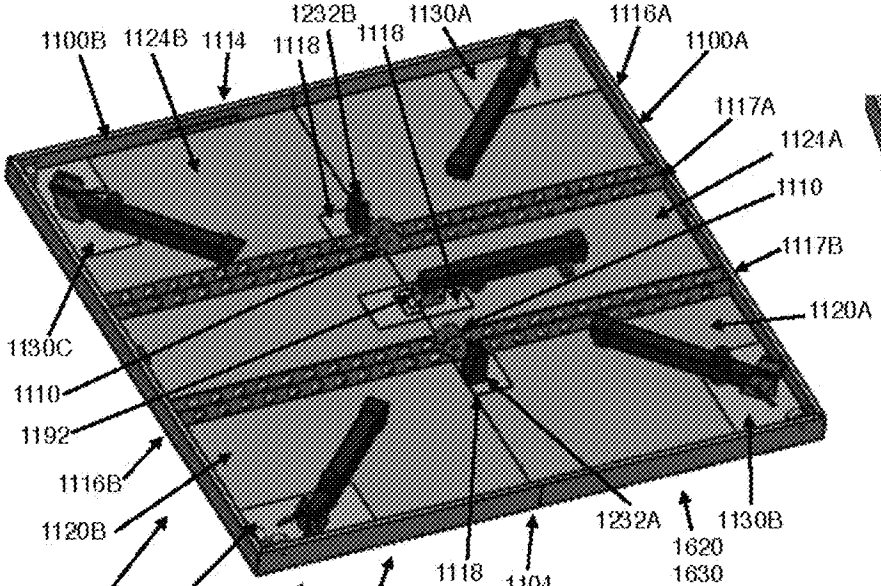
Figure 106:
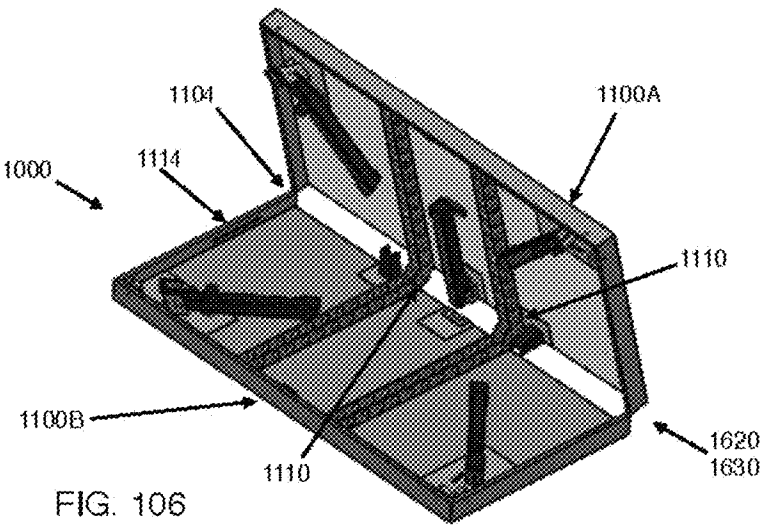

FIGS. 104-105 shows the stage 1000 in a bottom perspective view (FIG. 104) and a partial bottom perspective view (FIG. 105), in both views in a collapsed operational configuration 1410 in which the panels 1100A,B are in an open configuration 1500 and the legs 1150A-D,1190 are in a stowed configuration 1620,1630. FIG. 106 shows the stage 1000 in a bottom perspective view in a configuration in which the panels 1100A,B are in a partially closed configuration and the legs 1150A-D,1190 are in a stowed configuration 1620,1630. FIG. 107 shows the stage 1000 in a partial perspective view in an operational configuration 1400 in which the panels 1100A,B are in an open configuration 1500 and the legs 1150A-D,1190 are in a support configuration 1600,1610.

In this embodiment, certain ribs 1117A,B of the frames 1116A,B have a structure that minimizes material while retaining support strength characteristics (for example, the ribs 1117A,B have holes that do not compromise the structural strength of the ribs 1117A,B). In this embodiment, the corner braces 1130A-D are flat and the hinges 1110 are located on the ribs 1117A,B. Also in this embodiment, the central leg hinge 1192 and the central supports 1232A,B are located on support panels 1118 so that, for example, less material is required for the frames 1116A,B.

Figure 104A:
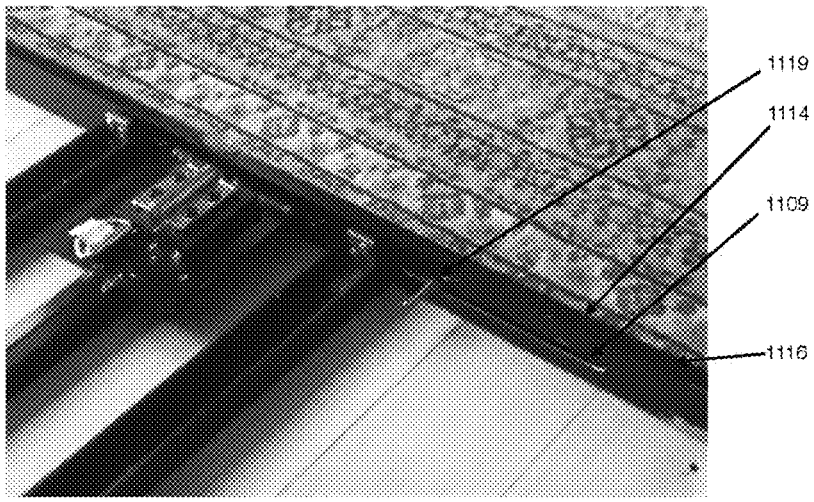
FIGS. 104A-C illustrate the locking slide beam in perspective detail views.
Figure 104B:
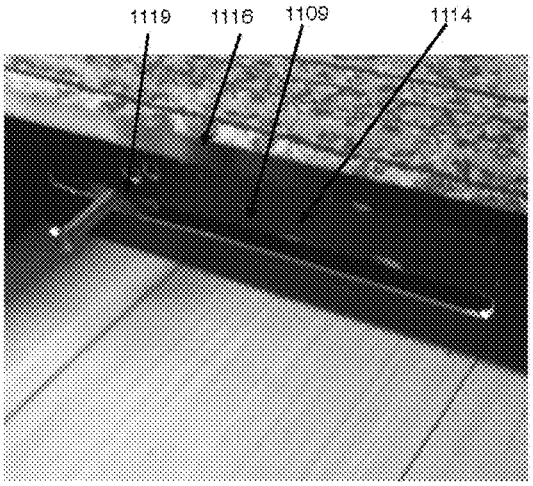
Figure 104C:
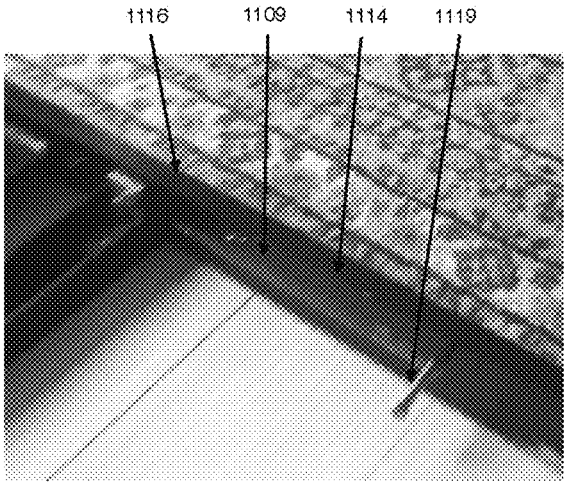

Also in this embodiment, the panels 1100A,B can be locked in the open configuration 1500 and unlocked to allow conversion of the panels into the closed configuration 1510, by moving locking slide beams 1114, which in an unlocked position (see FIG. 106) do not interfere with the folding and unfolding of the panels 1100A,B and therefore allow the panels 1100A,B to be folded and unfolded, and in a locked position (see FIGS. 104, 105 and 107) block the folding and unfolding of the panels 1100A,B and therefore prevent the panels 1100A,B from being folded and unfolded. The locking slide beams 1114 are moved between the locked and unlocked states by sliding the locking slide beams 1114 to straddle (or cover) the midline 1104 of the panels 1100A,B (locked, see FIG. 107) or avoid (or uncover) the midline 1104 of the panels 1100A,B (unlocked, see FIG. 106). As illustrated in greater detail in FIGS. 104A-C, the locking slide beam 1114 fits within the frame 1116, and has a control rod 1119 extending from an elongated slot 1109 in the frame 1116, and the control rod 1119 can be moved along the slot 1109 to move the locking slide beam 1114 into the lock position (at one end of the slot 1109, see FIGS. 104A,B) and the unlocked position (at the other end of the slot 1109, see FIG. 104C). The control rod 1119 can be rotated with a set screw or similar mechanism to secure the locking slide beam 1114 at each of the positions.

Figure 108:
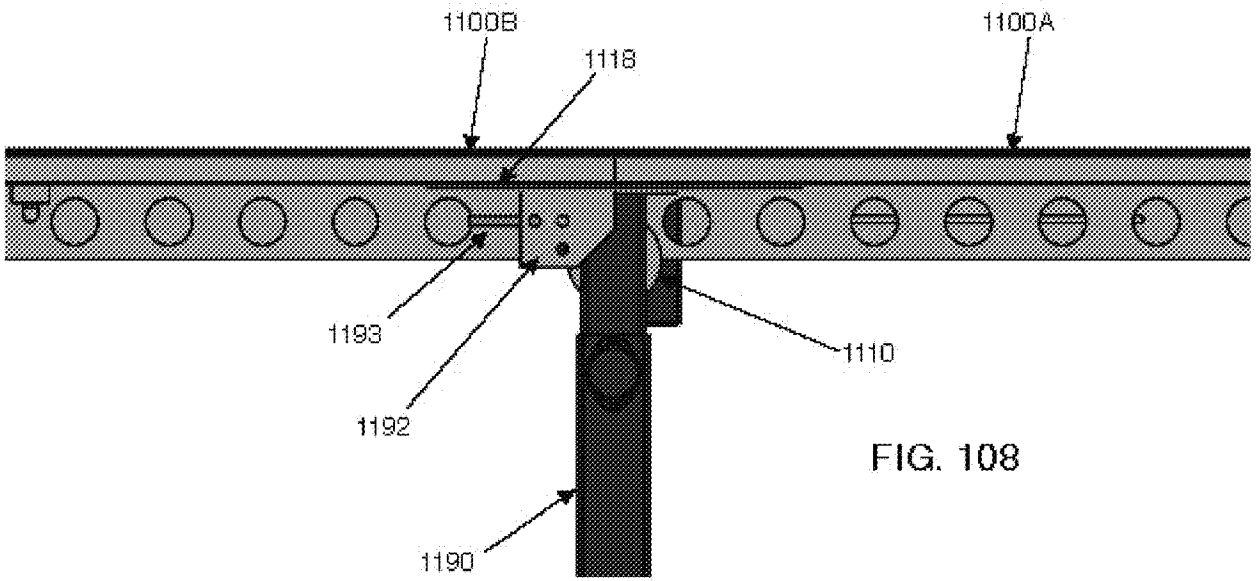
Figure 109:
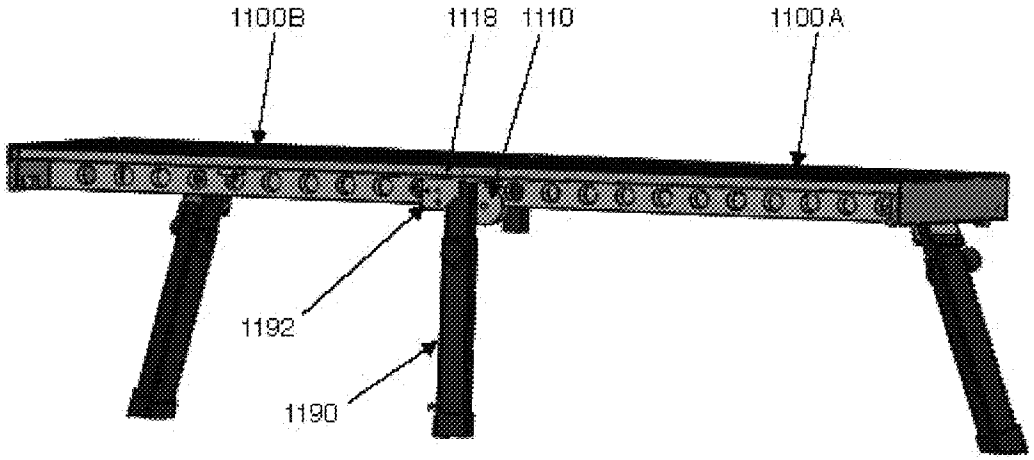

FIGS. 108-109 show the stage 1000 in partial side (FIG. 108) and side cutaway (FIG. 109) views illustrating an additional or alternate central leg 1190 design. In this embodiment, the central leg 1190 has a rotational connection or hinge 1192 that is attached to a support panel 1118 on the bottom side 1120 of the panel 1100B. A lever 1193 can be moved to lock and unlock the leg 1190 to allow rotation of the leg 1190 from a support configuration 1610 to a stowed configuration 1630.

Figure 110:
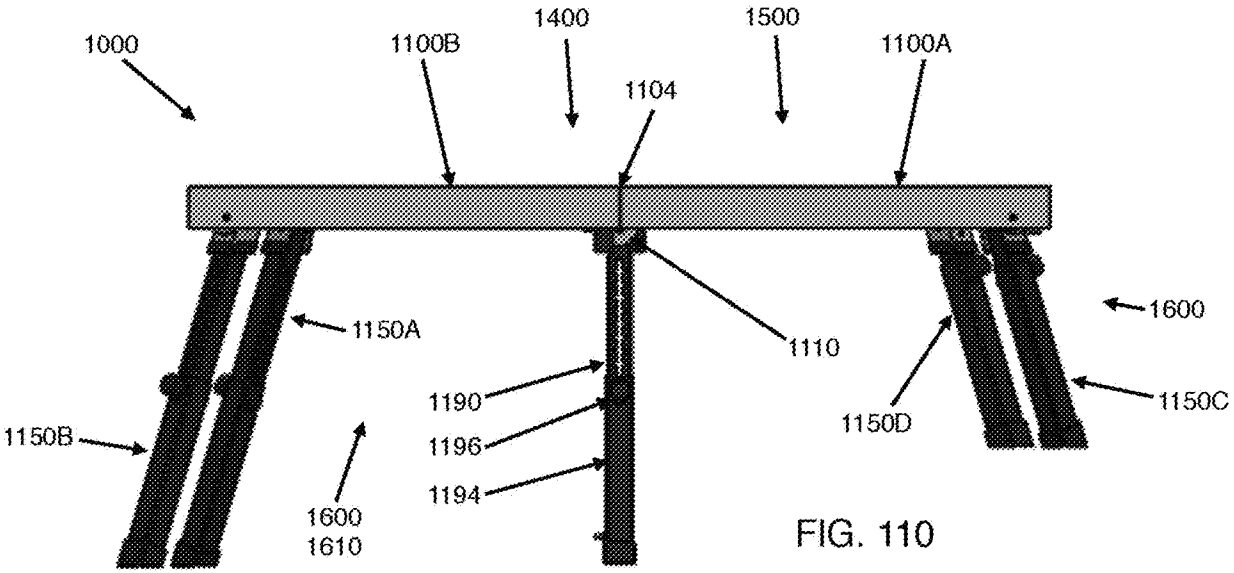
Figure 112:
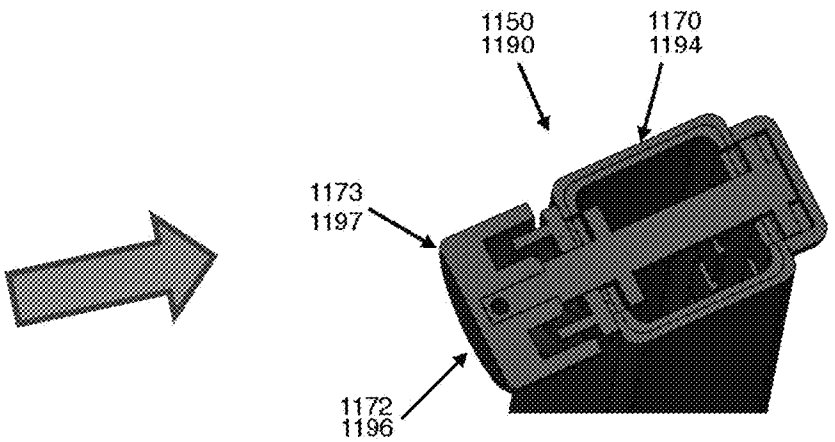
Figure 111:
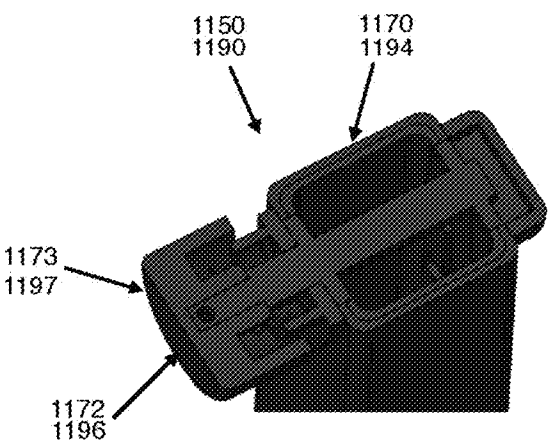

FIGS. 110-112 illustrate a leg extension lock design. FIG. 110 shows a side view of the stage 1000 in an operational configuration 1400, with the panels 1100A,B in an open configuration 1500, legs 1150A,B,1190 in a support configuration 1600,1610 and extended, and legs 1150C,D in a support configuration 1600 and retracted. The legs 1150A,B,1190 are adjustable by unlocking the leg extension lock 1172A-D,1196 and moving the extendable leg portion 1170A-D,1194 along the length of the leg 1150A-D,1190 until a desired length is reached, and then locking the leg extension lock 1172A-D,1196. FIGS. 111 and 112 show cutaway component views of the leg extension lock 1172, 1196, in a locked configuration (FIG. 52) and an unlocked configuration (FIG. 53). The leg extension lock 1172,1196 is biased in the locked configuration, and can be placed in the unlocked configuration by pressing on a button 1173,1197 of the leg extension lock 1172,1196, which pushes the blocking components of the leg extension lock 1172,1196 away from the non-moving part of the leg 1150,1190 to allow the extendable leg portion 1170,1194 to move along the length of the non-moving part of the leg 1150,1190. Once the extendable leg portion 1170,1194 is at the desired location, the button 1173,1197 can be released to release the blocking components of the leg extension lock 1172,1196 to move back to their blocking configuration.

Figure 113:
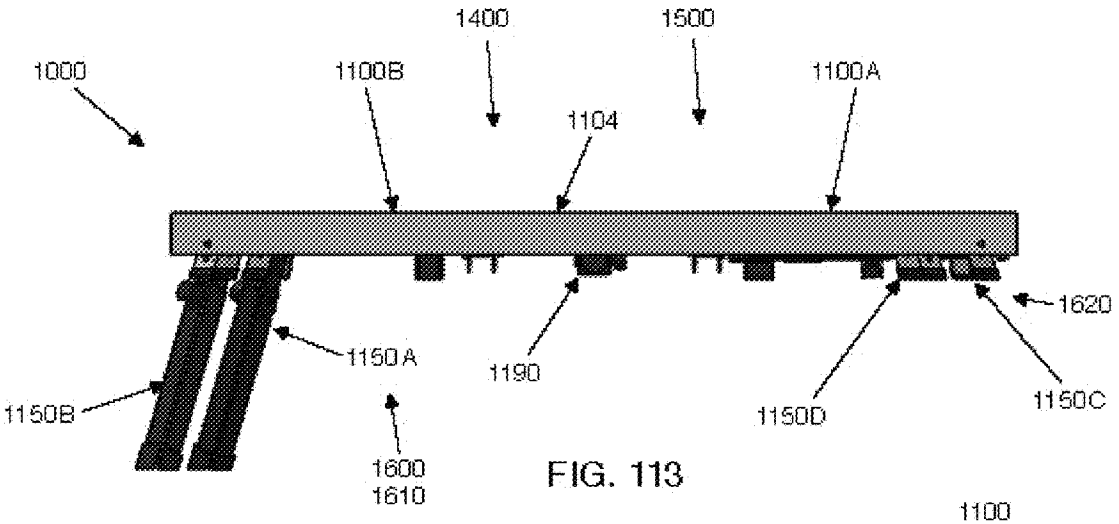
Figure 114:
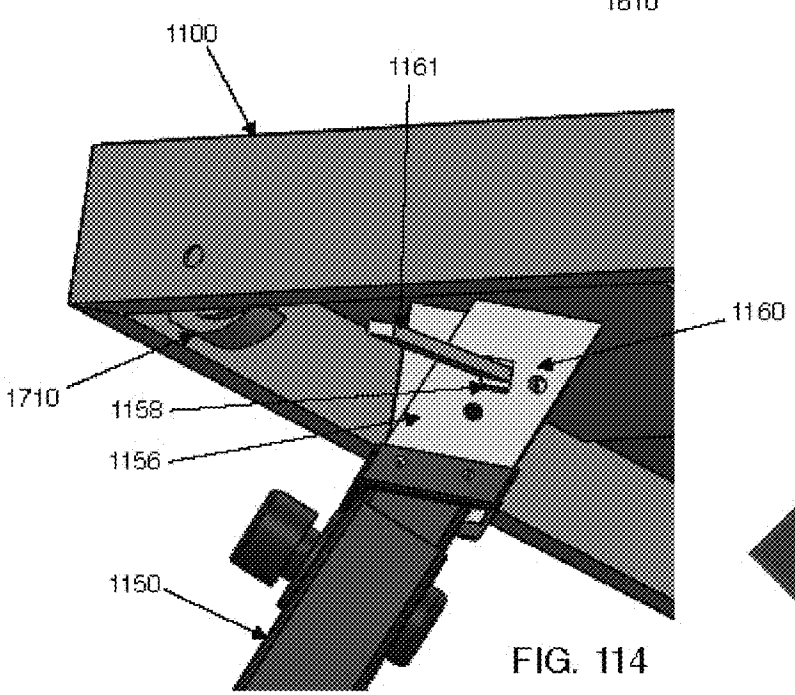
Figure 115:
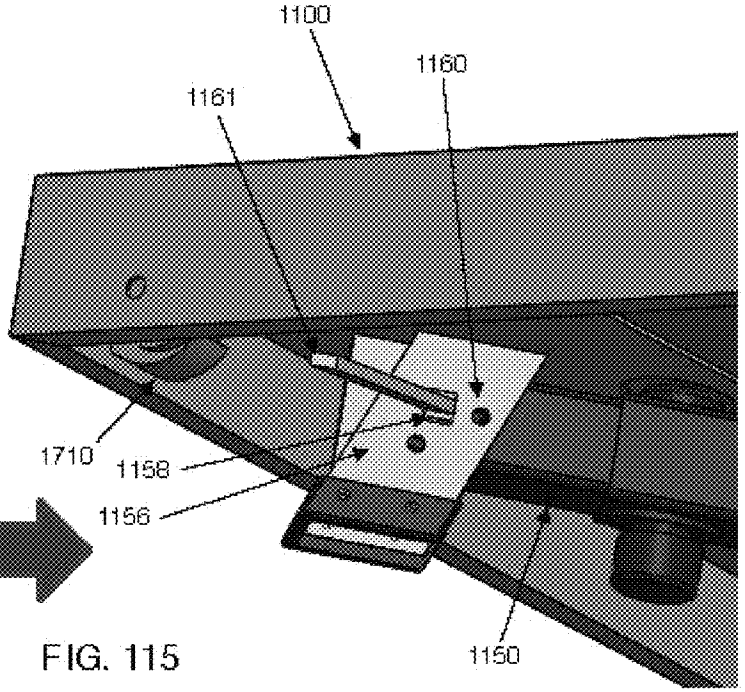

FIGS. 113-115 show the stage 1000, illustrating an additional or alternate leg rotation lock design. FIG. 113 shows a side view of the stage 1000, with the panels 1100A,B in an open configuration 1500, legs 1150A,B,1190 in a support configuration 1600,1610, and legs 1150C,D in a stowed configuration 1620. FIGS. 113-115 illustrate that the legs 1150 are rotatable about a center of rotation 1158 at the base 1156 of the leg 1150, and can be locked in the stowed configuration 1620 and in the support configuration 1600 by a leg rotation lock 1160. In the illustrated mechanism, the leg rotation lock 1160 includes a lever 1161 that can be moved to lock the leg 1150 in either the support (for example, unfolded) configuration 1600 (FIG. 114) or the stowed (for example, folded) configuration 1620 (FIG. 115), and moved back to unlock the leg 1150 to allow the leg 1150 to be rotated, about the center of rotation 1158, between the configurations. The leg rotation lock 1160 by the lever 1161 compressing (to lock) and releasing (to unlock) the leg 1150 and base 1156 between components of the leg rotation lock 1160. Also shown in FIGS. 113-115 is a clamp and pin feature 1710 for securing one stage 1000 to another.

Figure 117:
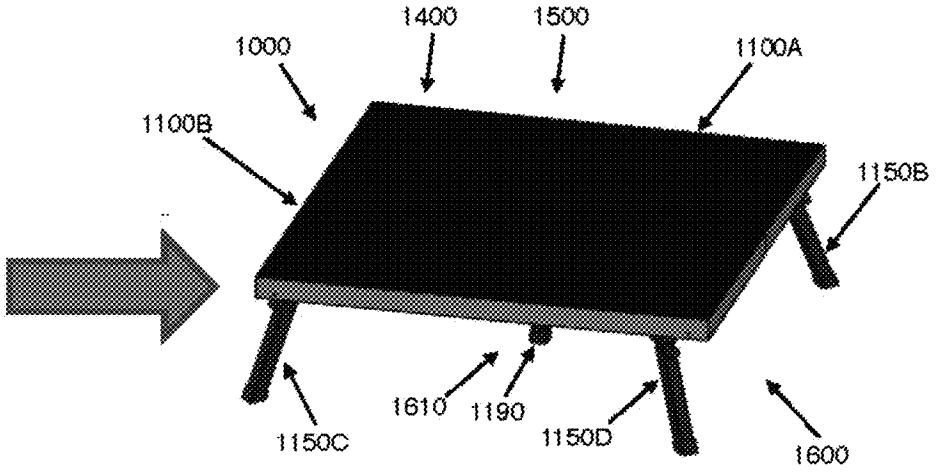
Figure 118:
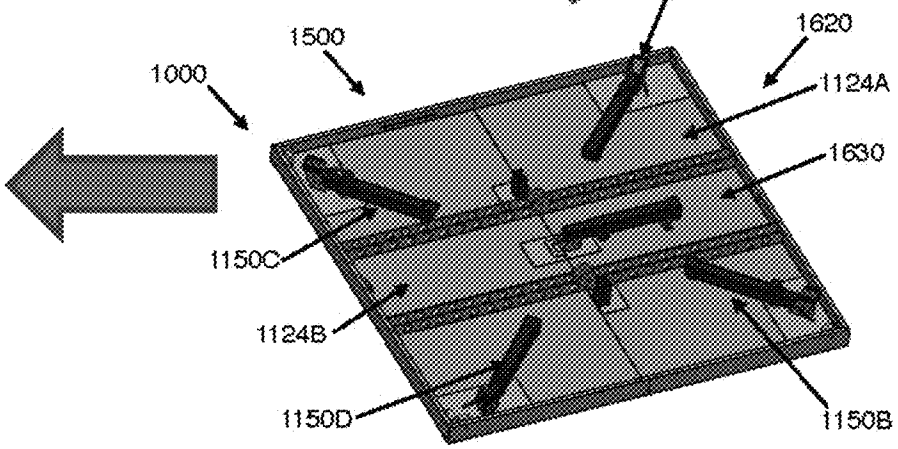
Figure 116:
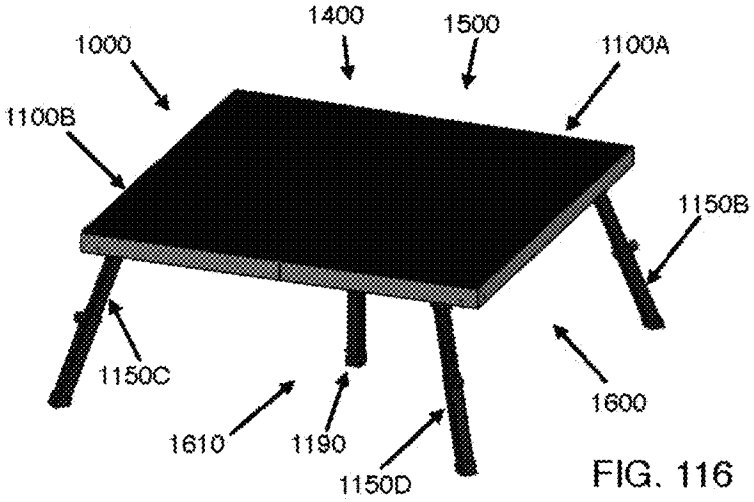

FIGS. 116-119 illustrate in perspective views a process of converting the stage 1000 from an operational configuration 1400 (FIG. 116) to a portable configuration 1420 (FIG. 118). FIG. 116 shows the stage 1000 in an operational configuration 1400 with the panels 1100A,B in an open configuration 1500 and the legs 1150A-D,1190 in a support configuration 1600,1610 and extended.

FIG. 117 shows the stage 1000 in an operational configuration 1400 with the panels 1100A,B in an open configuration 1500 and the legs 1150A-D,1190 in a support configuration 1600,1610 and retracted. As discussed above, the legs 1150A-D,1190 can be retracted by unlocking the leg extension locks 1172A-D,1196 (see FIGS. 110-112) of the legs 1150A-D,1190, moving the extendable leg portions 1170A-D,1194 (see FIGS. 110-112) to the fully retracted position, and again locking the leg extension locks 1172A-D,1196.

FIG. 118 shows the stage 1000 with the panels 1100A,B in an open configuration 1500 and the legs 1150A-D,1190 in a stowed configuration 1620,1630. As discussed above, the legs 1150A-D,1190 can be placed in the stowed configuration 1620,1630 by unlocking the leg rotation locks 1160A-D (and the central leg lock 1196) (see FIGS. 108-109, 113-115) at the bases 1156A-D (see FIGS. 108-109, 113-115) of the legs 1150A-D,1190, rotating the legs 1150A-D,1190 into the recesses 1124A,B (see also FIG. 104) and again locking the leg rotation locks 1160A-D (see FIGS. 108-109, 113-115).

Figure 119:
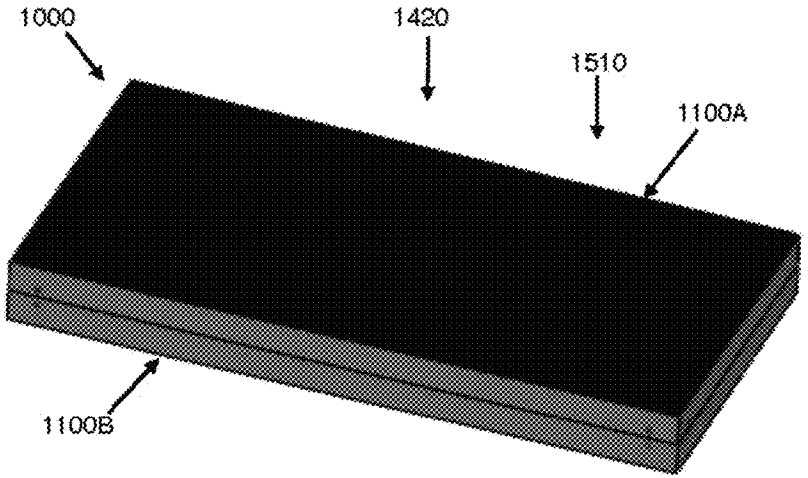

FIG. 119 shows the stage 1000 in a portable configuration 1420 with the panels 1100A,B in a closed configuration 1510. As discussed above, the panels 1100A,B can be placed in a closed configuration 1510 by first unlocking the locking slide beams (see FIGS. 104-107) then rotating the panels 1100A,B by the hinges 1110 (see FIGS. 104-107) until they are closed together.

Figure 122:
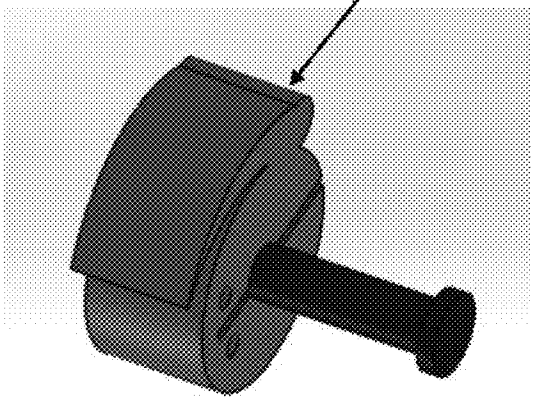
Figure 120:
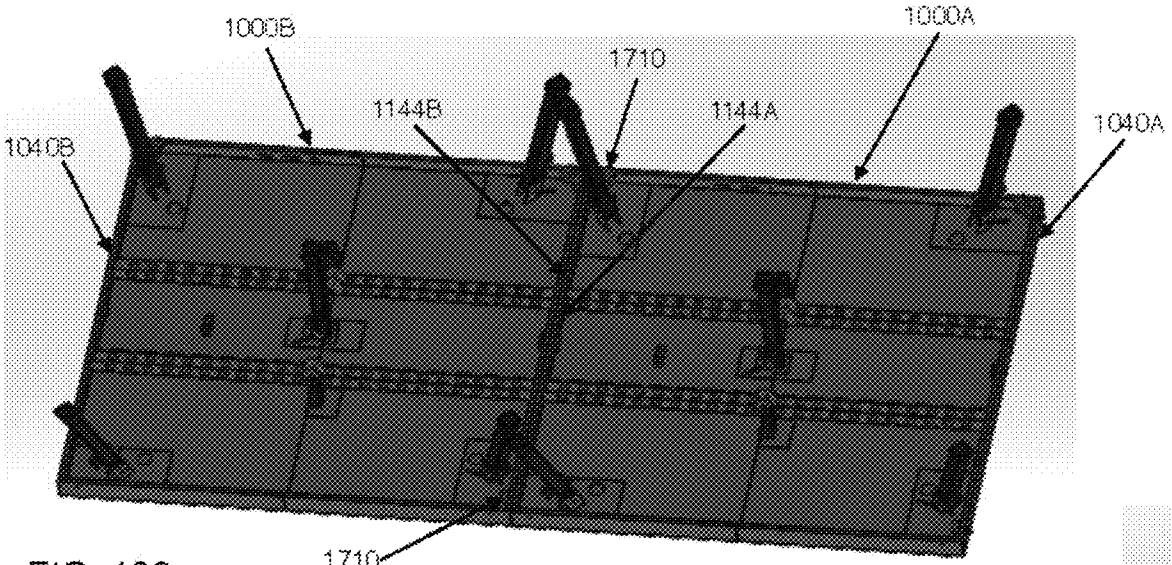
Figure 121:
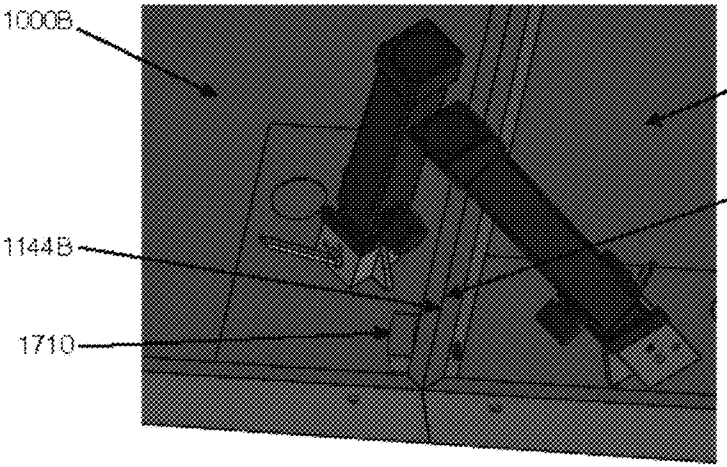

FIGS. 120-121 show bottom perspective views of two stages 1000A,B, each being of the fourth preferred embodiment of the stage 1000, adjacent one another to form a combined larger platform from the platforms 1040A,B, each of the stages 1000A,B being in an operational configuration 1400 (see FIG. 98) in which the panels 1100A,B (see FIG. 98) of each are in an open configuration 1500 (see FIG. 98) and the legs 1150A-D,1190 (see FIG. 98) of each are in a support configuration 1600,1610 (see FIG. 98). In FIGS. 120-121 the legs 1150,1190 are retracted. Certain sides 1144A,B of the stages 1000A,B are positioned flush against one another. Legs 1150 of each adjacent stage extend underneath the platform of the other stage but do not interfere with the legs 1150 of the other stage due to being asymmetrically positioned on the bottom sides 1120A,B (see FIG. 104) of the panels 1100A,B (see FIG. 104). FIG. 121 illustrates a close-up view of the configuration of the legs 1150 (one from each stage) at the meeting point of the stages shown in FIG. 120, showing the non-interference of the legs 1150 (one from each stage). FIG. 122 shows a detail of a clamp and pin feature 1710 for securing the stages together at the locations identified on FIGS. 120-121.

Figure 123:
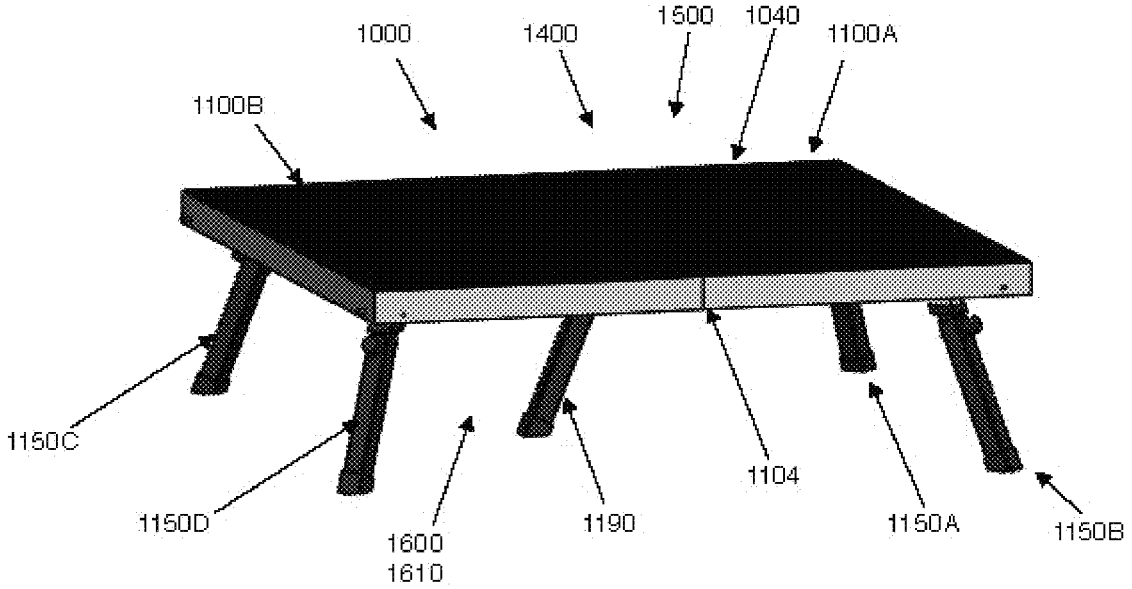
FIGS. 123-125 illustrate preferred features of a fifth preferred embodiment of a portable stage of the present invention.
Figure 124:
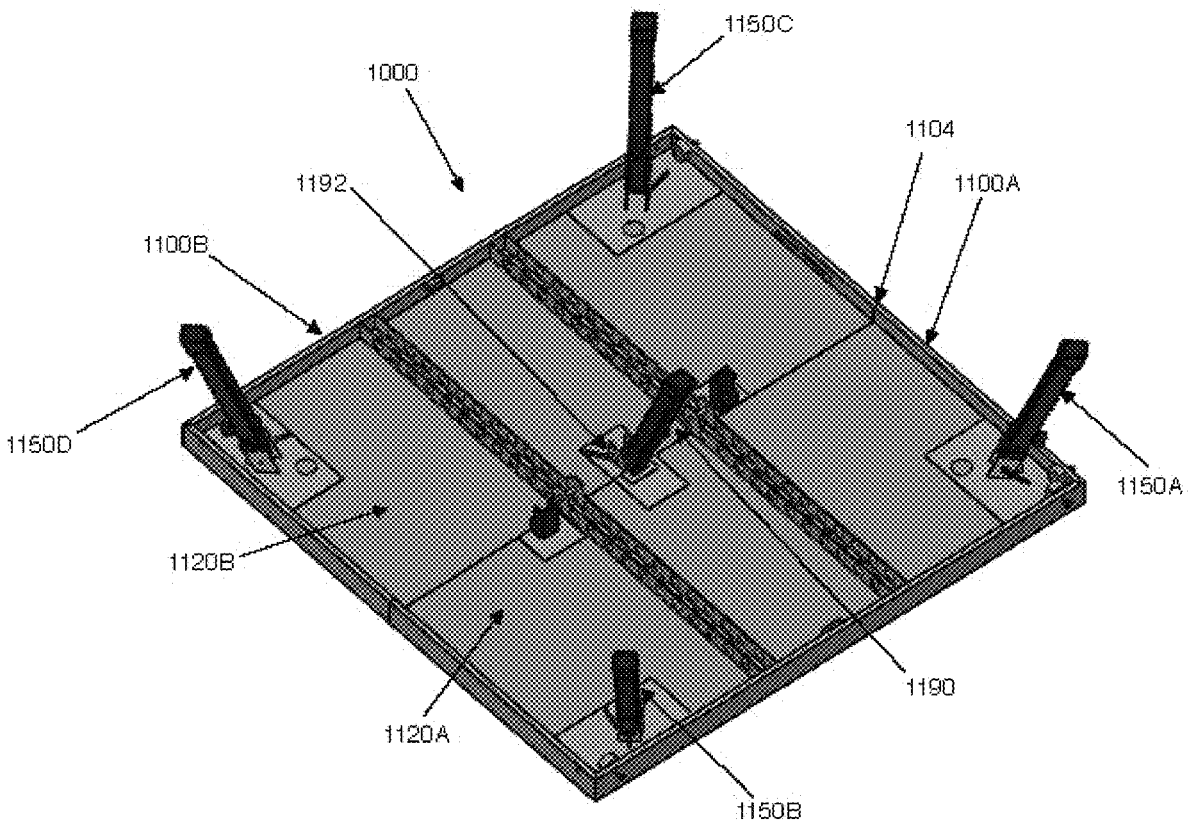
Figure 125:
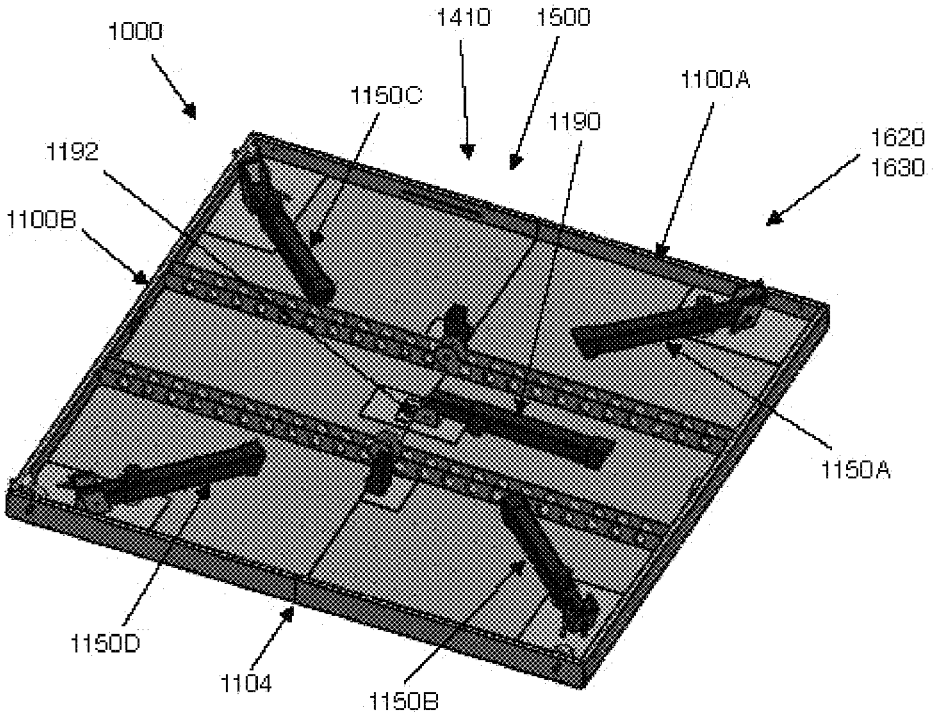

FIGS. 123-125 show a fifth preferred embodiment of a stage 1000 of the present invention. Elements of the fifth preferred embodiment of the stage 1000 corresponding to elements of the other preferred embodiments of the stage 1000 discussed herein have the same or similar features, unless otherwise discussed, and nevertheless, constitute additional and/or alternative features of such corresponding elements as to the other preferred embodiments of the stage 1000 discussed herein. Accordingly, such corresponding elements use the same or similarly indicative element numbers.

The fifth preferred embodiment of the stage 1000 is substantially similar to the fourth preferred embodiment of the stage 1000 with the additional or alternate feature that the central leg 1190 is angled with respect to the platform 1040 rather than perpendicular.

FIG. 123 illustrates the stage 1000 in a perspective view in an operational configuration 1400 in which the panels 1100A,B are in an open configuration 1500 and the legs 1150A-D,1190 are in a support configuration 1600,1610 and retracted. The central leg 1190 is angled with respect to the platform 1040, for, among other things, to enhance the support and stability of the stage 1000.

FIG. 124 illustrates the stage 1000 in a bottom perspective view in the configuration shown in FIG. 123. The components are substantially similar to those of the fourth preferred embodiment of the stage 1000, except that additionally or alternatively, the central leg 1190 is angled with respect to the bottom sides 1120A,B of the panels 1100A,B. This is achieved in this embodiment by the support position at which the central leg 1190 is locked in the support configuration 1610 at the rotational connection 1192 orienting the central leg 1190 at the desired angle.

FIG. 125 illustrates the stage 1000 in a bottom perspective view in a collapsed operational configuration 1410, in which the panels 1100A,B are in an open configuration 1500 and the legs 1150A-D,1190 are in a stowed configuration 1620, 1630. The components are substantially similar to those of the fourth preferred embodiment of the stage 1000, except that additionally or alternatively, the central leg 1190 can be rotated from the angled support configuration shown in FIG. 124 into the stowed configuration shown in FIG. 125 by the same or similar features and mechanisms described with respect to the fourth preferred embodiment of the stage 1000.

Figure 126:
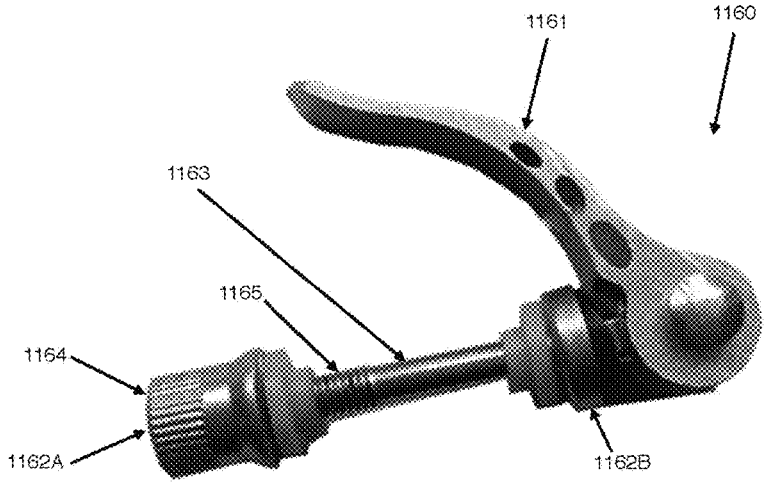
FIGS. 126-128 illustrate an additional or alternate leg rotation lock of certain preferred embodiments of the present invention.
Figure 127:
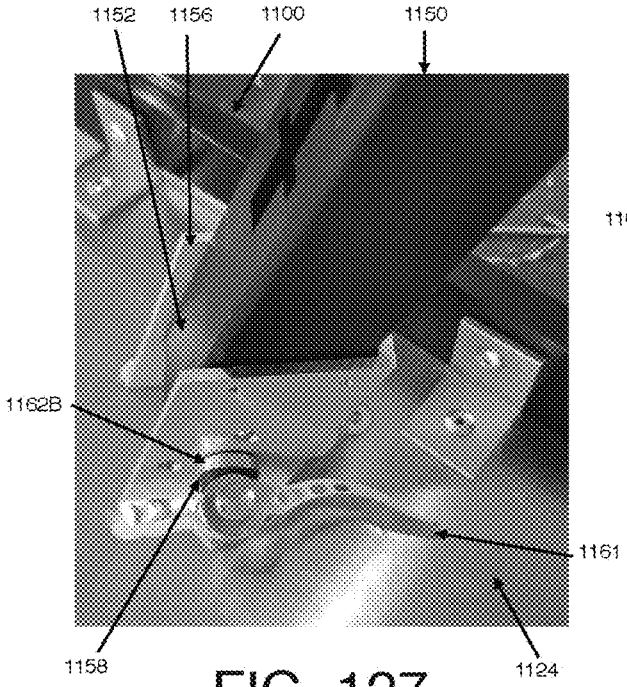
Figure 128:
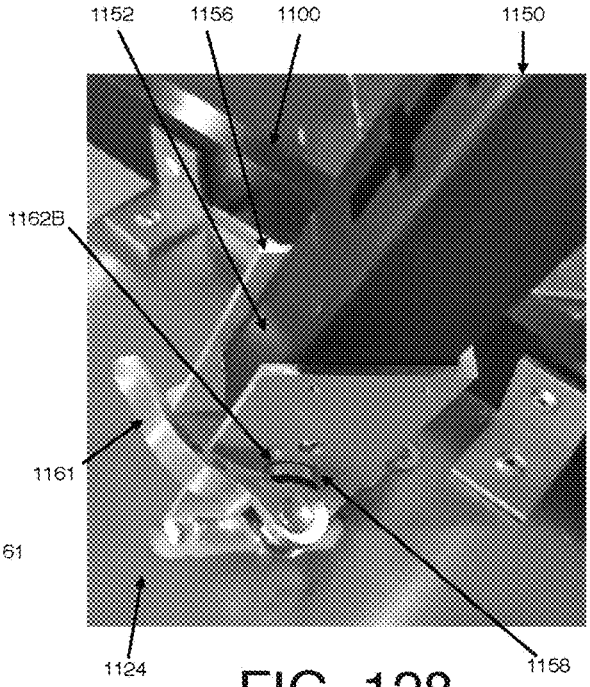
Figure 129:
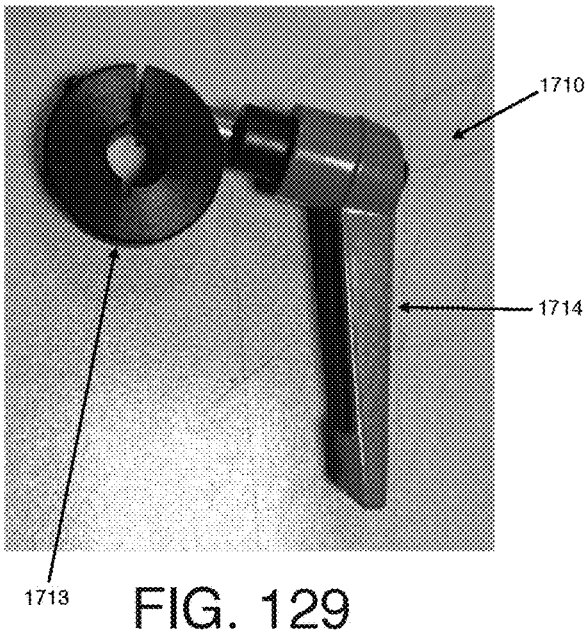
FIGS. 129-132 illustrate an additional or alternate clamp and pin feature of certain preferred embodiments of the present invention.
Figure 130:
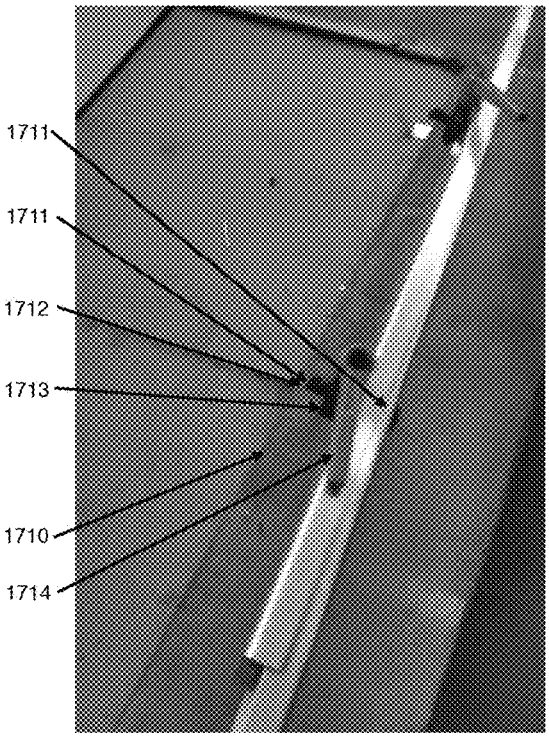
Figure 131:
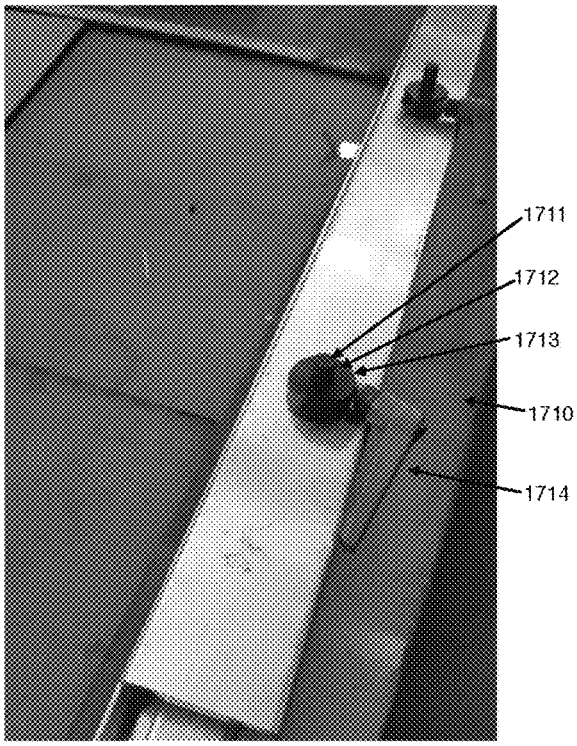
Figure 132:
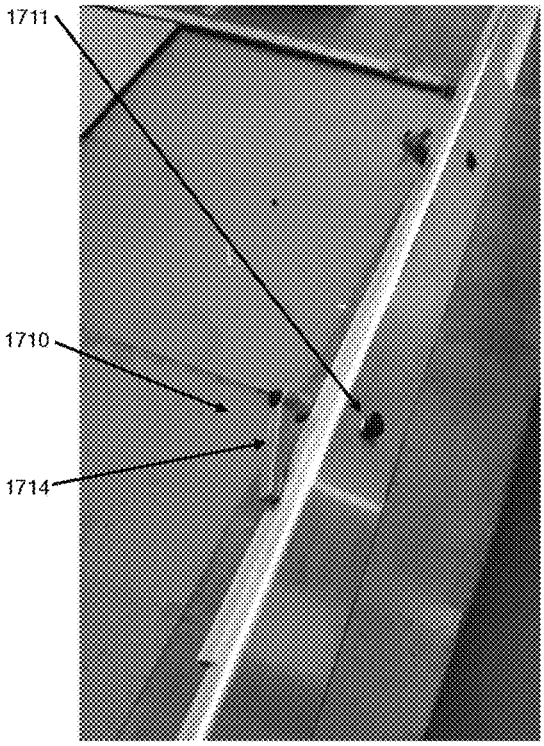

FIGS. 126-128 illustrate an additional or alternate leg rotation lock 1160 of the present invention, showing a lever 1161 for locking and unlocking the leg 1150 with respect to the base 1156 of the leg 1150. FIG. 126 shows the rod 1163 of the leg rotation lock 1160 that is passed through the components of the base 1156 and the leg 1150 and about which the distal end 1152 of the leg 1150 rotates, serving as the point of rotation 1158 for the rotation of the leg 1150 toward and away from the recess 1124 of the panel 1100. The lever 1161 when rotated in one direction (FIG. 128) locks the leg 1150 to the base 1156 by compressing the ends 1162A,1162B of the leg rotation lock 1160 together and thereby compressing the components of the base 1156 against the leg 1150 and holding them in compression, and in another direction (FIG. 127) unlocks the leg 1150 from the base 1156 by releasing from compression the ends 1162A,1162B of the leg rotation lock 1160 and thereby uncompressing the components of the base 1156 from the leg 1150. Accordingly, the leg 1150 can be locked in the stowed configuration 1620 (see FIGS. 102,104) and the support configuration 1600 (see FIGS. 102,104) as desired. The level of compression can be adjusted by moving one end 1126A of the lock 1160 closer to or farther away from the other end 1126B by rotating a control knob 1164 about a threaded portion 1165 of the rod 1163.

FIGS. 129-132 illustrate an additional or alternate clamp and pin feature 1710 useful for connecting two stages 1000A,B (see FIGS. 120-122) together at their sides 1144A,B (see FIGS. 120-122). A pin 1711 that passes through the sides 1144A,B (see FIGS. 120-122) can be, at one end 1712 of the pin 1711, be clamped by a clamp 1713 of the feature 1710 (to prevent the pin 1711 from backing out from between the sides 1144A,B), by rotating a handle 1714 of the feature 1710, and can be unclamped (to allow the pin 1711 to be removed from between the sides 1144A,B) by reverse rotating the handle 1714.

While the invention has been described herein in terms of specific embodiments, it is to be understood that the invention is not limited to these described embodiments. Upon reading the teachings of this disclosure many modifications and other embodiments of the invention will come to mind of those skilled in the art to which this invention pertains, and which are intended to be and are covered by this disclosure, including the accompanying figures and appended claims. It is intended that the scope of the invention should be determined by proper interpretation and construction of this disclosure, the accompanying figures, the appended claims, other possible claims, and the legal equivalents of all of the foregoing, as understood by those of skill in the art relying upon the entirety of this application.

What is claimed is:

1. A stage for elevating a platform of the stage over a surface on which the stage is placed, the stage comprising:

first and second panels movable relative to one another into an open configuration and a closed configuration, each panel having a recess; and first and second legs movable relative to the panels into a support configuration and a stowed configuration; wherein in the open configuration the panels define the platform and in the closed configuration the recesses define an enclosure;

in the support configuration, the legs extend from the recesses to the surface when the stage is on the surface;

in the stowed configuration, the legs fit within the recesses except for minority portions of each that remain outside the recesses;

when the panels are in the closed configuration and the legs are in the stowed configuration, the legs fit fully within the enclosure but neither leg fits fully within either recess;

each panel defines a respective half of the platform when the panels are in the open configuration;

each recess defines a respective half of the enclosure when the panels are in the closed configuration;

the first leg supports an area of the first panel platform half;

the second leg supports an area of the second panel platform half;

the areas are substantially similar in size;

when the panels are in the open configuration, with respect to a middle of the platform, the areas are symmetrically opposite one another on the panels and the legs are positioned asymmetrically opposite one another in the recesses; and when the panels are in the closed configuration, with respect to a middle of the enclosure, the areas are symmetrically opposite one another on the panels and the legs are positioned asymmetrically opposite one another in the recesses.

2. The stage according to claim 1, wherein each minority portion includes at least a portion of a support; and when the panels are in the open configuration and the legs are in the stowed configuration, the supports elevate the platform over the surface when the stage is on the surface.

3. The stage according to claim 2, wherein each leg includes a proximal end and a base thereat having a point of rotation of the leg;

the first leg support is attached to the first leg base; and the second leg support is attached to the second leg base.

4. The stage according to claim 1, wherein each panel includes an edge; and the panels are rotationally connected to one another at the edges such that the panels can be unfolded away from one another into the open configuration and folded toward one another into the closed configuration.

5. The stage according to claim 4, wherein each panel includes a top surface and a bottom side;

each top surface provides a respective portion of the platform when the panels are in the open configuration; and each bottom side has a respective one of the edges and a respective one of the recesses.

6. The stage according to claim 1, wherein the stage is configurable into an operational configuration and a portable configuration;

in the operational configuration, the panels provide a platform occupiable by a plurality of persons simultaneously and the legs support the platforms when occupied by the persons; and in the portable configuration, the stage can be carried by one of the persons individually without assistance.

7. The stage according to claim 6, wherein in the operational configuration, the panels are in a platform configuration in which the panels provides the platform, and the legs are in a support configuration in which the legs extend from the platform; and in the portable configuration, the panels are in a closed configuration in which the panels do not provide the platform, and the legs are in a stowed configuration in which the legs do not extend from the platform.

8. The stage according to claim 7, wherein the operational configuration is a first operational configuration and the stage is configurable into a second operational configuration; and in the second operational configuration, the panel is in the platform configuration and the leg is in the stowed configuration.

9. The stage according to claim 6, wherein the stage is convertible from the operational configuration to the portable configuration by the one of the persons individually without assistance.

10. The stage according to claim 6, wherein the platform is substantially square with a surface area of at least 16 square feet;

the panels includes first and second halves that are foldably connected to one another at a midline of the panels such that they are foldable toward one another and unfoldable away from one another;

in the platform configuration, the halves are fully unfolded;

in the closed configuration the halves are fully folded;

the stage includes five legs including the first and second legs;

when the stage is in the operational configuration, one of the legs supports a middle area of the platform and each of the remaining legs supports a respective corner area of the platform; and when the stage is in the portable configuration, the legs are fully enclosed by the halves.

11. The stage according to claim 10, wherein the midline has first and second ends;

the stage includes a shoulder strap extending from the first end of the midline to the second end of the midline; and when the stage is in the portable configuration, the stage is carryable by the one of the persons by use of the shoulder strap.

12. The stage according to claim 6, wherein the stage weighs less than 20 pounds; and in the operational configuration, the stage supports a weight load on the platform of at least 50 pounds per square foot.

13. The stage of claim 1, wherein the stage is a plurality of such stages together forming a stage group for providing a performance area elevated above a surface on which the group is placed, the group comprising:

a first of the plurality of stages wherein its platform defines a first stage plane, the first stage platform having a first stage edge defining an intersection of the first stage plane and a boundary perpendicular to the first stage plane, the first stage having at least one of its legs extending from the first stage platform such that a distal portion of the first stage leg crosses the first stage boundary; and a second of the plurality of stages wherein its platform defines a second stage plane, the second stage platform having a second stage edge defining an intersection of the second stage plane and a boundary perpendicular to the second stage plane, the second stage having at least one of its legs extending from the second stage platform such that a distal portion of the second stage leg crosses the second stage boundary; wherein when the edges are aligned, the first stage leg crosses the second stage boundary without interfering with the second stage extending leg, the second stage leg crosses the first stage boundary without interfering with the first stage extending leg, and the two platforms define the performance area.

14. The stage according to claim 13, wherein the first stage extending leg supports an area of the first stage platform;

the second stage extending leg supports an area of the second stage platform;

the areas are substantially similar in size;

the alignment of the edges defines a line between the platforms;

with respect to the line, the areas are symmetrically opposite one another on the platforms and the extending legs are positioned asymmetrically opposite one another under the platforms; and the asymmetrical positioning of the extending legs causes the non-interference of the extending legs.

15. The stage according to claim 13, further comprising:

a third of the plurality of stages wherein its platform defines a third stage plane, the third stage platform having a first third stage edge defining an intersection of the third stage plane and a first boundary perpendicular to the third stage plane, the third stage platform having a second third stage edge defining an intersection of the third stage plane and a second boundary perpendicular to the third stage plane and to the first third stage boundary, the third stage having at least one of its legs extending from the third stage platform such that a distal portion of the third stage extending leg crosses the first third stage boundary;

a fourth of the plurality of stages wherein its platform defines a fourth stage plane, the fourth stage platform having a first fourth stage edge defining an intersection of the fourth stage plane and a first boundary perpendicular to the fourth stage plane, the fourth stage platform having a second fourth stage edge defining an intersection of the fourth stage plane and a second boundary perpendicular to the fourth stage plane and to the first fourth stage boundary, the fourth stage having at least one of its legs extending from the fourth stage platform such that a distal portion of the fourth stage extending leg crosses the first fourth stage boundary; wherein the first stage platform edge is a first edge of the first stage platform, and the first stage boundary is a first boundary perpendicular to the first stage plane, and the first stage platform further has a second edge defining an intersection of the first stage plane and a second boundary perpendicular to the first stage plane and to the first first stage boundary;

the second stage platform edge is a first edge of the second stage platform, and the second stage boundary is a first boundary perpendicular to the second stage plane, and the second stage platform further has a second edge defining an intersection of the second stage plane and a second boundary perpendicular to the second stage plane and to the first second stage boundary;

when the first stage platform first edge is aligned with the second stage platform first edge, and the second stage platform second edge is aligned with the third stage platform second edge, and the third stage platform first edge is aligned with the fourth stage platform first edge, and the fourth stage platform second edge is aligned with the first stage platform second edge, none of the extending legs interfere with any of the other extending legs.

16. The stage according to claim 15, wherein the first stage extending leg supports an area of the first stage platform;

the second stage extending leg supports an area of the second stage platform;

the third stage extending leg supports an area of the third stage platform;

the fourth stage extending leg supports an area of the fourth stage platform;

the areas are substantially similar in size;

the alignment of the edges defines a line between the first and second platforms, a line between the second and third platforms, a line between the third and fourth platforms, and a line between the fourth and first platforms;

with respect to each line, the areas of the platforms on either side of the respective line are symmetrically opposite one another on the platforms on either side of the respective line and the extending legs of the stages on either side of the respective line are positioned asymmetrically opposite one another under the platforms on either side of the respective line; and the asymmetrical positioning of the extending legs causes the non-interference of the extending legs.

17. A stage for elevating a platform of the stage over a surface on which the stage is placed, the stage comprising:

first and second panels movable relative to one another into an open configuration and a closed configuration, each panel having a recess; and first and second legs movable relative to the panels into a support configuration and a stowed configuration; wherein in the open configuration the panels define the platform and in the closed configuration the recesses define an enclosure;

in the support configuration, the legs extend from the recesses to the surface when the stage is on the surface;

in the stowed configuration, the legs fit within the recesses except for minority portions of each that remain outside the recesses;

when the panels are in the closed configuration and the legs are in the stowed configuration, the legs fit fully within the enclosure but neither leg fits fully within either recess;

each minority portion includes at least a portion of a support;

when the panels are in the open configuration and the legs are in the stowed configuration, the supports elevate the platform over the surface when the stage is on the surface;

each leg includes a distal end and a foot thereat;

the first leg support is spaced from the first leg foot and from a first leg base;

the second leg support is spaced from the second leg foot and from a second leg base; and when the legs are in the stowed configuration, the first leg foot fits fully within the first panel recess and the second leg foot fits fully within the second panel recess.

18. The stage according to claim 17, wherein each panel defines a respective half of the platform when the panels are in the open configuration; and each recess defines a respective half of the enclosure when the panels are in the closed configuration.

19. The stage according to claim 18, wherein the first leg supports an area of the first panel platform half;

the second leg supports an area of the second panel platform half;

the areas are substantially similar in size;

when the panels are in the open configuration, with respect to a middle of the platform, the areas are symmetrically opposite one another on the panels and the legs are positioned asymmetrically opposite one another in the recesses; and when the panels are in the closed configuration, with respect to a middle of the enclosure, the areas are symmetrically opposite one another on the panels and the legs are positioned asymmetrically opposite one another in the recesses.

20. A stage for elevating a platform of the stage over a surface on which the stage is placed, the stage comprising first and second panels movable relative to one another into an open configuration and a closed configuration, each panel having a recess; and first and second legs movable relative to the panels into a support configuration and a stowed configuration; wherein in the open configuration the panels define the platform and in the closed configuration the recesses define an enclosure;

in the support configuration, the legs extend from the recesses to the surface when the stage is on the surface;

in the stowed configuration, the legs fit within the recesses except for minority portions of each that remain outside the recesses;

when the panels are in the closed configuration and the legs are in the stowed configuration, the legs fit fully within the enclosure but neither leg fits fully within either recess;

the stage includes a third leg movable relative to the panels into a third leg support configuration and a third leg stowed configuration;

when the panels are in the open configuration and the third leg is in the third leg support configuration, the third leg supports both panels; and in the third leg stowed configuration, the third leg fits fully within one of the recesses.

* * * * *